US006066440A

United States Patent [19]

Araki et al.

[11] Patent Number: 6,066,440

[45] Date of Patent: May 23, 2000

[54] SILVER HALIDE PHOTOSENSITIVE MATERIAL AND METHOD FOR FORMING IMAGE

[75] Inventors: Yasushi Araki; Yoichi Hosoya; Mitsuo Saitou, all of Kanagawa, Japan

[73] Assignee: Fuji Photo Film Co., Ltd., Kanagawa, Japan

[21] Appl. No.: 09/035,205

[22] Filed: Mar. 5, 1998

[30] Foreign Application Priority Data

Mar. 5, 1997 [JP] Japan ..... 9-067396
Sep. 9, 1997 [JP] Japan ..... 9-261013

[51] Int. Cl.[7] ..... G03C 7/00; G03C 5/40

[52] U.S. Cl. ..... 430/354; 430/203; 430/351; 430/383; 430/405; 430/640; 430/642

[58] Field of Search ..... 430/203, 351, 430/640, 642, 567, 354, 405, 483, 300, 383

[56] References Cited

U.S. PATENT DOCUMENTS 5,587,281 12/1996 Saitou et al. ..... 430/567
5,607,827 3/1997 Kirk et al. ..... 430/567
5,756,269 5/1998 Ishikawa et al. ..... 430/351

FOREIGN PATENT DOCUMENTS

0762201 A1 3/1997 European Pat. Off. .

*Primary Examiner*—Thorl Chea
*Attorney, Agent, or Firm*—Sughrue, Mion, Zinn, Macpeak & Seas, PLLC

[57] ABSTRACT

Disclosed is a silver halide photosensitive material comprising a support and a photosensitive layer formed thereon. The photosensitive layer comprises at least a photosensitive silver halide emulsion, a developing agent, a compound which forms a dye by a coupling reaction with an oxidized form of the developing agent, and a binder. The silver halide photosensitive material after the exposure thereof is put together with a processing material, which comprises a processing layer containing at least a base and/or a base precursor, in the presence of water supplied between the layer of the silver halide photosensitive material and the layer of the processing material in an amount ranging from 1/10 to the equivalent of an amount which is required for the maximum swelling of the total of the layers of these materials excluding back layers thereof, and these materials are heated to form a color image in the silver halide photosensitive material, in which the photosensitive layer comprises gelatin which is modified so that the interaction thereof with silver is reduced, and a silver halide emulsion in which tabular silver halide grains, each having an aspect ratio of 2 or more, account for 50% or more of the total projected area of the silver halide grains of the emulsion. Also disclosed is a method for forming an image by using this silver halide photosensitive material.

20 Claims, No Drawings

SILVER HALIDE PHOTOSENSITIVE MATERIAL AND METHOD FOR FORMING IMAGE

BACKGROUND OF THE INVENTION

1. Field of the Invention

The present invention relates to a novel silver halide color photographic photosensitive material and a novel method for forming an image by using said photosensitive material.

2. Description of the Related Art

The so-called color negative, which is known in conventional color photography, generally contains a yellow dye image forming layer for recording blue light, a magenta dye image forming layer for recording green light, and a cyan dye image forming layer for recording red light. In the developing process a developing agent is oxidized when silver halide grains containing a latent image are reduced to silver, so that a dye image is formed by a (coupling) reaction between a coupler and the oxidized form of the developing agent. The unreacted silver halide and the developed silver generated are removed through bleaching and fixing processes that follow. Subsequently, color photographic printing paper is optically exposed to light through the dye image of the color negative, and is again subjected to the same developing, bleaching and fixing processes to obtain a color print.

Also known is a method in which, after image information contained in the color negative is optoelectrically read, the image information is processed to produce image information for image recording and for producing color images on other printing materials by using the image information for image recording. In particular, a digital photoprinter, in which the image information is converted into digital signals and a photosensitive material such as color paper is scan-exposed to light modulated in accordance with the signals to obtain a color print, is being developed and an example of the digital photoprinter is described in Japanese Patent Application Laid-Open (JP-A) No. 7-15,593.

Since the above-mentioned methods are based on conventional wet-process development, bleaching and fixing, they are complicated.

In contrast with such methods, simple and rapid processes using heat development are being developed for the processing of silver halide color photosensitive materials. Examples are the Pictrography and Pictrostat products developed by Fuji Photo Film Co., Ltd. An embodiment of the heat development is a process in which a photosensitive material is processed in the presence of a small amount of water and a base and/or a base precursor; For example, Japanese Patent Application Publication (JP-B) No. 2-51, 494.

Many of these photosensitive materials for use in heat development were photosensitive materials for print. But the recent JP-A No. 9-10,506 discloses an example in which photosensitive material used in photographing is heat developed in the presence of a small amount of water and a base and/or a base precursor. Then the image obtained is read, image-processed and outputted to a printing material. However, since the silver halide emulsion used in this example was not highly sensitive, the sensitivity/RMS granularity was not satisfactory. That is, the problem was that the print obtained by reading and image-processing an image obtained was inferior to a conventional photograph in sensitivity/RMS granularity.

Tabular silver halide grains are known as a highly sensitive silver halide. This is because the tabular silver halide grains have a larger surface area/volume ratio, and therefore a highly sensitive silver halide emulsion can be prepared by the adsorption of a large amount of sensitizing dye onto the grains. The ratio of the major plane to the thickness of the tabular silver halide grain is called the aspect ratio. The larger this aspect ratio is, the larger the surface area/volume ratio of the grain is.

However, the problem was that spotted color unevenness was generated when a photosensitive material was processed by a simple and rapid heat development in the presence of a small amount of water and a base and/or a base precursor even when the photosensitive material comprises silver halide grains having a high aspect ratio used in silver halide photosensitive materials for use in conventional photography. As a result, a highly sensitive silver halide having a high sensitivity/RMS granularity could not be used.

SUMMARY OF THE INVENTION

A first object of the present invention is to provide a silver halide photosensitive material which exhibits a high sensitivity/RMS granularity even in a simple and rapid heat developing process. A second object of the present invention is to provide a silver halide photosensitive material which generates no spotted color unevenness even in a simple and rapid heat developing process, and, more particularly, to provide a silver halide photosensitive material which generates no spotted color unevenness even when a highly sensitive emulsion composed of grains having a high aspect ratio is used and which has a high sensitivity/RMS granularity. A third object of the present invention is to provide a novel method for forming an image using these silver halide photosensitive materials.

The objectives were effectively achieved by the silver halide photosensitive materials described in the following items 1) to 8) and by the method for forming an image which uses these silver halide photosensitive materials and is described in the following item 9).

1) A silver halide photosensitive material comprising a support and at least one photosensitive layer formed thereon, the photosensitive layer comprising at least a photosensitive silver halide emulsion, a developing agent, a compound, which forms a dye by a coupling reaction with an oxidized form of the developing agent, and a binder, the silver halide photosensitive material after the exposure thereof being put together with a processing material, which comprises a support and a processing layer coated thereon containing at least a base and/or a base precursor, in the presence of water supplied between the layer of the silver halide photosensitive material and the layer of the processing material in an amount ranging from 1/10 to the equivalent of an amount which is required for the maximum swelling of the total of the layers of these materials excluding back layers thereof so that the layers face each other, and being heated to form a color image in the silver halide photosensitive material, in which the photosensitive layer comprises gelatin which is chemically modified so that the interaction thereof with silver is reduced, and a silver halide emulsion in which tabular silver halide grains, each having an aspect ratio of 2 or more where the aspect ratio is defined as a value obtained by dividing the projected grain diameter by the grain thickness, account for 50% or more of the total projected area of the silver halide grains of the emulsion.

2) A silver halide photosensitive material comprising a support and at least one photosensitive layer formed thereon, the photosensitive layer comprising at least a photosensitive silver halide emulsion, a binder and a colorant which releases or diffuses a diffusive dye in proportion or in reverse proportion to the development of silver, the silver halide photosensitive material after the exposure thereof being put together with a processing material, which comprises a support and a processing layer coated thereon containing at least a base and/or a base precursor, in the presence of water supplied between the layer of the silver halide photosensitive material and the layer of the processing material in an amount ranging from 1/10 to the equivalent of an amount which is required for the maximum swelling of the total of the layers of these materials excluding back layers thereof so that the layers face each other, and being heated to form a color image in the silver halide photosensitive material by removing part or all of the released or diffused diffusive dye through transfer thereof from the photosensitive material to the processing material, in which the photosensitive layer comprises gelatin which is chemically modified so that the interaction thereof with silver is reduced, and a silver halide emulsion in which tabular silver halide grains, each having an aspect ratio of 2 or more where the aspect ratio is defined as a value obtained by dividing the projected grain diameter by the grain thickness, account for 50% or more of the total projected area of the silver halide grains of the emulsion.

3) The amount of calcium ion contained in the photosensitive layer of the silver halide photosensitive material of the present invention is preferably 4,000 ppm or less with respect to the amount of gelatin.

4) In the silver halide photosensitive material of the present invention, the gelatin which is chemically modified so that the interaction thereof with silver is reduced is preferably at least one selected from the following (i) to (v):

(i) gelatin having a methionine content of 50 μmol or less per gram of gelatin;

(ii) gelatin having an —$NH_2$ group content of 720 μmol or less per gram of gelatin;

(iii) gelatin having an —NH— group content of 1,800 μmol or less per gram of gelatin;

(iv) gelatin containing a —COOH group and a derivative thereof in an amount of 1,200 μmol or more per gram of gelatin; and (v) gelatin containing a —$SO_3H$ group and a derivative thereof in an amount of 5 μmol or more per gram of gelatin.

5) In the silver halide photosensitive material of the present invention, the gelatin which is chemically modified so that the interaction thereof with silver is reduced is preferably a gelatin whose amino groups are chemically modified such that at least two carboxyl groups are introduced into the chemically modified parts.

6) In the silver halide photosensitive material of the present invention, the gelatin whose amino groups are chemically modified such that at least two carboxyl groups are introduced into the chemically modified parts are preferably a trimellitated gelatin.

7) In the silver halide photosensitive material of the present invention, the trimellitated gelatin is preferably a gelatin which is trimellitated such that the amino group content of the gelatin is 190 μmol or less per gram of the gelatin.

8) In the silver halide photosensitive material of the present invention, the developing agent is preferably at least one compound represented by any of the following general formulas (1) to (5):

General formula (1)

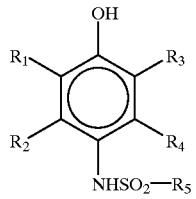

General formula (2)

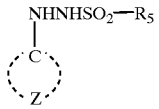

General formula (3)

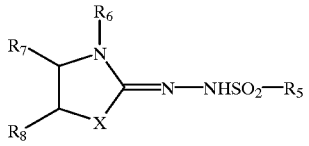

General formula (4)

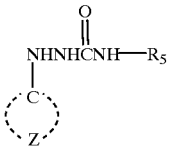

General formula (5)

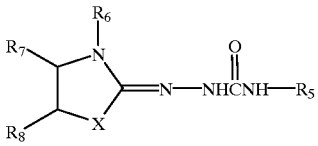

where $R_1$ to $R_4$ each represents a group selected from the group consisting of a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group; $R_5$ represents an alkyl group, an aryl group or a heterocyclic group; Z stands for a group of atoms forming an aromatic ring (including a heterocyclic/aromatic ring) and the total of Hammett's constants σ of the substituents is 1 or greater if Z is a benzene ring; $R_6$ represents an alkyl group; X represents a group selected from the group consisting of an oxygen atom, a sulfur atom, a selenium atom and a tertiary nitrogen atom bearing an alkyl and aryl substituent; $R_7$ and $R_8$ represent a group selected from the group consisting of a hydrogen atom and a substituent; and $R_7$ and $R_8$may join together to form a double bond or a ring.

9) The method for forming an image according to the present invention comprises putting the silver halide photosensitive material which is described in any one of the items 1) to 8), after imagewise exposure thereof, together with a processing material in the presence of water supplied between the photosensitive material and the processing material in an amount ranging from 1/10 to the equivalent of an amount which is required for the maximum swelling of the total of the layers of these materials, and heating these materials at 60 to 100° C. for 5 to 60 seconds to form a color image in the photosensitive material.

DESCRIPTION OF THE PREFERRED EMBODIMENTS

In the present invention, after a color image is formed by a heat developing process, the unreacted silver halide and/or the developed silver may be or may not be removed. The outputting of the image information to other material may be performed by a conventional projection exposure, or may be performed by a procedure comprising reading out the image information photoelectrically by measuring the density of transmitted light. Output is produced via these signals. A material which receives the output does not need to be a photosensitive material. It may be a sublimation-type heat-sensitive recording material, an ink-jet recording material, an electrophotographic material, a full-color direct heat-sensitive recording material, or the like. Preferred embodiments in the present invention comprise the steps of forming a color image by a heat developing process, reading out the image information photoelectrically by measuring the density of transmitted light utilizing the diffused light and a CCD image sensor without any additional processing to remove the unreacted silver halide and the developed silver, converting the image information into digital signals, image processing the signals, and outputting the resulting signals by using a color printer for a heat developing process, such as Pictrography 3000 manufactured by Fuji Photo Film Co., Ltd. In this procedure, a superior print can be obtained rapidly without using a processing solution which is used in conventional color photography. In this procedure, since the digital signals can be edited at will, a photographed image can be outputted after being freely corrected, modified and treated.

In the present invention, the gelatin which is chemically modified such that the interaction thereof with silver is reduced may be a gelatin whose interaction with silver is reduced by chemically modifying a group which is contained in the gelatin and interacts with silver, a gelatin to which a group that increases affinity with water is added, or a gelatin from which all amino acids having groups that interact with silver are removed by an enzyme or the like. Although it is difficult to quantitatively determine directly the amount of the group in the gelatin that interacts with silver, analysis of gelatin by a commonly adopted analytical method for amino acids quantifies the amino acid composition of the gelatin, and the quantified amino acid composition can be used to determine the proportions of groups contained in the gelatin.

As for groups contained in gelatin and interacting with silver, —SH of cystine, —S— of methionine, —$NH_2$ of lysine, —$NH_2$ and —NH— of arginine and —NH— of hystidine are well known. Further, the interaction between silver and groups, such as —NH— and —$NH_2$, and oxygen and nitrogen atoms, such as —O— and —N═, in proline, hydroxyproline and hydroxylysine, is not insignificant. In the present invention, a method for chemically modifying these groups is not limited, and in principle any method may be adopted if the interaction between these groups and silver is reduced. The scehemically modifying methods are used in the wide research in the field of protein engineering. Not all of these methods can be mentioned. Some of the typical methods are given below.

—S— of methionine in gelatin can be converted into methionine sulfone and methionine sulfoxide by an oxidant such as an aqueous solution of hydrogen peroxide or ozone, and thus the interaction between methionine and silver can be reduced. Meanwhile, the —$NH_2$ groups contained in lysine, arginine and the like can be converted into an amide by an anhydride, such as acetic anhydride, phthalic anhydride, trimellitic anhydride pyromellitic anhydride or mellitic anhydride, or by an acid halide, or can be converted into an imine by an aldehyde such as formaldehyde. The —NH— groups contained mainly in compounds such as hystidine, proline and hydroxyproline can be chemically modified by an acid halide such as acetyl chloride, acetyl bromide and acetyl iodide.

A group which is added in order to increase the affinity of gelatin with water is not limited, and basically any group can be used if the group added increases the solubility of gelatin in water. Examples of the group to be used for this purpose include —COOH, —OH and —$SO_3H$ groups. Also, derivatives such as —COONa, —COOK, —$SO_3Na$ and —$SO_3K$ may be used.

It is preferable to chemically modify a group which is contained in gelatin and which interacts with silver and further to add a water-soluble group to the gelatin, because such a treatment is doubly effective.

In the chemical modification to reduce the interaction between gelatin and silver, the higher the level of the chemical modification the better. However, if all interaction is lost, the silver particles flocculate and dispersion is low. Therefore, it is desired that the interaction between gelatin and silver be reduced to a minimum while maintaining the function of the gelatin as a protective colloid.

In the present invention, the gelatin which is modified so that the interaction thereof with silver is reduced is preferably any one selected from the following (i) to (v):

(i) gelatin having a methionine content of 50 μmol or less per gram of gelatin, and more preferably gelatin having a methionine content of 20 μmol or less per gram of gelatin;

(ii) gelatin having an —$NH_2$ group content of 720 μmol or less per gram of gelatin, more preferably gelatin having an —$NH_2$ group content of 500 μmol or less per gram of gelatin, and most preferably gelatin having an —$NH_2$ group content of 190 μmol or less per gram of gelatin;

(iii) gelatin having an —NH— group content of 1,800 μmol or less per gram of gelatin, more preferably gelatin having an —NH— group content of 1,000 μmol or less per gram of gelatin, and most preferably gelatin having an —NH— group content of 270 μmol or less per gram of gelatin;

(iv) gelatin containing a —COOH group and a derivative thereof in an amount of 1,200 μmol or more per gram of gelatin, more preferably gelatin containing a —COOH group and a derivative thereof in an amount of 1,700 μmol or more per gram of gelatin, and most preferably gelatin containing a —COOH group and a derivative thereof in an amount of 2,300 μmol or more per gram of gelatin; and (v) gelatin containing an —$SO_3H$ group and a derivative thereof in an amount of 5 μmol or more per gram of gelatin, more preferably gelatin containing a —$SO_3H$ group and a derivative thereof in an amount of 20 μmol or more per gram of gelatin, and most preferably gelatin containing a —$SO_3H$ group and a derivative thereof in an amount of 50 μmol or more per gram of gelatin.

In the present invention, it is preferable for one photosensitive layer to have a calcium ion content of 4,000 ppm or less with respect to the amount of gelatin. In the case where the calcium ion content is reduced, a silver halide photosensitive material (hereinafter abbreviated as "photosensitive material" on occasion), which contains tabular silver halide grains and gelatin whose interaction with silver is reduced, can become a photosensitive material which has a high sensitivity/RMS granularity and yet produces no spotted color unevenness even if a heat development process is performed. Since the calcium ion in the photosensitive material is mostly derived from gelatin serving as a binder, in the present invention the above-mentioned requirement for the calcium ion concentration can be met by using gelatin having a calcium content of 4,000 ppm or less with respect to the amount of gelatin. Basically, although the type of gelatin is not limited, preferably it is acid-processed or alkali-processed gelatin. The calcium content is preferably 3,500 ppm or less, more preferably 1,000 ppm or less, and most preferably 100 ppm or less with respect to the amount of gelatin. The calcium ion content of gelatin can be quantitatively determined by EDTA chelatometric titration according to Puggy's method. Although the method for removing the calcium ion is not limited, generally the calcium ion is removed preferably through an ion-exchange resin.

The silver halide for use in the present invention may be any one selected from the group consisting of silver iodobromide, silver chloroiodobromide, silver bromide, silver chlorobromide, silver iodochloride and silver chloride. Any of these silver halides is selected depending on the properties which are to be imparted to the silver halide photosensitive material. For example, if a high level of sensitivity is required as in the case of a photographing material, a silver iodobromide emulsion is mostly used. Meanwhile, for use as a printing material in which importance is attached to rapid and simplified processing, a silver chloride emulsion is often used. However, recent attempts made to utilize a silver chloride emulsion in order to hasten the processing of photographic materials has been reported.

The size of silver halide grains which constitute the photosensitive emulsion is preferably 0.1 to 2 $\mu$m, and most preferably 0.2 to 1.5 $\mu$m when the size is expressed as a diameter equivalent to that of a sphere having the same volume as the grain. As for the shape of the silver halide grains, hexagonal or rectangular tabular grains account for 50% or more, more preferably 80% or more, and most preferably 90% or more of the total projected area of the silver halide grains of the emulsion.

In order to impart a high level of sensitivity to the photosensitive material, it is most preferable to use tabular grains having a high aspect ratio. That is, grains having a larger projected diameter with respect to thickness. The aspect ratio as written here refers to the value obtained by dividing the diameter of a circle having an area equivalent to the projected area of the grain by the thickness of the grain. In a silver halide emulsion for use as a photographing material, tabular grains, each having an aspect ratio of 2 or more, preferably 5 or more, more preferably 8 or more, and most preferably 20 or more, account for 50% or more preferably 80% or more, and more preferably 90% or more of the total projected area of the silver halide grains of the emulsion. When using smaller grains (about 0.5 $\mu$m or less as an equivalent-sphere diameter), the grains preferably have a planarity of 25 or more, where the planarity is defined as a value obtained by dividing the aspect ratio by the thickness of grain.

When compared on the basis of the same volume of grains, grains having a higher aspect ratio provide a larger projected area and therefore the rate of spectral sensitization of the grains can be increased. Further, if photographic sensitivity is proportional to the projected area of the grains, the same sensitivity can be achieved by a smaller amount of silver halide. Meanwhile, if the projected area of grains is kept constant when preparing the grains, the number of the grains can be increased by using grains having a higher aspect ratio even if the amount of the silver halide used is the same and therefore the granularity can be improved. Further, the use of tabular grains having a high aspect ratio decreases the amount of scattered light having a larger angle of scattering to the passageway of incident light, and, as a result, the sharpness can be increased.

The techniques for using these tabular grains having a high aspect ratio and characteristics of these tabular grains having a high aspect ratio are disclosed in U.S. Pat. Nos. 4,433,048, 4,434,226 and 4,439,520. Further, techniques concerning the tabular grains having a grain thickness of less than 0.07 $\mu$m and a very high aspect ratio are disclosed in U.S. Pat. Nos. 5,494,789, 5,503,970, 5,503,971 and 5,536,632, European Patent Nos. 0,699,945, 0,699,950, 0,699,948, 0,699,944, 0,701,165 and 0,699,946. The tabular grains having a high aspect ratio described in these references are composed mainly of silver bromide or silver iodobromide and are often hexagonal tabular grains having a (111) plane as the major crystal face. The grain which has the above-described shape usually has in the inside thereof two parallel twinning plane parallel to the (111) plane. An important technique to prepare tabular grains having a small grain thickness and a high aspect ratio is to decrease the distance between the two parallel twinning plane. For this purpose, it is important to control parameters such as the concentration of binder, temperature, pH, the kind of excess halogen ion, the ion concentration of the excess halogen ion and the supply rate of a reaction solution when nuclei are created. Another key to the preparation of the tabular grains having a high aspect ratio is to grow the created tabular nuclei selectively in the peripheral direction of the tabular shape. Not in the direction of the thickness. For this purpose, it is important not only to control the adding rate of a reaction solution for growing the grains but also to select the most suitable binder in the stages ranging from the formation of grains to the growth of grains. Some of the references enumerated above disclose that gelatin having a low methionine content is beneficial to the preparation of grains having a high aspect ratio.

Also, gelatin having an amino (—$NH_2$) group chemically modified is very beneficial to the preparation of silver halide grains having a high aspect ratio. For example, Japanese patent Application Laid-open (JP-A) No. 8-82,883 describes how phthalated gelatin obtained by treating gelatin with phthalic anhydride is effective. In the case of the phthalated gelatin, the chemical modification of an amino group leads to the formation of gelatin having one carboxyl group at the end of the modified site. If trimellitated gelatin which is prepared by treating an amino group of gelatin with trimellitic anhydride is used, it is possible to prepare very thin monodispersed tabular grains, uniform in grain size and having a high aspect ratio. If gelatin is trimellitated, the chemical modification of an amino group leads to the formation of gelatin having two carboxyl groups at the end of the modified site. Since the expected effect increases as the number of the trimellitated amino groups increases, gelatin after the trimellitation thereof has an —$NH_2$ group content of preferably 720 $\mu$mol or less, more preferably 190 $\mu$mol or less, even more preferably 73.2 $\mu$mol or less, and most preferably 36.6 $\mu$mol or less per gram of gelatin.

On the other hand, techniques in which tabular grains are formed by using a silver halide having a high silver chloride content are also disclosed. For example, U.S. Pat. Nos. 4,400,463, 4,713,323 and 5,217,858, and European Patent Nos. 0,423,840 and 0,647,877 disclose techniques concerning tabular grains having a high silver chloride content and a (111) plane as the major crystal face.

Further, U.S. Pat. Nos. 5,264,337, 5,292,632, 5,310,635 and 5,275,932, European Patent Nos. 0,534,395 and 0,617,320, and International Laid-Open Patent No. WO94/22,054 disclose techniques concerning tabular grains having a high silver chloride content and a (100) plane as the major crystal face. All of these techniques are useful for the preparation of a highly sensitive emulsion utilizing silver chloride excellent in developing rate and optical properties.

In addition to the shaping of the silver halide grains as described above, a variety of structures are created inside the grain when the grains are prepared. According to usual practice, a method is employed so that the grain is composed of a plurality of layers each having a different halogen composition. In the case of silver iodobromide grains for use as a photographing material, it is preferable to produce layers each having a different iodine content. For the purpose of controlling developability, known is a core/shell structure grain in which the core comprises a layer having a high iodine content. This core is covered with a shell having a low iodine content. Also known is a conversely structured grain in which the core comprises a layer having a high iodine content. This core is covered with a shell having a high iodine content. This type of grain is effective in enhancing the shape stability when the thickness of the tabular grain is reduced. Also known is a technique in which the core having a low iodine content is covered with a first shell having a high iodine content. Then a second shell having a low iodine content is precipitated on the first shell in order to impart a high sensitivity to the grain. In this type of silver halide grain, the high sensitivity level is obtained by a dislocation line formed by crystal asymmetry on the shell (corresponding to the fringe of grain periphery in the case of tabular grains) precipitated on the layer having a high iodine content.

A preferable technique for obtaining a high sensitivity comprises epitaxially growing a crystal having a different halogen composition on a localized site of a host grain. For example, it is known that a crystal having a high iodine content is epitaxially grown on the part (e.g., top, ridge or face of grain) of the surface of a host grain having a high silver bromide content. Conversely, it is also known that a crystal having a higher solubility (e.g., a crystal having a higher silver chloride content) is epitaxially grown on the surface of silver bromide or silver iodobromide grain serving as a host grain, and this technique is preferable for imparting a high sensitivity to tabular grains having a small grain thickness in particular.

Also in tabular grains having a high silver chloride content, it is preferable to form a localized phase having a high silver bromide or silver iodide content either inside or on the surface of the grain. Particularly, it is preferable to grow epitaxially such a localized phase on the top or ridge on the surface of the grain. These epitaxially grown crystal sites serve as effective sites for the formation of photosensitive nuclei and provide a high sensitivity.

It is a preferable practice to dope a salt or complex salt of a metal into the grain in order to improve the photographic properties of a photosensitive silver halide emulsion. These compounds serve as a temporary or permanent trap for an electron or hole in the silver halide crystal. In this way, these compounds are effective in providing a high sensitivity or a high contrast, improving dependence on illuminance or environment (e.g., temperature and humidity) at the time of exposure and inhibiting changes in performance when pressure is applied to the grain before or after exposure. For the purpose of incorporating these dopants, a variety of methods can be selected depending on the purpose, and examples of these methods are a method in which the dopant is uniformly incorporated into the silver halide grain, a method in which the dopant is localized in a specific portion inside the grain, a method in which the dopant is localized in a subsurface or surface area of the grain, and a method in which the dopant is localized in the above-mentioned epitaxial crystal portion.

Examples of the preferable metal include the first to third transition metals such as iron, ruthenium, rhodium, palladium, cadmium, rhenium, osmium, iridium and platinum as well as amphoteric metals such as thallium and lead. These metal ions in the form of an appropriate salt or complex salt are used as a dopant. Among these compounds, preferable compounds are 6-coordinate halogeno- or cyano-complexes having a halide ion or a cyano ion as a ligand. Complexes having an organic ligand are also used, and examples of the organic ligand include a nitrosyl ligand, a carbonyl ligand, a thiocarbonyl ligand, a dinitrogen ligand, a bipyridyl ligand, a cyclopentadienyl ligand and 1,2-dithiolenyl ligand. These techniques are described in, for example, JP-A Nos. 2,236,542 and 1,116,637, and Japanese patent Application No. 4-126,629.

Meanwhile, it is also a preferable practice to use as a dopant a divalent anion of a so-called chalcogen element such as sulfur, selenium or tellurium. These dopants are also effective in obtaining a high sensitivity of silver halides and improving their dependence on exposure conditions.

For other conditions for the preparation of silver halide grains, reference can be made, for example, to P. Glafkides, Chimie et Phisique Photographique, Paul Montel, 1967; G. F. Duffin, Photographic Emulsion Chemistry, Focal Press, 1966; and V. L. Zelikman et al., Making and Coating of Photographic Emulsion Focal Press, 1964. That is, the preparation can be performed in any pH region selected from an acidic method, a neutral method and an ammonia method. Further, any method selected from a single jet method, a double jet method and a combination thereof may be used as a method for supplying reaction solutions of a water-soluble silver salt and a water-soluble salt of halogen. It is also preferable to employ a controlled double jet method whereby the addition of reaction solutions is controlled in order that the pAg is maintained at a target value during the reaction. Further, a method whereby the pH during the reaction is maintained at a constant value is also employed. When the grains are formed, although the solubility of silver halide can be controlled by varying the temperature, pH or pAg of the system, a thioether, a thiourea or a rhodanate can be used as a solvent. These examples are described in, for example, JP-B No. 47-11,386 and JP-A No. 53-144,319.

In the present invention, silver halide grains are usually prepared by supplying a solution of a water-soluble silver salt such as silver nitrate and a solution of a water-soluble salt of halogen such as an alkali halide into a solution containing a water-soluble binder such as gelatin dissolved therein in a controlled condition. After the formation of the silver halide grains, excess of the water soluble salts is preferably removed. This operation is called a desalting or water-washing process, and a variety of means are employed for the process. One example is a noodle washing process comprising gelling a gelatin solution containing silver halide grains, cutting the gelled substance into the form of strings and then washing away the water-soluble salts from the strings with cold water. Another example is a flocculation process comprising flocculating the gelatin by adding to the solution a compound such as an inorganic salt comprising a polyvalent anion (e.g., sodium sulfate), an anionic surfactant, an anionic polymer (e.g., polystyrenesulfonic acid sodium salt) or a gelatin derivative (e.g., aliphatic-acylated gelatin, aromatic-acylated gelatin and aromatic-carbamoylated gelatin), and thereafter removing the excess salts. The flocculation process is preferable, because the excess salts are rapidly removed.

Normally, a chemically sensitized silver halide emulsion is preferably used in the present invention. The chemical sensitization imparts a high sensitivity to the silver halide grains prepared and contributes to the stability of the silver halide emulsion to exposure conditions and storage conditions. The chemical sensitization can be performed by any one of the generally known methods or by a combination of them.

As a chemical sensitization process, preferably employed is a method utilizing a chalcogen such as a sulfur compound, a selenium or a tellurium compound. When added to a silver halide emulsion, these sensitizers release the chalcogen element to form a silver chalcogenide with the silver halide. Use of a combination of these sensitizers is also preferable from the viewpoint of achieving a high sensitivity level and reducing fog.

Also preferable is a sensitization method by means of a noble metal, such as gold, platinum or palladium. In particular, a gold-sensitizing method, which uses chloroauric acid singly or in combination with a compound capable of becoming a ligand of gold, such as thiocyanate ion, brings about a high sensitivity level. A combination of the gold-sensitizing method and a chalcogen-sensitizing method brings about an even higher sensitivity level.

Another preferable method is a reduction sensitization method in which, in the grain forming stage, a compound having an appropriate reducing ability is used to introduce reductive nuclei into the grain so that a high sensitivity is obtained. Also preferable is a reduction sensitization in which an alkynylamine having an aromatic ring is added to a silver halide emulsion at the time of chemical sensitization thereof.

When a chemical sensitization process is carried out, it is also preferable to control the reactivity of silver halide grains by use of a compound capable of being adsorbed on the silver halide grain. It is particularly preferable to add a nitrogen-containing heterocyclic compound or a mercapto compound and a sensitizing dye such as a cyanine dye or a merocyanine dye prior to a chalcogen-sensitization or gold-sensitization process.

Although conditions for a chemical sensitization vary depending on the purpose, the temperature is in the range of 30 to 95° C. and preferably in the range of 40 to 75° C. The pH is in the range of 5.0 to 11.0 and preferably in the range of 5.5 to 8.5. The pAg is in the range of 6.0 to 10.5 and preferably in the range of 6.5 to 9.8.

The techniques concerning chemical sensitization are described in, for example, JP-A Nos. 3-110,555, 4-75,798, 62-253,159, 5-45,833 and 62-40,446.

In the present invention, a silver halide emulsion preferably undergoes a so-called spectral sensitization process which makes the silver halide emulsion sensitive to light in a desired region of wavelength. In particular, a color photosensitive material comprises photosensitive layers sensitive to blue, green and red, respectively, so the color reproduction is carried out well in conformity with an original. In order to impart the above-mentioned color-sensitivity to a silver halide silver halide emulsion, the silver halide emulsion is spectrally sensitized. For the purpose of the spectral sensitization, a so-called spectrally sensitizing dye is used so that this dye is adsorbed on the silver halide particle to make the silver halide grain sensitive to the region of wavelength corresponding to the region of absorption wavelength of the dye.

Examples of employable dyes include cyanine dyes, merocyanine dyes, complex cyanine dyes, complex merocyanine dyes, holopolar cyanine dyes, hemicyanine dyes, styryl dyes and hemioxonol dyes. Examples of these sensitizing dyes are disclosed in, for example, U.S. Pat. No. 4,617,257 and JP-A Nos. 59-180,550, 64-13,546, 5-45,828 and 5-45,834.

Although these sensitizing dyes may be used alone, they may also be used in a combination thereof. A combination of these sensitizing dyes is used for the adjustment of distribution in wavelength of spectral sensitization or for supersensitization. By the use of a combination of dyes exhibiting a supersensitization effect, it is possible to obtain sensitivity far greater than the sum of sensitivity obtainable by the use of a single dye.

The photosensitive silver halide emulsion in the present invention preferably contains a compound which is a dye having no spectral sensitization effect itself or a compound substantially incapable of absorbing visible light but which exhibits a supersensitizing effect. Examples of the compound which exhibits the supersensitizing effect include diaminostilbene compounds. Examples of these compounds are described in U.S. Pat. No. 3,615,641 and JP-A No. 63-23,145.

These spectrally sensitizing dyes or supersensitizing dyes can be added to the silver halide emulsion at any stage of the preparation of the emulsion. There are a variety of methods. For example, a method in which the addition is performed when a coating solution is prepared from an emulsion after the chemical sensitization thereof, a method in which the addition is performed upon the completion of the chemical sensitization of the emulsion, a method in which the addition is performed during the chemical sensitization of the emulsion, a method in which the addition is performed before the chemical sensitization of the emulsion, a method in which the addition is performed after the grain formation but before desalting, a method in which the addition is performed during the process for grain formation, and a method in which the addition is performed before grain formation. These methods may be employed alone, or a combination of these methods may be employed. In order to obtain high sensitivity, it is preferable that the addition be performed before the chemical sensitization of the emulsion.

The amount of the spectral sensitizing dyes or supersensitizing dyes to be added varies depending on the shape of the grain, the size of the grain or the photographic property to be imparted, but it is generally in the range of $10^{-8}$ to $10^{-1}$ mol and preferably in the range of $10^{-5}$ to $10^{-2}$ mol per mol of silver halide. These spectral sensitizing dyes or supersensitizers may be added to the emulsion as a solution in an organic solvent, such as methanol or fluorine-containing alcohol, or as an aqueous dispersion made by dispersing the dye together with a surfactant or gelatin in water.

In order to prevent the fogging or to improve the storage stability, a variety of stabilizers is preferably added to the silver halide emulsion. Preferable examples of these stabilizers include nitrogen-containing heterocyclic compounds, such as azaindene, triazole, tetrazole and purine, and mercapto compounds such as mercaptotetrazole, mercaptotriazole, mercaptoimidazole and mercaptothiadiazole. Details of these compounds are described in T. H. James, The Theory of the Photographic Process, Macmillan, 1977, pp. 396–399, and references cited therein.

These anti-fogging agents or stabilizers can be added to the silver halide emulsion at any stage of the preparation of the emulsion. There are a variety of methods, for examples, a method in which the addition is performed when a coating solution is prepared from an emulsion after the chemical sensitization thereof, a method in which the addition is performed upon the completion of the chemical sensitization of the emulsion, a method in which the addition is performed during the chemical sensitization of the emulsion, a method in which the addition is performed before the chemical sensitization of the emulsion, a method in which the addition is performed after the grain formation but before desalting, a method in which the addition is performed during the process for grain formation, and a method in which the addition is performed before grain formation. These methods may be employed alone, or a combination of these methods may be employed.

The amount of the anti-fogging agents or stabilizers to be added varies depending on the halide composition of the silver halide emulsion and purpose but it is generally in the range of $10^{-6}$ to $10^{-1}$ mol and preferably in the range of $10^{-5}$ to $10^{-2}$ mol per mol of silver halide.

The photographic additives described above which are used in the photosensitive material of the present invention are described in the Journal of Research Disclosure (hereinafter abbreviated as RD) Nos. 17,643 (December, 1978), 18,716 (November, 1979) and 307,105 (November, 1989). The following table shows the additives together with relevant references.

| | Additives | RD17,643 | RD18,716 | RD307,105 |
|---|---|---|---|---|
| 1. | Chemical sensitizers | page 23 | page 648, right column | page 866 |
| 2. | Sensitivity increasing agents | | page 648, right column | |
| 3. | Spectral sensitizers, Super sensitizers | pages 23–24 | page 648, right column to page 649, right column | pages 866–868 |
| 4. | Brighteners | page 24 | page 648, right column | page 868 |
| 5. | Anti-fogging agents, Stabilizers | pages 24–26 | page 649, right column | pages 868–870 |
| 6. | Light absorbents, Filter dyes, Ultraviolet absorbents | pages 25–26 | page 649, right column to page 650, left column | page 873 |
| 7. | Dye image stabilizers | page 25 | page 650, left column | page 872 |
| 8. | Gelatin hardeners | page 26 | page 651, left column | pages 874–875 |
| 9. | Binders | page 26 | page 651, left column | pages 873–874 |
| 10. | Plasticizers, lubricants | page 27 | page 650, right column | page 876 |
| 11. | Coating aids, Surfactants | pages 26–27 | page 650, right column | pages 875–876 |
| 12. | Antistatic agents | page 27 | page 650, right column | pages 876–877 |
| 13. | Matting agents | | | pages 878–879 |

The coated weight of the photosensitive silver halide to be used in the photosensitive material of the present invention is in the range of 0.05 to 20 g/m$^2$, and preferably 0.1 to 10 g/m$^2$, based on the weight of silver.

An organic metal salt may be used as an oxidant together with a photosensitive silver halide in the present invention. Among these organic metal salts, an organic silver salt is particularly preferable.

Examples of the organic compounds which can be used for the preparation of the above-mentioned organic silver salts serving as an oxidant include benzotriazoles, fatty acids and other compounds in U.S. Pat. No. 4,500,626, columns 52–53. The silver acetylide, which is described in U.S. Pat. No. 4,775,613, is also useful. These organic silver salts may be used alone or in a combination of two or more of them.

The above-mentioned organic silver salt can be used in an amount in the range of 0.01 to 10 mol, and preferably in the range of 0.01 to 1 mol, per mol of the photosensitive silver halide.

The binder for a constituent layer of the photosensitive material is preferably a hydrophilic material, examples of which include those described in the aforesaid RD and in JP-A No. 64-13,546, pp. 71–75. More specifically, the binder is preferably a transparent or translucent hydrophilic material, exemplified by a naturally occurring compound, such as a protein including gelatin and a gelatin derivative, and a polysaccharide including a cellulose derivative, starch, gum arabic, dextran and pullulan, and by a synthetic polymer such as polyvinyl alcohol, modified polyvinyl alcohol (e.g., Poval MP 103, MP 203 having alkyl-modified terminals and manufactured by Kuraray Co., Ltd.), polyvinyl pyrrolidone and acryl amide polymer. It goes without saying that in the present invention, at least one photosensitive layer containing "the gelatin which is modified so that the interaction thereof with silver is reduced" uses the gelatin as a binder. Also usable as the binder is a highly water-absorbent polymer described in U.S. Pat. No. 4,960,681 and JP-A No. 62-245,260. For example, a homopolymer composed of a vinyl monomer having —COOM or —$SO_3M$ (M stands for a hydrogen atom or an alkali metal), or a copolymer obtained by a combination of these monomers or by a combination of at least one of these monomers and another monomer(s) such as sodium methacrylate and ammonium methacrylate (e.g., SUMIKAGEL L-5H manufactured by Sumitomo Chemical Co., Ltd.). These binders may be used alone or in a combination of two or more of them. Particularly, a combination of gelatin and any of the above-mentioned non-gelatin binders is preferable. Depending on the purposes, a lime-processed gelatin, acid-processed gelatin and delimed gelatin which has undergone a deliming treatment to decrease the content of calcium, and the like can be used. Alternatively, a combination of these processed gelatin substances may be employed.

In the present invention, the coated weight of the binder is preferably 1 to 20 g/m$^2$, preferably 2 to 15 g/m$^2$, and more preferably 3 to 12 g/m$^2$. In the binder, the percentage of gelatin is 50 to 100% and preferably 70 to 100%.

The developing agent may be a p-phenylenediamine or a p-aminophenol. However, from the viewpoint of reduction of fog and increase of image density, the developing agent is preferably any one of the compounds represented by the aforementioned general formulas (1) to (5).

The compounds, which are represented by the general formula (1), are generally called sulfonamide phenols.

In the formula, $R_1$ to $R_4$ are each a group selected from the group consisting of a hydrogen atom, a halogen atom (e.g., chlorine atom and bromine atom), a substituted or unsubstituted alkyl group (e.g., methyl group, ethyl group, isopropyl group, n-butyl group and t-butyl group), a substituted or unsubstituted aryl group (e.g., phenyl group, tolyl group and xylyl group), a substituted or unsubstituted alkylcarbonamide group (e.g., acetylamino group, propionylamino group and butyloylamino group), a substituted or unsubstituted arylcarbonamide group (e.g., benzoylamino group), a substituted or unsubstituted alkylsulfonamide group (e.g., methanesulfonylamino group and ethanesulfonylamino group), a substituted or unsubstituted arylsulfonamide group (e.g., benzenesulphonylamino group and toluenesulfonylamino group), a substituted or unsubstituted alkoxy group (e.g., methoxy group, ethoxy group and butoxy group), a substituted or unsubstituted aryloxy group (e.g., phenoxy group), a substituted or unsubstituted alkylthio group (e.g., methylthio group, ethylthio group and butylthio group), a substituted or unsubstituted arylthio group (e.g., phenylthio group and tolylthio group), a substituted or unsubstituted alkylcarbamoly group (e.g., methylcarbamoyl group, dimethylcarbamoyl group, ethylcarbamoyl group, diethylcarbamoyl group, dibutylcarbamoyl group, piperidylcarbamoyl group and morpholylcarbamoyl group),a substituted or unsubstituted arylcarbamoly group (e.g., phenylcarbamoyl group, methylphenylcarbamoyl group, ethylphenylcarbamoyl group and benzylphenylcarbamoyl group), a carbamoyl group, a substituted or unsubstituted alkylsulfamoyl group (e.g., methylsulfamoyl group, dimethylsulfamoyl group, ethylsulfamoyl group, diethylsulfamoyl group, dibutylsulfamoyl group, piperidylsulfamoyl group and morpholylsulfamoyl group), a substituted or unsubstituted arylsulfamoyl group (e.g., phenylsulfamoyl group, methylphenylsulfamoyl group, ethyiphenylsulfamoyl group and benzylphenylsulfamoyl group), a sulfamoyl group, a cyano group, a substituted or unsubstituted alkylsulfonyl group (e.g., methanesulfonyl group and ethanesulfonyl group), a substituted or unsubstituted arylsulfonyl group (e.g., phenylsulfonyl group, 4-chlorophenylsulfonyl group and p-toluenesulfonyl group), a substituted or unsubstituted alkoxycarbonyl group (e.g., methoxycarbonyl group, ethoxycarbonyl group and butoxycarbonyl group), a substituted or unsubstituted aryloxycarbonyl group (e.g., phenoxycarbonyl group), a substituted or unsubstituted alkylcarbonyl group (e.g., acetyl group, propionyl group and butyloyl group), a substituted or unsubstituted arylcarbonyl group (e.g., benzoyl group and alkylbenzoyl group), and a substituted or unsubstituted acyloxy group (e.g., acetyloxy group, propionyloxy group and butyloyloxy group). Of the groups represented by $R_1$ to $R_4$, $R_2$ and $R_4$, are preferably a hydrogen atom. The total of Hammett's constants op of $R_1$ to $R_4$ is preferably 0 or greater.

$R_5$ is a group selected from the group consisting of a substituted or unsubstituted alkyl group (e.g., methyl group, ethyl group, butyl group, octyl group, lauryl group, cetyl group or stearyl group), a substituted or unsubstituted aryl group (e.g., phenyl group, tolyl group, xylyl group, 4-methoxyphenyl group, dodecylphenyl group, chlorophenyl group, trichlorophenyl group, nitrochlorophenyl group, triisopropylphenyl group, 4-dodecyloxyphenyl group or 3,5-di-(methoxy)carbonyl group), and a substituted or unsubstituted heterocyclic groups (e.g., pyridyl group).

The compounds represented by the general formula (2) are generally called sulfonylhydrazines. The compounds represented by the general formula (4) are generally called carbamoylhydrazines.

In the formulas, $R_5$ is a group selected from the group consisting of a substituted or unsubstituted alkyl group (e.g., methyl group, ethyl group, butyl group, octyl group, lauryl group, cetyl group and stearyl group), a substituted or unsubstituted aryl group (e.g., phenyl group, tolyl group, xylyl group, 4-methoxyphenyl group, dodecylphenyl group, chlorophenyl group, dichlorophenyl group, trichlorophenyl group, nitrochlorophenyl group, triisopropylphenyl group, 4-dodecyloxyphenyl group and 3,5-di(methoxy)carbonyl group), and a substituted or unsubstituted heterocyclic group (e.g., pyridyl group). Z stands for an atomic group forming an aromatic ring. The aromatic ring indicated by Z should be sufficiently electron-attractive to impart silver development activity to the compound. From this standpoint, preferably employed is a nitrogen-containing aromatic ring or an aromatic ring such as a benzene ring bearing an electron-attractive substituent. In this sense preferred examples of such aromatic rings include a pyridine ring, a pyrazine ring, a pyrimidine ring, a quinoline ring and a quinoxaline ring.

If the aromatic ring formed by Z is a benzene ring, examples of its substituents include an alkylsulfonyl group (e.g., methanesulfonyl group and ethanesulfonyl group), a halogen atom (e.g., chlorine atom and bromine atom), an alkylcarbamoly group (e.g., methylcarbamoyl group, dimethylcarbamoyl group, ethylcarbamoyl group, diethylcarbamoyl group, dibutylcarbamoyl group, piperidylcarbamoyl group and morpholylcarbamoyl group), an arylcarbamoly group (e.g., phenylcarbamoyl group, methylphenylcarbamoyl group, ethylphenylcarbamoyl group and benzylphenylcarbamoyl group), a carbamoyl group, an alkylsulfamoyl group (e.g., methylsulfamoyl group, dimethylsulfamoyl group, ethylsulfamoyl group, diethylsulfamoyl group, dibutylsulfamoyl group, piperidylsulfamoyl group and morpholylsulfamoyl group), an arylsulfamoyl group (e.g., phenylsulfamoyl group, methylphenylsulfamoyl group, ethylphenylsulfamoyl group and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group and p-toluenesulfonyl group), an alkoxycarbonyl group (e.g., methoxycarbonyl group, ethoxycarbonyl group and butoxycarbonyl group), an aryloxycarbonyl group (e.g., phenoxycarbonyl group), an alkylcarbonyl group (e.g., acetyl group, propionyl group and butyloyl group), and an arylcarbonyl group (e.g., benzoyl group and alkylbenzoyl group). The total of Hammett's constants $\sigma$ of the above-mentioned substituents is preferably 1 or greater.

The compounds represented by the general formula (3) are generally called sulfonylhydrazones. The compounds represented by the general formula (5) are generally called carbamoylhydrazones.

In the formulas, $R_5$ is a group selected from the group consisting of a substituted or unsubstituted alkyl group (e.g., methyl group, ethyl group, butyl group, octyl group, lauryl group, cetyl group and stearyl group), a substituted or unsubstituted aryl group (e.g., phenyl group, tolyl group, xylyl group, 4-methoxyphenyl group, dodecylphenyl group, chlorophenyl group, dichlorophenyl group, trichlorophenyl group, nitrochlorophenyl group, triisopropylphenyl group, 4-dodecyloxyphenyl group and 3,5-di(methoxy)carbonyl group), and a substituted or unsubstituted heterocyclic group (e.g., pyridyl group). $R_6$ is a substituted or unsubstituted alkyl group (e.g., methyl group and ethyl group). X is selected from the group consisting of an oxygen atom, a sulfur atom, a selenium atom and an alkyl- or aryl-substituted tertiary nitrogen atom. X is preferably an alkyl-substituted tertiary nitrogen atom. $R_7$ and $R_8$are selected from the group consisting of a hydrogen atom and a substituent, in which $R_7$ and $R_8$ may join with each other to form a double bond or a ring.

Concrete examples of the compounds represented by the general formulas (1) to (5) are given below, but the compounds in the present invention are not limited by these examples.

D-1

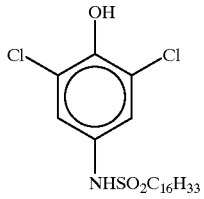

D-2

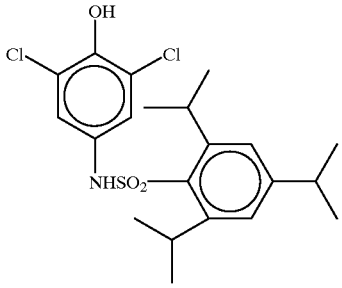

D-3

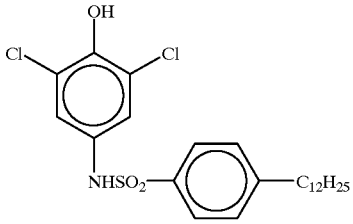

D-4

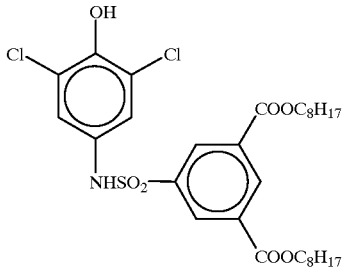

D-5

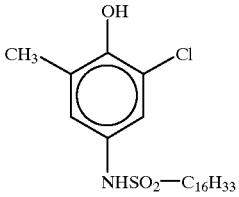

-continued

D-6

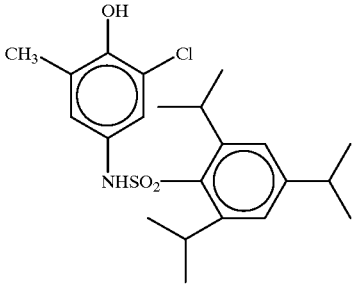

D-7

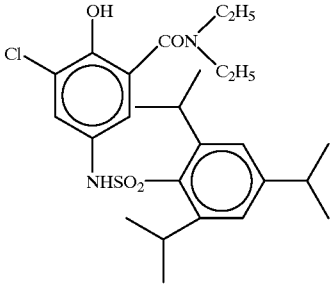

D-8

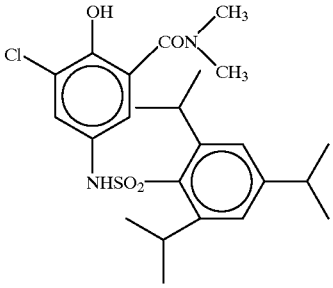

D-9

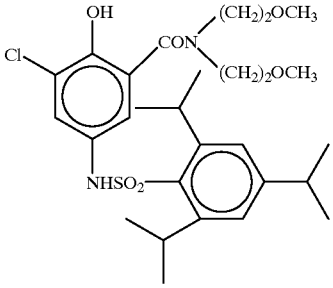

D-10

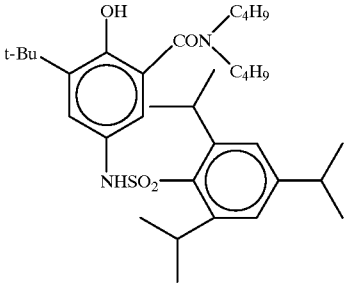

-continued
D-11
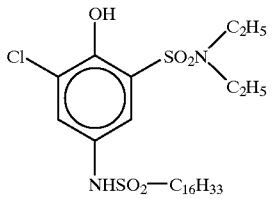
D-12
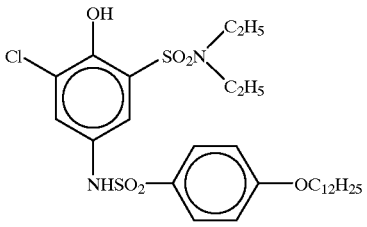
D-13
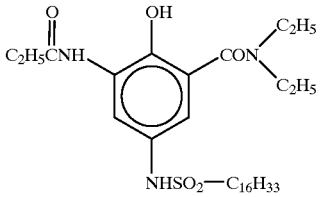
D-14
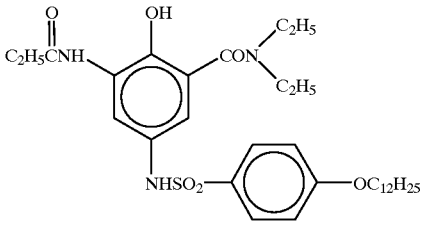
D-15
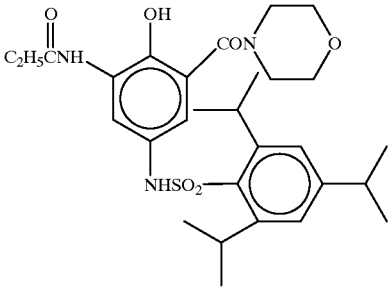
D-16
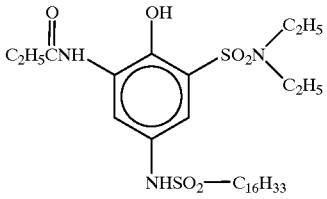
-continued
D-17
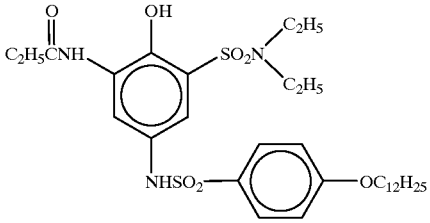
D-18
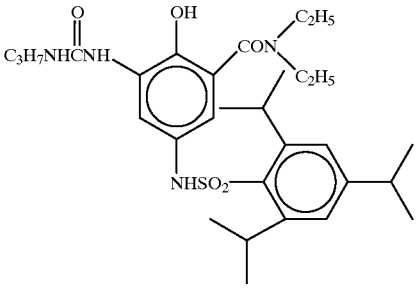
D-19
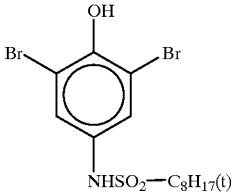
D-20
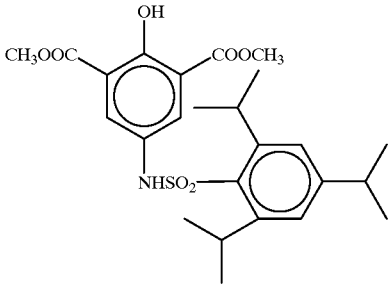
D-21
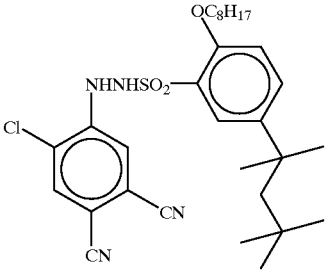
D-22
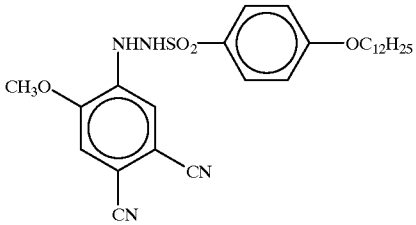

-continued
D-23
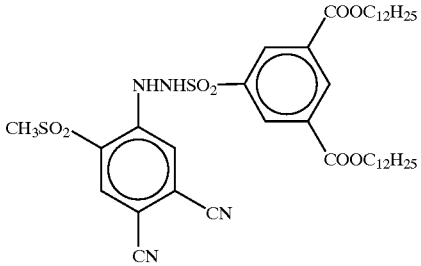
D-24
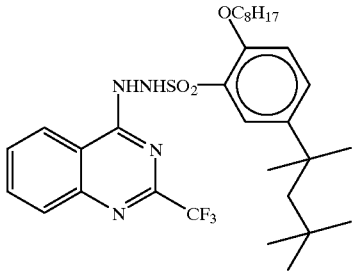
D-25
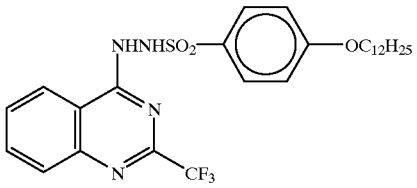
D-26
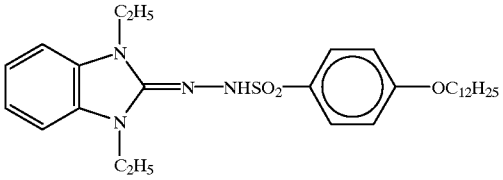
D-27
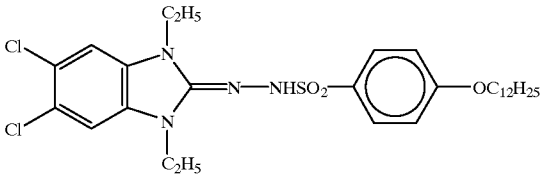
D-28
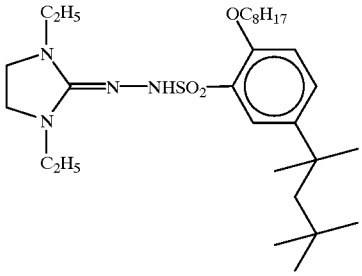
-continued
D-29
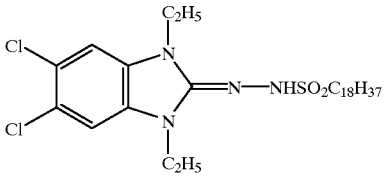
D-30
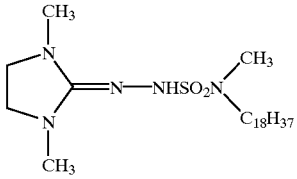
D-31
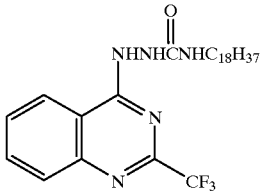
D-32
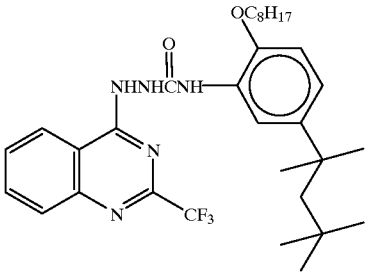
D-33
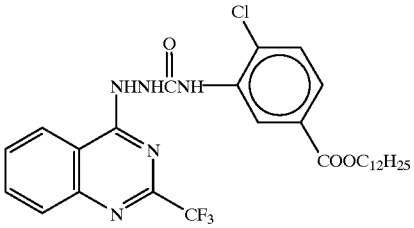
D-34
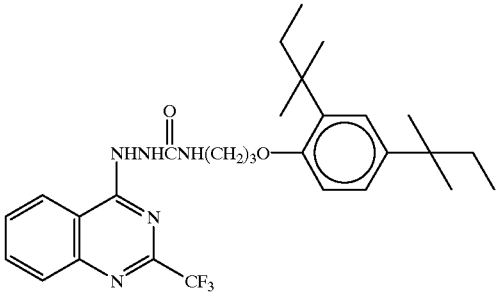

-continued
D-35
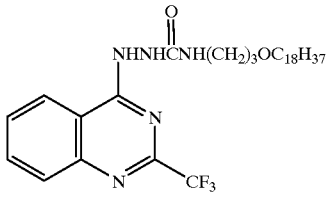
D-36
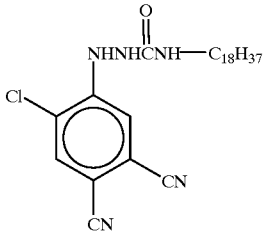
D-37
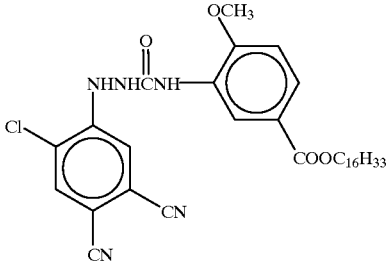
D-38
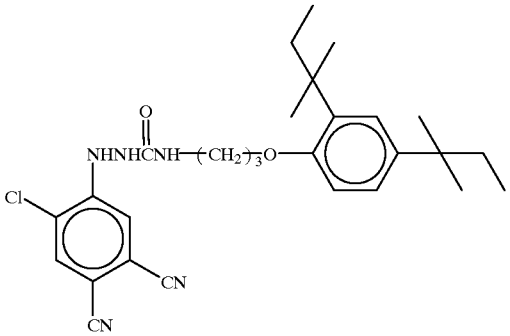
D-39
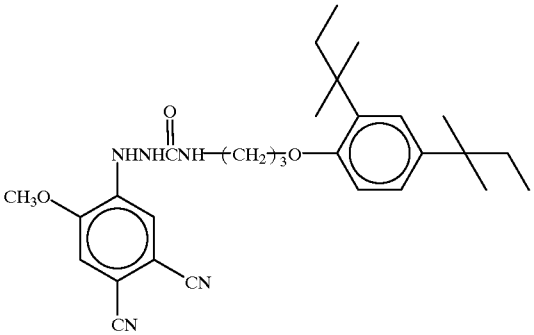
-continued
D-40
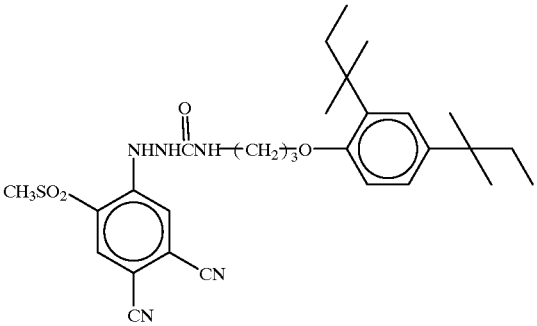
D-41
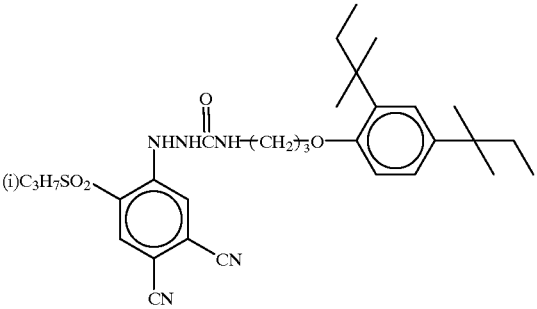
D-42
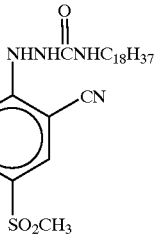
D-43
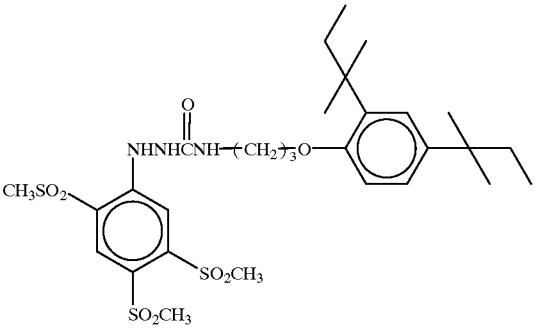
D-44
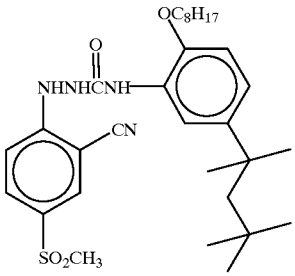

-continued
D-45
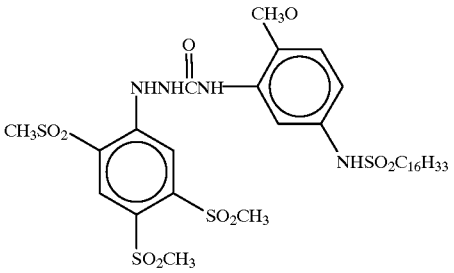
D-46
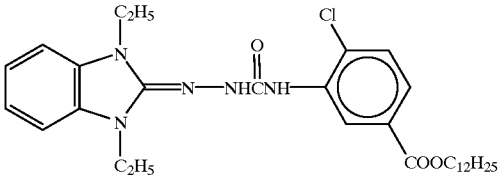
D-47
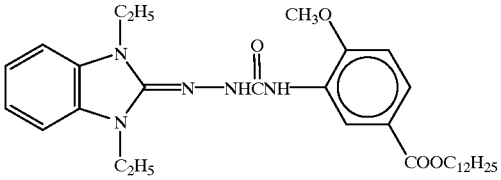
D-48
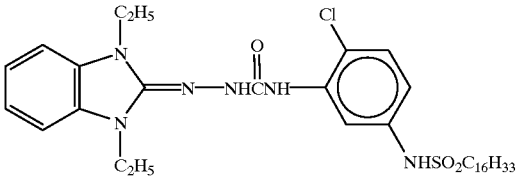
D-49
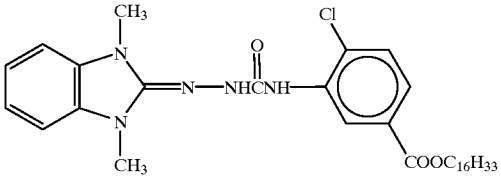
D-50
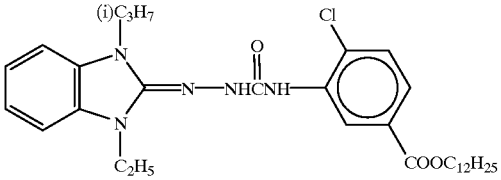
D-51
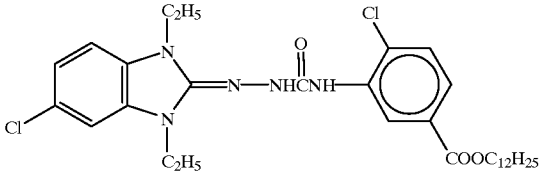
-continued
D-52
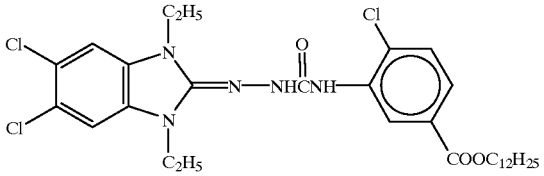
D-53
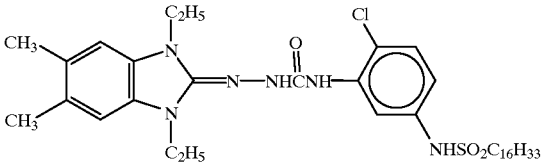
D-54
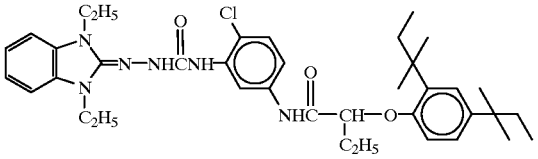
D-55
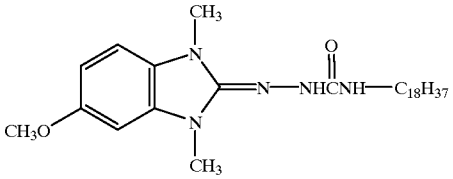
D-56
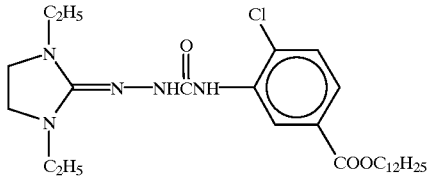
D-57
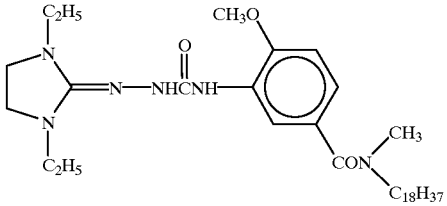
D-58
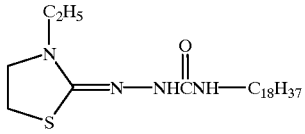
D-59
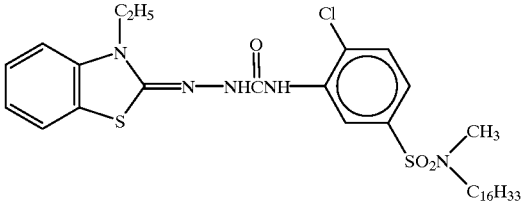

-continued

D-60

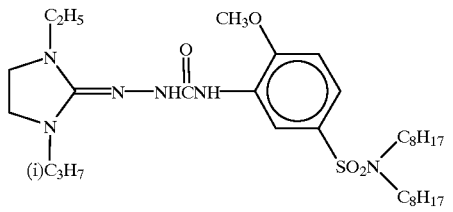

A developing agent in the present invention uses one or more of the above-mentioned compounds. Each of the layers of a photosensitive material may contain a different developing agent. The total amount of the developing agent to be used is in the range of 0.05 to 20 mmol/$m^2$, and preferably 0.1 to 10 mmol/$m^2$.

Couplers are described below. In the present invention, the term "coupler" refers to a compound which causes a coupling reaction with the oxidized product of the developing agent to form a dye.

The couplers which are suitable for use in the present invention are compounds generally called active methylenes, 5-pyrazolones, pyrazoloazoles, phenols, naphthols and pyrrolotriazoles. Preferable examples of these couplers are described in RD No. 38,957 (September, 1996), pp. 616–624, cited in "x. Dye image formers and modifiers".

These couplers can be classified into so-called 2-equivalent couplers and so-called 4-equivalent couplers. Examples of the groups serving as an anionic releasing group of a 2-equivalent coupler include a halogen atom (e.g., chlorine atom and bromine atom), an alkoxy group (e.g., methoxy group and ethoxy group), an aryloxy group (e.g., phenoxy group, 4-cyanophenoxy group and 4-alkoxycarbonylphenyl group), an alkylthio group (e.g., methylthio group, ethylthio group and butylthio group), an arylthio group (e.g., phenylthio group and tolylthio group), an alkylcarbamoly group (e.g., methylcarbamoyl group, dimethylcarbamoyl group, ethylcarbamoyl group, diethylcarbamoyl group, dibutylcarbamoyl group, piperidylcarbamoyl group and morpholylcarbamoyl group), an arylcarbamoly group (e.g., phenylcarbamoyl group, methylphenylcarbamoyl group, ethylphenylcarbamoyl group and benzylphenylcarbamoyl group), a carbamoyl group, an alkylsulfamoyl group (e.g., methylsulfamoyl group, dimethylsulfamoyl group, ethylsulfamoyl group, diethylsulfamoyl group, dibutylsulfamoyl group, piperidylsulfamoyl group and morpholylsulfamoyl group), an arylsulfamoyl group (e.g., phenylsulfamoyl group, methylphenylsulfamoyl group, ethylphenylsulfamoyl group and benzylphenylsulfamoyl group), a sulfamoyl group, a cyano group, an alkylsulfonyl group (e.g., methanesulfonyl group and ethanesulfonyl group), an arylsulfonyl group (e.g., phenylsulfonyl group, 4-chlorophenylsulfonyl group and p-toluenesulfonyl group), an alkylcarbonyloxy group (e.g., acetyloxy group, propionyloxy group and butyloyloxy group), an arylcarbonyloxy group (e.g., benzoyloxy group, tolyloxy group and anisyloxy group), and a nitrogen-containing heterocyclic group (e.g., imidazolyl group and benzotriazolyl group).

Examples of the group serving as a cationic releasing group of a 4-equivalent coupler include a hydrogen atom, a formyl group, a carbamoyl group, a methylene group bearing a substituent (such as an aryl group, sulfamoyl group, carbamoyl group, alkoxy group, amino group or hydroxyl group), an acyl group and a sulfonyl group.

Besides the compounds described in RD No. 38,957, preferable couplers are given below.

Active methylene-based couplers are: couplers represented by Formulas (I) and (II) in European Patent Application No.502,424A; couplers represented by Formulas (1) and (2) in European Patent Application No. 513,496A; couplers represented by Formula (I) in claim 1 of European Patent Application No. 568,037A; couplers represented by Formula (I) in column 1, lines 45 to 55, in U.S. patent application Ser. No. 5,066,576; couplers represented by Formula (I) in paragraph 00008 of JP-A No. 4-274,425; couplers described in claim 1 on page 40 in European Patent Application No. 498,381A1; couplers represented by Formula (Y) on page 4 in European Patent Application No. 447,969A1; and couplers represented by Formulas (II) to (IV) in column 7, lines 36–58, in U.S. patent application Ser. No. 4,476,219.

Preferable 5-pyrazolone-based magenta couplers are the compounds described in JP-A Nos. 57-35,858 and 51-20,826.

Preferable pyrazoloazole-based couplers are imidazo[1,2-b]pyrazoles described in U.S. Pat. No. 4,500,630, pyrazo[1,5-b][1,2,4]triazoles described in U.S. Pat. No. 4,540,654 and pyrazo[1,5-c][1,2,4]triazoles described in U.S. Pat. No. 3,725,067. Among these compounds, pyrazo[1,5-b][1,2,4]triazoles are more preferable from the viewpoint of light fastness.

Also preferable are a pyrazoloazole-based coupler having a branched alkyl group linked to the $2^{nd}$, $3^{rd}$ or $6^{th}$ position of the pyrazoloazole group as described in JP-A No. 61-65,245, a pyrazoloazole-based coupler having a sulfonamide group in the molecule thereof as described in JP-A No. 61-65,245, a pyrazoloazole-based coupler having an alkoxyphenylsulfonamide ballast group as described in JP-A No. 61-147,254, a pyrazolotriazole-based coupler having an alkoxy group or an aryloxy group linked to the $6^{th}$ position of the pyrazolotriazole group as described in JP-A Nos. 62-209,457 or 63-307,453 and a pyrazolotriazole-based coupler having a carbonamide group in the molecule thereof as described in JP-A No. 2-201,443.

Preferable examples of phenol-based couplers include 2-alkylamino-5-alkylphenols described in U.S. Pat. Nos. 2,369,929, 2,801,171, 2,772,162, 2,895,826 and 3,772,002, 2,5-diacylaminophenols described in U.S. Pat. Nos. 2,772,162, 3,758,308, 4,126,396, 4,334,011 and 4,327,173, German Patent Application Laid-Open No. 3,329,729, JP-A No. 59-166,956, and 2-phenylureido-5-acylaminophenols described in U.S. Pat. Nos. 3,446,622, 4,333,999, 4,451,559 and 4,427,767.

Preferable examples of naphthol-based couplers include 2-carbamoyl-1-naphthols described in U.S. Pat. Nos. 2,474,293, 4,052,212, 4,146,396, 4,228,233 and 4,296,200, and 2-carbamoyl-5-amido-1-naphthols described in U.S. Pat. No. 4,690,889.

Preferable examples of pyrrolotriazole-based couplers are the couplers described in European Patent Application Nos. 488,248A1, 491,197A1 and 545,300.

Other usable couplers are those each having a structure such as a fused-ring phenol, an imidazole, a pyrrole, 3-hydroxypyridine, an active methine, a 5,5-fused heterocyclic ring or a 5,6-fused heterocyclic ring.

A fused-ring phenol-based couplers usable in the present invention are those described in U.S. Pat. Nos. 4,327,173, 4,564,586 and 4,904,575.

An imidazole-based couplers usable in the present invention are those described in U.S. Pat. Nos. 4,818,672 and 5,051,347.

A pyrrole-based couplers usable in the present invention are those described in JP-A Nos. 4-188,137 and 4-190,347.

A 3-hydroxypyridine-based couplers usable in the present invention are those described in JP-A No. 1-315,736.

An active methine-based couplers usable in the present invention are those described in U.S. Pat. Nos. 5,104,783 and 5,162,196.

A 5,5-fused heterocyclic ring-based couplers usable in the present invention are the pyrrolopyrazoles described in U.S. Pat. No. 5,164,289, and pyrroloimidazoles described in JP-A Nos. 4-174,429.

A 5,6-fused heterocyclic ring-based couplers usable in the present invention are the pyrazolopyrimidines described in U.S. Pat. No. 4,950,585, pyrrolotriazines described in JP-A No. 4-204,730 and the couplers described in European Patent No. 556,700.

Besides these couplers, couplers which can be used in the present invention are those described in German Patent Nos. 3,819,051A and 3,823,049, U.S. Pat. Nos. 4,840,883, 5,024,930, 5,051,347 and 4,481,268, European Patent Nos. 304,856A2, 329,036, 354,549A2, 374,781A2, 379,110A2, 386,930A1, JP-A Nos. 63-141,055, 64-32,260, 64-32,261, 2-297,547, 2-44,340, 2-110,555, 3-7,938, 3-160,440, 3-172,839, 4-172,447, 4-179,949, 4-182,645, 4-184,437, 4-188,138, 4-188,139, 4-194,847, 4-204,532, 4-204,731 and 4-204,732.

These couplers are used in an amount of 0.05 to 10 mmol/$m^2$ and preferably 0.1 to 5 mmol/$m^2$ for each color.

In addition to the foregoing couplers, the following functional couplers can also be used.

Preferable examples of couplers which form dyes having a suitable level of diffusion are those described in U.S. Pat. No. 4,366,237, British Patent No. 2,125,570, European Patent No. 96,873B, and German Patent No. 3,234,533.

Couplers which are used for compensating unnecessary absorption of formed dyes are a yellow-colored cyan dye-forming coupler described in European Patent Application No.456,257A1, a yellow-colored magenta dye-forming coupler described in European Patent Application No. 456,257A1, a magenta-colored cyan dye-forming coupler described in U.S. Pat. No. 4, 833,069, and a colorless masking coupler represented by Formula (A) described in claim 1 in U.S. Pat. No. 4,837,136 (2) and WO92/11575 (particularly the compounds given on pages 36 to 45).

Examples of couplers which react with an oxidized form of a developing agent and release a residual group which is photographically useful are as follows:

Development inhibitor releasing compounds: compounds represented by Formulas (I) to (IV) described on page 11 in European Patent Application No. 378,236A1, compounds represented by Formula (I) described on page 7 in European Patent Application No. 436, 938A2, compounds represented by Formula (1) in European Patent Application No. 568,078A, and compounds represented by Formulas (I) to (III) described on pages 5 to 6 in European Patent Application No. 440,195A2.

Bleaching promoter releasing compounds: compounds represented by Formulas (I) and (I') described on page 5 in European Patent Application No. 310,125A2 and compounds represented by Formulas (I) in claim 1 of JP-A No. 6-59,411.

Ligand releasing compounds: compounds represented by LIG-X described in claim 1 of U.S. Pat. No. 4,555,478.

Leuco dye releasing compounds: compounds 1 to 6 in U.S. Pat. No. 4,749,641, columns 3 to 8.

Fluorescent dye releasing compounds: compounds represented by COUP-DYE described in claim 1 of U.S. Pat. No. 4,774,181.

Compounds which release a development promoter or a fogging agent: compounds represented by Formula (1), (2) or (3) in U.S. Pat. No. 4,656,123, column 3, and compounds represented by ExZK-2 described in lines 36 to 38 on page 75 in European Patent Application No. 450,637A2.

Compounds which release a group capable of becoming a dye only after being released: compounds represented by Formula (I) in claim 1 of U.S. Pat. No. 4,857,447, compounds represented by Formula (1) in Japanese Patent Application No. 4-134,523, compounds represented by Formula (I), (II) or (III) on pages 5 to 6 in European Patent No. 440,195A2, compound-ligand releasing compounds represented by Formula (I) described in claim 1 in JP-A No.4-325,564 and compounds represented by LIG-X in claim 1 of U.S. Pat. No. 4,555,478.

Any of these functional couplers are used preferably in an amount of 0.05 to 10 times and more preferably 0.1 to 5 times the molar amount of the above-described color forming coupler.

Hydrophobic additives, such as a coupler and a developing agent, can be introduced into a layer of a photosensitive material according to a known method such as the method described in, e.g., U.S. Pat. No. 2,322,027. In this case, an organic solvent having a high boiling point, which is described in U.S. Pat. Nos. 4,555,470, 4,536,466, 4,536,467, 4,587,206, 4,555,476 and 4,599,296 and in Japanese Patent Application Publication (JP-B) No. 3-62,256, can be used, if necessary, together with an organic solvent having a lower boiling point in the range of 50 to 160° C. These color forming compounds and organic solvents having a high boiling point and the like may be used in a combination of two or more of them, respectively.

The amount of the organic solvent having a high boiling point is 10 grams or less, preferably 5 grams or less, more preferably in the range of 0.1 to 1 grams, per gram of the hydrophobic additives to be used. The amount of the organic solvent having a high boiling point is 1 cc or less, preferably 0.5 cc or less, more preferably 0.3 cc or less, per gram of the binder.

Examples of useful methods for introducing a hydrophobic additive into the layer of a photosensitive material include a dispersion method utilizing a polymer as described in JP-B No.51-39,853 and JP-A No.51-59,943 and a method in which a hydrophobic additive, which has been dispersed into fine particles, is added to the layer as described in JP-A No.62-30,242.

In addition to the above methods, in the case where the hydrophobic additive is a compound substantially insoluble in water, the hydrophobic compound may be dispersed as fine particles in a binder.

When dispersing a hydrophobic compound in a hydrophilic colloid, a variety of surfactants can be used. For example, surfactants, which are described in JP-A No.59-157,636, pp. 37–38, and in RD mentioned above, can be used. In addition, a phosphate-type surfactant, which is described in JP-A Nos.5-204,325 and 6-19,247 and in German Patent Application Laid-Open No.1,932,299A, can also be used.

A colorant which releases or causes diffusion of a diffusive a dye in proportion or in reverse proportion to the development of silver can be used in the present invention. This compound can be represented by the general formula [L1] given below.

$$((\mathrm{Dye})_m\text{-}\mathrm{Y})_n\text{-}\mathrm{Z} \qquad [L1]$$

In the formula, Dye represents a dye group or a dye precursor group having the absorption wavelength region thereof temporarily shifted in a short wavelength region, Y represents merely a bond or linking group, Z represents a group which causes a difference in the diffusivity of the compound represented by the formula $((Dye)_m-Y)_n-Z$ conforming either regularly or reversely to the imagewise latent image of a photosensitive silver halide, or which releases $(Dye)_m-Y$ and causes a difference in the diffusivity of the released $(Dye)_m-Y$ from that of $((Dye)_m-Y)_n-Z$; m is an integer of 1 to 5, n is 1 or 2, and the plurality of Dyes may be the same or not if all of m and n are not 1.

Concrete examples of the dye forming compounds represented by the general formula [LI] include the following compounds (i) to (vi). Among these compounds, the compounds (i) to (iv) release or cause the diffusion of a diffusive dye in reverse proportion to the development of silver halide, while the compounds (v) and (vi) release or cause the diffusion of a diffusive dye in proportion to the development of silver halide.

(i) Color developers which comprise a hydroquinone-based developing agent and a dye component linked thereto and which are described in, e.g., U.S. Pat. Nos. 3,134,764, 3,362,819, 3,597,200, 3,544,545 and 3,482,972 and JP-B No. 3-68,387. These color developers are diffusive in an alkaline environment, but they become nondiffusive after their reaction with a silver halide.

(ii) As described in, e.g., U.S. Pat. No. 4,503,137, it is possible to use a nondiffusive compound which is capable of releasing a diffusive dye in an alkaline environment but loses this capability after the reaction with a silver halide. Examples of this compound are a compound which releases a diffusive dye as a result of an intramolecular nucleophilic substitution reaction as described in, e.g., U.S. Pat. No. 3,980,479, and a compound which releases a diffusive dye as a result of an intramolecular tautomerization of an isooxazolone ring as described in, e.g., U.S. Pat. No. 4,199,354.

(iii) Compounds which react with a silver ion or an organosilver complex ion to release a diffusive dye as described in U.S. Pat. Nos. 4,362,806, 3,719,489 and 4,375,507.

(iv) Nondiffusive compounds which react with a reducing agent remaining unoxidized after a developing process and release a diffusive dye as described in, e.g., U.S. Pat. No. 4,559,290, European Patent No. 220,746A2, U.S. Pat. No. 4,783,396, Journal of Technical Disclosure (Kokai-Giho) No.87-6,199, and JP-A No. 64-13,546.

Examples of these compounds include compounds which release, after reduction thereof, a diffusive dye as a result of the intramolecular nucleophilic substitution reaction as described in, e.g., U.S. Pat. Nos. 4,139,389 and 4,139,379, and JP-A Nos. 59-185,333 and 57-84,453; compounds which release, after reduction thereof, a diffusive dye as a result of the intramolecular transfer of electrons as described in, e.g., U.S. Pat. Nos. 4,232,107, JP-A Nos. 59-101,649 and 61-88,257, and RD No.24,025 (1984); compounds which release, after reduction thereof, a diffusive dye as a result of the severance of a single bond as described in, e.g., German Patent No. 3,008,588A, JP-A No. 56-142,530, U.S. Pat. Nos. 4,343,893 and 4,619,884; nitro compounds which release a diffusive dye after accepting electrons as described in, e.g., U.S. Pat. No. 4,450,223, and compounds which release a diffusive dye after accepting electrons as described in, e.g., U.S. Pat. No. 4,609,610.

More preferable examples include compounds which have in a single molecule thereof an N-X linkage (X stands for an oxygen atom and N stands for a sulfur atom or a nitrogen atom) and an electron-attractive group as described in, e.g., European Patent No. 220,746A2, Journal of Technical Disclosure No.87-6,199, U.S. Pat. No. 4,783,396, JP-A Nos. 63-201,653, 63-201,654 and 64-13,546; compounds which have in a single molecule thereof an $SO_2$—X linkage (X is as defined above) and an electron-attractive group as described in JP-A No. 1-26,842; compounds which have in a single molecule thereof a PO—X linkage (X is as defined above) and an electron-attractive group as described in JP-A No. 63-271,344; and compounds which have in a single molecule thereof a C—X' linkage (X' is the same as X or stands for —$SO_2$—) and an electron-attractive group as described in JP-A No. 63-271,341. Also usable are compounds which releases a diffusive dye as a result of severance of a single bond after reduction due to a π bond conjugated with an electron-accepting group as described in JP-A Nos. 1-161,237 and 1-161,342.

Among these compounds, a compound, which has in a single molecule thereof an N—X linkage and an electron-attractive group, is preferable. Concrete examples of the preferable compounds include the compounds (1)~( 3), (7)~(10), (12), (13), (15), (23)~(26), (31), (32), (35), (36), (40), (41), (44), (53)~(59), (64) and (70) described in European Patent Application No. 220,746A2 or U.S. patent application Ser. No. 4,783,396; the compounds (11)~(23) described in Journal of Technical Disclosure No.87-6,199; and the compounds (1)~(84) described in JP-A No. 64-13,546.

(v) Compounds (DRR couplers) which are couplers having a diffusive dye as a releasing group and release the diffusive dye by reacting with an oxidized form of a reducing agent. Concrete examples of these compounds include those described in, e.g., British Patent No. 1,330,524; JP-B No. 48-39,165; U.S. Pat. Nos. 3,443,940; 4,474,867 and 4,483,914.

(vi) Compounds (DRR compounds) which are capable of reducing a silver halide or an organic silver salt and release a diffusive dye after reducing the silver halide or the organic silver salt. These compounds do not need the use of an other reducing agent, and bring about the advantage that the resulting image is not contaminated with an oxidized decomposition product of the reducing agent. Typical examples of these compounds are described in, e.g., U.S. Pat. Nos. 3,928,312, 4,053,312, 4,055,428 and 4,336,322, JP-A Nos. 59-65,839, 59-69,839, 53-3,819 and 51-104,343, RD 17,465, U.S. Pat. Nos. 3,725,062, 3,728,113 and 3,443,939, JP-A Nos. 58-116,537 and 57-179,840, and U.S. Pat. Nos. 4,500,626. Concrete examples of the DRR compounds include those described in U.S. Pat. No. 4,500,626, columns 22–44. Among these compounds described in this patent, compounds (1)~(3), (10)~(13), (16)~(19), (28)~(30), (33)~(35), (38)~(40) and (42)~(64) are preferable. Also useful are the compounds described in U.S. Pat. No. 4,639,408, columns 37–39.

Although the present invention is applicable to the system utilizing the above-described dye-releasing compounds, the present invention is based on the finding that an image superior in terms of granularity and sharpness can be obtained by a step of carrying out a heat development by use of a photosensitive material comprising a developing agent and a coupler, which are very stable in the absence of a base, and a processing material comprising a base and/or a base precursor in the presence of a small amount of water so that an image of nondiffusive dyes is formed in the photosensitive material and that a very good color image can be obtained when the image information of the preceding step is provided to an other recording material such as color paper or a color printing material for heat development. In this case, since the photosensitive material is separated from the base until the developing process begins, a high level of storability required for a photographing material can be fulfilled and yet a rapid developing process is possible.

Further, in comparison with the system utilizing the dye-releasing compounds, the use of a colorless developing agent and coupler provides better sensitivity which is very important in photographing materials.

In the photosensitive material of the present invention, at least one photosensitive layer is formed on a support. A typical example of the photosensitive materials of the present invention is a silver halide color photosensitive material having on the support at least one photosensitive layer made up of a plurality of silver halide emulsion layers which are sensitive to the same color but which have different levels of sensitivity. The photosensitive layer is a unit photosensitive layer having sensitivity to any of blue light, green light and red light. In the case of a multilayered silver halide color photosensitive material, a generally adopted order of the unit photosensitive layers from the support is a red-sensitive layer, a green-sensitive layer and a blue-sensitive layer. However, depending on the purpose, this order of layers may be reversed, or photosensitive layers sensitive to the same color may sandwich a photosensitive layer sensitive to a different color. Non-photosensitive layers can be formed between the silver halide photosensitive layers or as the uppermost layer or as the lowermost layer. These layers may contain the couplers, developing agents, DIR compounds, color mixing prevention agent, dyes and the like. As for a plurality of silver halide emulsion layers constituting a unit photosensitive layer, preferably a high-speed emulsion layer and a low-speed emulsion layer are arranged in a descending order of sensitivity toward a support as described in German Patent No. 1,121,470 or British Patent No. 923,045. Alternatively, as described in JP-A Nos. 57-112,751, 62-200,350, 62-206,541 and 62-206,543, layers may be arranged such that a low-speed emulsion layer is formed remotely from a support and a high-speed layer is formed close to the support.

For example, the layers may be arranged from far to near the support in the order of a low-speed blue-sensitive layer (BL)/a high-speed blue-sensitive layer (BH)/a high-speed green-sensitive layer (GH)/a low-speed green-sensitive layer (GL)/a high-speed red-sensitive layer (RH)/a low-speed red-sensitive layer (RL), or in the order of BH/BL/GL/GH/RH/RL or in the order of BH/BL/GH/GL/RL/RH.

Alternatively, as described in JP-B No. 55-34,932, the layers may be arranged from far to near the support in the order of a blue-sensitive layer /GH/RH/GL/RL. Further, as described in JP-A Nos. 56-25,738 and 62-63,936, the layers may be arranged from far to near the support in the order of a blue-sensitive layer /GL/RL/GH/RH.

Further, as described in JP-B No.49-15,495, three layers may be arranged such that a silver halide emulsion layer having the highest sensitivity is placed as an upper layer, a silver halide emulsion layer having sensitivity lower than that of the upper layer is placed as an intermediate layer, and a silver halide emulsion layer having sensitivity lower than that of the intermediate layer is place as a lower layer, i.e., the three layers having different sensitivities may be arranged in a descending order of sensitivity toward the support. Also, when the photosensitive material comprises the three layers having different sensitivities, these layers may be arranged from far to near the support in the order of medium-speed emulsion different sensitivities, these layers may be arranged from far to near the support in the order of medium-speed emulsion layer/high-speed emulsion layer/low-speed emulsion layer within a layer sensitive to the same color as described in JP-A No. 59-202,464.

In addition, an order of high-speed emulsion layer/low-speed emulsion layer/medium-speed emulsion layer or an order of low-speed emulsion layer/medium-speed emulsion layer/high-speed emulsion layer may be adopted. Furthermore, the arrangement can be changed as described above, even when four or more layers are formed.

In order to improve color reproduction, it is preferable to arrange a donor layer (CL), which provides an interimage effect and has a distribution of spectral sensitivity different from that of main photosensitive layers such as BL, GL and RL, in a position adjacent or close to the main photosensitive layer, as described in U.S. Pat. Nos. 4,663,271, 4,705,744 and 4,707,436, and JP-A Nos. 62-160,448 and 63-89,850.

In the present invention, a silver halide, a color forming coupler and a developing agent maybe contained in the same layer. However, if these substances are likely to react with each other, they may be incorporated in separate layers. For example, if the developing agent is contained in one layer and the silver halide is contained in another layer, the storability of the unexposed photosensitive material can be improved.

Although the relationship between the spectral sensitivity and hue of a dye formed by a coupler may be selected green-sensitive layer contains a magenta dye-forming coupler and a blue-sensitive layer contains a yellow dye-forming coupler, enables the photosensitive material to be directly projected for exposure of conventional color paper and the like.

A non-photosensitive layer, such as a protective layer, a subbing layer, an intermediate layer, a yellow filter layer or an antihalation layer, may be formed between the silver halide emulsion layers, or as a top layer or a bottom layer. Further, an auxiliary layer, such as a back layer, may be formed on the reverse side of the support. More specifically, it is possible to form various layers including the above-mentioned construction, a subbing layer described in U.S. Pat. No. 5,051,335, an intermediate layer containing a solid pigment described in JP-A Nos.1-167,838 and 61-20,943, an intermediate layer containing a reducing agent or a DIR compound described in JP-A Nos.1-120,553, 5-34,884 and 2-64,634, an intermediate layer containing an electron transferring agent described in U.S. Pat. No. 5,017,454 and 5,139,919 and in JP-A No.2-235,044 and a protective layer containing a reducing agent described in JP-A No.4-249,245 as well as a combination of two or more of these layers.

A dye, which can be used in a yellow filter layer or in an antihalation layer, is preferably a dye which loses its color or is decolorized or removed out of these layers at the time of development so that it exerts no influence on the density of image after the developing process of the photosensitive material.

That the dye which is present in a yellow filter layer or in the antihalation layer is decolorized or is removed at the time of development means that the amount of the dye remaining after the developing process is less than one third, preferably less than one tenth, of the amount of the dye present immediately before the process. This may be attained by a phenomenon in which the component of the dye is transferred into the processing material at the time of development, or by a phenomenon in which the component of the dye undergoes a reaction and becomes a colorless compound at the time of development.

Concrete examples of the dyes include the dye described in European Patent Application No. 549,489A and the dye described in JP-A No.7-152,129, ExF 2-6. A dye which is solid-dispersed and is described in Japanese Patent Application No.6-259,805 can also be used.

Further, it is also possible to mordant a dye to a binder with a mordant. In this case, the mordant and the dye may be those well known in the field of photography. Examples of the mordants include those described in U.S. Pat. No. 4,500,626, columns 58–59 and in JP-A Nos.61-88,256, pp. 32–41, 62-244,043 and 62-244,036.

Furthermore, it is also possible to use a reducing agent and a compound which reacts with the reducing agent to release a diffusive dye so that the alkali at the time of development causes the reaction to release a mobile dye, which will be eliminated by being transferred to the processing material. Examples of these compounds and reducing agents are described in U.S. Pat. Nos. 4,559,290 and 4,783,396, European Patent Application No. 220,746A2, Journal of Technical Disclosure No.87-6,119 and Japanese Patent Application No.6-259,805, paragraph 0080–0081.

A leuco dye, which is decolorized, can also be used. For example, JP-A No.1-150,132 discloses a silver halide photosensitive material containing a leuco dye which is given a color in advance by means of a metal salt of an organic acid as a color developer. A complex of a leuco dye and a color developer undergoes a reaction by heat or reacts with an alkali to be decolorized.

In the present invention, a known leuco dye can be used, examples of which are described in Moriga and Yoshida, "Dyes and Chemicals", Vol. 9, pp. 84, Association of Chemical Products, "New Handbook of Dyes", pp. 242, Maruzen Co., Ltd. (1970), R. Garner, "Reports on the progress of Appl. Chem", Vol. 56, pp. 199 (1971), "Dyes and Chemicals", Vol. 19, pp. 230, Association of Chemical Products (1974), "Color Materials", Vol. 62, pp. 288 (1989) and "Dying Industry", Vol. 32, pp. 208.

Preferred color developers are a metal salt of an organic acid in addition to acid clay and a phenol/formaldehyde resin. Among metal salts of organic acids, metal salts of salicylic acid, metal salts of a phenol/salicylic acid/formaldehyde resin, rhodanates and metal salts of xanthogenic acid are preferable. Zinc is particularly preferable among the metals. An oil-soluble zinc salicylate described in U.S. Pat. Nos. 3,864,146 and 4,046,941 and in JP-B No.52-1,327 can also be used as the color developer.

In the present invention, a colored layer containing an oil-soluble dye which can be decolorized by the processing can be a yellow filter layer, magenta filter layer and an antihalation layer. Accordingly, if the order of photosensitive layers from the near side of the support is a red-sensitive layer, a green sensitive layer and a blue-sensitive layer, it is possible to form a yellow-colored filter layer between the blue-sensitive layer and the green-sensitive layer, to form a magenta-colored filter layer between the green-sensitive layer and the red-sensitive layer, and to form a cyan-colored filter layer (antihalation layer) between the red-sensitive layer and the support. These colored layers may contact a photosensitive layer and an emulsion layer either directly or via an intermediate layer such as gelatin. The amount of the dyes to be used are such that the transmission densities of the layers are 0.03 to 3.0, preferably 0.1 to 1.0, to blue light, green light and red light, respectively. More specifically, the amounts are 0.005 to 2.0 mmol/$m^2$ and preferably 0.05 to 1.0 mmol/$m^2$, although the amounts depend on $\epsilon$ and molecular weights of the dyes.

Preferable examples of employable dyes are compounds having a structure comprising two members selected from the group consisting of an acidic nucleus composed either of a cyclic ketomethylene compound (e.g., 2-pyrazoline-5-one, 1,2,3,6-tetrahydropyridine-2,6-dione, rhodanine, hydantoin, thiohydantoin, 2,4-oxazolidine-dione, isooxazolone, barbituric acid, thiobarbituric acid, indandione, dioxopyrazolopyridine, hydroxypyridine, pyrazolidinedione, 2,5-hydrafuran-2-one and pyrroline-2-one) or a compound having a methylene group sandwiched between electron-attractive groups (e.g., —CN, —$SO_2R_1$, —$COR_1$, —$COOR_1$, —$CON(R_2)_2$, —$SON(R_2)_2$, —[=C$(CN)_2$]$R_1$ and —[=C$(CN)_2$]$N(R_1)_2$, where $R_1$ represents an alkyl, alkenyl, aryl, cycloalkyl or heterocyclic group while $R_2$ represents a hydrogen atom or the same group as $R_1$), a basic nucleus (e.g., pyridine, quinoline, indolenine, oxazole, imidazole, thiazole, benzooxazole, benzoimidazole, benzothiazole, oxazoline, naphthooxazole and pyrrole), an aryl group (e.g., a phenyl group and a naphthyl group) and a heterocyclic group (e.g., pyrrole, indole, furan, thiophene, imidazole, pyrazole, indolysine, quinoline, carbazole, phenothiazine, phenoxazine, indoline, thiazole, pyridine, pyridazine, thiadiazine, phenoxazine, pyran, thiopyran, oxadiazole, benzoquinone, thiadiazole, pyrrolothiazole, pyrrolopyridazine, tetrazole, oxazole, coumarin and chroman) together with a methine group, or a compound having the structure represented by $(NC)_2C$=(CN)—$R_3$ ($R_3$ represents an aryl group or a heterocyclic group), as described in Japanese Patent Application No. 8-329,124.

In the present invention, a colored layer of the photosensitive material may contain a mixture of two or more dyes. For example, the antihalation layer described above may contain a mixture of a yellow dye, a magenta dye and a cyan dye.

In the present invention, the photosensitive material preferably uses a dye, which can be decolorized, as a dispersion thereof prepared by dispersing in a hydrophilic binder the oil droplets which are prepared by dissolving the dye in an oil and/or an oil-soluble polymer. As a method for preparing the dispersion, preferable is an emulsifying method which is described in, for example, U.S. Pat. No. 2,322,027. In this case, an oil having a high boiling point, which is described in U.S. Pat. Nos. 4,555,470, 4,536,466, 4,587,206, 4,555,476 and 4,599,296 and in JP-B No.3-62,256, can be used, if necessary, together with an organic solvent having a lower boiling point in the range of 50 to 160° C. Two or more of the oils having a high boiling point can be used together. The oil-soluble polymer may be used in place of or together with the oil, as described in the specification of PCT International Laid-Open No. WO88/00723. The amount of the oil having a high boiling point and/or the polymer is 0.01 to 10 grams and 0.1 to 5 grams per gram of the dye to be used.

The process for dissolving the dye in the polymer may be carried out by a latex-dispersing method, and examples of the step as well as of the latex for impregnation are described in, for example, U.S. Pat. No. 4,199,363, German Patent Application Laid-Open (OLS) Nos. 2,541,274 and 2,541,230, JP-B No. 53-41,091 and European Patent Application Laid-Open No. 029,104.

When the oil droplets are dispersed in a hydrophilic binder, a variety of surfactants may be used. The surfactants which can be used are described in JP-A No. 59-157,636, pp.-37–38, and "Known Technologies (Kochi-Gijutsu)" No.5 (issued on Mar. 22, 1991, ASTECH Inc.), pp. 136–138. Phosphate-based surfactants described in Japanese Patent Application Nos. 5-204,325 and6-19,247 and German Patent Laid-Open No. 932,299A can also be used.

Preferable hydrophilic binders are water-soluble polymers, examples of which include naturally occurring compounds, such as a protein including gelatin and a gelatin derivative, and a polysaccharide including a cellulose derivative, starch, gum arabic, dextrin and pullulan, and synthetic polymers such as polyvinyl alcohol, polyvinyl pyrrolidone and acrylamide polymers. These water-soluble polymers may be used in a combination of two or more of them. A combination of gelatin and one or more of other water-soluble polymers is particularly preferable. Depending on purposes, the gelatin is selected from the group consisting of lime-processed gelatin, acid-processed gelatin and so-called delimed gelatin containing a reduced amount of calcium or the like. A combination of two or more of these kinds of gelatin can also be used.

In the present invention, a dye is achromatized when processed in the presence of an achromatizing agent.

Examples of the descolorizing agent include alcohol or phenols (R51OH), amines or anilines ($(R52)_3N$), hydroxylamines ($(R52)_2NOR52$), sulfinic acid ($R51SO_2H$) or salts thereof, sulfurous acid or salts thereof, thiosulfuric acid or salts thereof, carboxylic acid ($R51CO_2H$) or salts thereof, hydrazines ($(R52)_2NN(R52)_2$), guanidines ($[(R52)_2N]_2C{=}NH$), aminoguanidines ($(R52)_2NR52N(R52N)C{=}NH$), amidines, thiols (R51SH), cyclic or chain-like active methylene compounds ($Z53\text{-}CH_2\text{-}Z54$, where Z53 and Z54 are each selected from the group consisting of —CN, $—SO_2R51$, —COR51, —COOR51, $—CON(R52)_2$, $—SO_2N(R52)_2$, $—C[{=}C(CN)_2]R51$ and $—C[{=}C(CN)_2]N(R51)_2$ in which Z53 and Z54 may join each other to form a ring), cyclic or chain-like active methine compounds (Z53-CH(R51)-Z54 or Z53-CH(Z54)-Z55, where Z55 may be the same as Z53, and Z53, Z54 and Z55(or Z51) may join each other to form a ring), and anions derived from these compounds. In the compounds described above, R51 represents an alkyl group, an aryl group or a heterocyclic group, while R52 represents a hydrogen atom or the same group as R51. Each of R51 and R52 may have a substituent. If a plurality of R51 or R52 are present in the molecule, they may be the same or different. Z53 and Z54 may be the same.

Among these compounds, preferable are hydroxylamines, sulfinic acids, sulfurous acid, guanidines, aminoguanidines, heterocyclic thiols, cyclic or chain-like active methylene compounds and cyclic or chain-like active methine compounds. Particularly preferable are guanidines and aminoguanidines.

These decolorizing agents may be incorporated into unexposed photosensitive materials, or these decolorizing agents may be added to exposed photosensitive materials by an appropriate method when the exposed photosensitive materials are processed. When added, these decolorizing agents may be in the form of precursors.

The decolorizing agent is thought to make contact with dye molecules to undergo nucleophilic addition to the dye molecule so that the dye is decolorized when the photosensitive material is processed. As a preferable procedure, a dye-containing silver halide photosensitive material after imagewise exposure or at the time of imagewise exposure thereof is put together with a processing material, which contains a decolorizing agent or a precursor thereof, face to face in the presence of water, and then these materials are heated. When these materials are separated from each other after the heating step, a colored image is obtained in the silver halide photosensitive material and the dye is decolorized. In this case, the concentration of the dye after the decolorization is one third or less and preferably one fifth or less of the original concentration. The molar amount of the decolorizing agent to be used is in the range of 0.1 to 200 times and preferably 0.5 to 100 times the molar amount of the dye.

The photosensitive material of the present invention is preferably hardened by means of a hardener.

Examples of the hardener include those described in U.S. Pat. Nos. 4,678,739, column 41 and 4,791,042, and in JP-A Nos.59-116,655, 62-245,261, 61-18,942 and 4-218,044. More specifically, examples of these hardeners include aldehydes (e.g., formaldehyde), aziridines, an epoxy, vinylsulfones (e.g., N,N'-ethylene-bis(vinylsulfonylacetamide) ethane), N-methylol compounds (e.g., dimethylolurea), boric acid, metaboric acid and polymeric hardeners (e.g., a compound described in, e.g., JP-A No.62-234,157).

The amount of the hardener added is in the range of 0.001 g to 1 g, preferably 0.005 to 0.5 g, per gram of the hydrophilic binder.

The photosensitive material of the present invention may contain an anti-fogging agent or a photographic stabilizer as well as a precursor thereof, examples of which include the compounds described in the aforesaid RD, U.S. Pat. Nos. 5,089,378, 4,500,627 and 4,614,702, JP-A No.64-13,564, pp. 7–9, pp. 57–71 and pp. 81–97; U.S. Pat. Nos. 4,775,610, 4,626,500 and 4,983,494, JP-A Nos.62-174,747, 62-239,148, 1-150,135, 2-110,557, 2-178,650 and RD 17,643 (1978) pp. 24–25.

The amount of these compounds added is preferably in the range of $5\times10^{-6}$ to $1\times10^{-1}$ mol, more preferably $1\times10^{-5}$ to $1\times10^{-2}$ mol, per mol of silver.

For such purposes as improvement of the coatability, improvement of the releaseability, improvement of the sliding ability, prevention of electrostatic charge and acceleration of development, a surfactant may be added to the photosensitive material. Examples of the surfactant include those described in "Known Technologies (Kochi-Gijutsu)" No.5 (issued on Mar. 22, 1991, ASTECH Inc.), pp. 136–138, and in JP-A Nos. 62-173,643 and 62-183,457.

For such purposes as prevention of slip, prevention of electrostatic charge and improvement of the releaseability, an organic fluorine-containing compound may be added to the photosensitive material. Typical examples of the organic fluorine-containing surfactant include a fluorine-containing surfactant and a hydrophobic fluorine-containing compound, an oily fluorine compound e.g., fluorocarbon oil, and a solid fluorine-containing resin, e.g., tetrafluoroethylene resin, described in JP-B No. 57-9,053, columns 8–17, JP-A Nos. 61-20,944 and 62-135,826. The use of a fluorine-containing surfactant having a hydrophilic group is also preferable because it maintains the wettablility and prevents antistatic property of the photosensitive material.

Preferably, the photosensitive material has a certain level of sliding ability. For this purpose, layers containing a slicking agent are preferably formed on the surfaces of both a photosensitive layer and a back layer. A preferable level of sliding ability is indicated by a coefficient of kinetic friction of 0.01 to 0.25. This value represents a measured value determined in a test comprising sliding a stainless steel ball having a diameter of 5 mm on the photosensitive material at a rate of 60 cm/minute (25° C., 60% RH). In this evaluation, a value of nearly the same level is obtained even when the stainless steel ball is replaced with the surface of a photosensitive layer.

Examples of usable slicking agents include polyorganosiloxanes, higher fatty acid amides, metals salts of higher fatty acids, and esters of higher fatty acids and higher alcohols. Examples of the polyorganosiloxanes include polydimethylsiloxane, polydiethylsiloxane, polystyrylmethylsiloxane and polymethylphenylsiloxane. A layer to which the slicking agent is added is preferably the outermost emulsion layer or the back layer. Polydimethylsiloxanes or esters having a long-chain alkyl group are particularly preferable. Silicone oils and chlorinated paraffins are preferably used in order to prevent the pressure-induced fogging or pressure-induced sensitization of silver halide.

In the present invention, an antistatic agent is preferably used. Examples of the antistatic agent include carboxylic acids, carboxylates, polymers containing a sulfonate group, cationic polymers and ionic surfactant compounds.

It is most preferable to use as the antistatic agent at least one finely-divided crystalline metal oxide which is selected from the group consisting of ZnO, $TiO_2$, $SnO_2$, $Al_2O_3$, $In_2O_3$, $SiO_2$, MgO, BaO, $MoO_3$ and $V_2O_5$ and which has a volume resistivity of $10^7$ Ω.cm or less, more preferably $10^5$ Ω.cm or less, and a particle size of 0.001 to 1.0 μm, fine particles of compositeoxides (e.g., Sb, P, B, In, S, Si and C) of these metal oxides, fine particles of metal oxides in a sol state, or fine particles of composite oxides of these metal oxides in a sol state. The content in the photosensitive material is preferably 5 to 500 mg/$m^2$, and most preferably 10 to 350 mg/$m^2$. The ratio of an electroconductive crystalline oxide or its composite oxide to the binder is preferably 1/300 to 100/1, and more preferably 1/100 to 100/5. It is also preferable to coat a water-resistant polymer, described in JP-A No. 8-292,514, on the back of the support of the photosensitive material.

Constituent layers (including back layers) of the photosensitive material or processing material which is described later can contain a polymer latex in order to improve film physical properties such as dimension stability, prevention of curling, prevention of adhesion, prevention of film cracking and prevention of pressure-induced sensitization or desensitization. Any of the polymer latices, which are described in, e.g., JP-A Nos. 62-245,258, 62-136,648 and 62-110,066, can be used. Particularly, the utilization of a polymer latex having a low glass transition point (40° C. or below) in the mordant layer can prevent cracking of the mordant layer, while the utilization of a polymer latex having a high glass transition point in the back layer provides a curl-preventing effect.

The photosensitive material of the present invention preferably contains a matting agent. Although the matting agent can be added to either the emulsion surface or the back surface, it is most preferable that the matting agent be added to the outermost layer on the same side of the support that the emulsion layer is provided. The matting agent may be either soluble or insoluble in the processing solutions, and it is preferable to use a combination of a soluble matting agent and an insoluble matting agent. Preferable examples are particles of polymethylmethacrylate, particles of poly (methylmethacrylate/methacrylic acid) (in a molar ratio of 9/1 or 5/5) and particles of polystyrene. The matting agent has particle diameters preferably in the range of 0.8 to 10 μm and preferably a narrow range of particle diameter distribution. It is preferable that 90% or more of the total number of the particles have a diameter falling in the range of 0.9 to 1.1 times the average particle diameter. Meanwhile, in order to enhance the matting effect, it is also preferable to use fine particles having a diameter of 0.8 μm or less, together with the matting agent having the above-mentioned particle diameter. Examples of the fine particles include particles of polymethylmethacrylate (0.2 μm), particles of poly (methylmethacrylate/methacrylic acid) (in a molar ratio of 9/1, 0.3 μm), particles of polystyrene (0.25 μm) and particles of colloidal silica (0.03 μm).

Concrete examples of the matting agent are described in JP-A No.61-88,256, pp. 29. Other examples of the matting agent are such materials as benzoguanamine resin beads, polycarbonate resin beads and AS resin beads, all of which are described in JP-A Nos.63-274,944 and 63-274,952. Further, the compounds which are described in the aforementioned RD can be employed as the matting agent.

These matting agents may be dispersed in binders described in the paragraph relating to binders and thereafter used as dispersions, as occasion demands. Particularly, a dispersion in gelatin, for example, acid-processed gelatin, easily provides a stable coating solution, in which parameters, i.e., pH, ion strength and binder concentration, are preferably optimized, if necessary.

The following compounds can also be used:

Dispersing media for oil-soluble organic compounds: P-3, P-5, P-16, P-19, P-25, P-30, P-42, P-49, P-54, P-55, P-66, P-81, P-85, P-86 and P-93 (pages 140 to 144) in JP-A No. 62-215,272;

Latices for impregnating oil-soluble organic compounds: latices described in U.S. Pat. No. 4,199,363;

Scavengers for oxidized forms of developing agents: compounds represented by Formula (I) in column 2, lines 54 to 62 (particularly I-(1), I-(2), I-(6) and I-(12) (columns 4 and 5)) in U.S. Pat. No. 4,978,606, and compounds represented by formulas in column 2, lines 5 to 10(particularly compound 1 (column 3)) in U.S. Pat. No. 4,923,787;

Stain inhibitors: Compounds represented by Formulas (I) to (III) on page 4, lines 30 to 33, and particularly I-47, I-72, III-1 and III-27 (pages 24 to 48) in European Patent Application No. 298,321A;

Ant-fading agents: A-6, A-7, A-20, A-21, A-23, A-24, A-25, A-26, A-30, A-37, A-40, A-42, A-48, A-63, A-90, A-92, A-94 and A-164 (pages 69 to 118) in European Patent Application No. 298,321A, II-1 to III-23, particularly III-10, in columns 25 to 38 in U.S. patent application Ser. No. 5,122,444, I-1 to III-4, particularly II-2, on pages 8 to 12 in European Patent Application No. 471,347A, and A-1 to A-48, particularly A-39 and A-42, in columns 32 to 40 in U.S. Pat. No. 5,139,931;

Materials which reduce the use amount of a color enhancer or a color, mixing prevention agent: I-1 to II-15, particularly I-46, on pages 5 to 24 in European Patent Application No. 411,324A;

Formalin scavengers: SCV-1 to SCV-28, particularly SCV-8, on pages 24 to 29 in European Patent Application No. 477,932A;

Hardeners: H-1, H-4, H-6, H-8 and H-14 on page 17 in JP-A No. 1-214,845, compounds (H-1 to H-54) represented by Formulas (VII) to (XII) in columns 13 to 23 in U.S. Pat. No. 4,618,573, compounds (H-1 to H-76), particularly H-14, represented by Formula (6) on page 8, lower right column, in JP-A No. 2-214,852, and compounds described in claim 1 of U.S. Pat. No. 3,325,287;

Precursors of development inhibitors: P-24, P-37 and P-39 (pages 6 and 7) in JP-A No. 62-168,139 and compounds described in claim 1, particularly compounds 28 and 29, in column 7, of U.S. Pat. No. 5,019,492;

Antiseptic agents and mildew-proofing agents: I-1 to III-43, particularly II-1, II-9, II-10, II-18 and III-25, in columns 3 to 15 of U.S. Pat. No. 4,923,790;

Stabilizers and anti-fogging agents: I-1 to (14), particularly I-1, 60, (2) and (13), in columns 6 to 16 in U.S. Pat. No. 4,923,793, and compounds 1 to 65, particularly compound 36, in columns 25 to 32 in U.S. Pat. No. 4,952,483;

Chemical sensitizers: triphenylphosphine selenide and compound 50 described in JP-A No.5-40,324;

Dyes: a-1 to b-20, particularly a-1, a-12, a-18, a-27, a-35, a-36 and b-5 on pages 15 to 18, and V-1 to V-23, particularly V-1, on pages 27 to 29 in JP-A No. 3-156,450, F-I-1 to F-II-43, particularly F-I-11 and F-II-8, on pages 33 to 55 in European Patent Application No. 445,627A, III-1 to III-36, particularly III-1 and III-3, on pages 17 to 28 in European Patent Application No. 457,153A, crystallite dispersions of Dye-1 to Dye-124 on pages 8 to 26 in WO 88/04,794, compounds 1 to 22, particularly compound 1, on pages 6 to 11 in European Patent Application No. 319,999A, compounds D-1 to D-87 (pages 3 to 28) represented by Formulas (1) to (3) in European Patent Application No. 519,306A, compounds 1 to 22 (columns 3 to 10) represented by Formulas (I) in U.S. Pat. No 4,268,622, and compounds (1) to (31) (columns 2 to 9) represented by Formulas (I) in U.S. Pat. No. 4,923,788;

Ultraviolet ray absorbents: compounds (18b) to (18r) and 101 to 427 (pages 6 to 9) represented by Formulas (1) in JP-A No.46-3,335, compounds (3) to (66) (pages 10 to 44) represented by Formula (I) and compounds HBT-1 to HBT-10 (page 14) represented by Formula (III) in European Patent Application No. 520,938A and compounds (1) to (31) (columns 2 to 9) represented by Formula (1) in European Patent Application No. 521,823A.

The additives described above, such as a hardener, an anti-fogging agent, a surfactant, a slicking agent, an anti-static agent, a latex and a matting agent, may be added, if necessary, to a processing material or to both of the processing material and a photosensitive material.

In the present invention, a support for the photosensitive material needs to be transparent and to be able to withstand the processing temperature. Generally, examples of the support are paper, a synthetic polymer (film) and the like, as described in "Fundamentals of Photographic Engineering—Silver Salt Photography Section", pp. 223–240, edited by Photographic Society of Japan, Corona Co., Ltd., 1979. Concrete examples of the support include polyethylene terephthalate, polyethylene naphthalate, polycarbonate, polyvinyl chloride, polystyrene, polypropylene, polyimide and cellulose (e.g., triacetylcellulose).

Other supports, which can be used in the present invention, include those described in, e.g., JP-A Nos.62-253,159, pp. 29–31, 1-161,236, pp. 14–17, 63-316,848, 2-22,651 and 3-56,955 and U.S. Pat. No. 5,001,033. In order to improve optical properties and physical properties, these supports may undergo treatments such as a thermal treatment (control of degree of crystallization or orientation), uniaxial or biaxial stretching (control of orientation), blending with other polymers and a surface treatment.

Where requirements of resistance to heat and curling are stringent, preferred examples of the supports are those described in JP-A Nos.6-41,281, 6-43,581, 6-51,426, 6-51,437, 6-51,442, Japanese Patent Application Nos. 4-251,845, 4-231,825, 4-253,545, 4-258,828, 4-240,122, 4-221,538, 5-21,625, 5-15,926, 4-331,928, 5-199,704, 6-13,455 and 6-14,666.

Also preferable is a support made from a styrene-based polymer mainly composed of a syndiotactic structure. The thickness of the support is preferably 5 to 200 $\mu$m and more preferably 40 to 120 $\mu$m.

In order to adhere the constituent photographic layer to the support, it is preferable that the support be surface-treated. Examples of the surface-activating treatments include a chemical treatment, a mechanical treatment, a corona discharge treatment, a flame treatment, an ultraviolet ray treatment, a microwave treatment, a glow discharge treatment, an activated plasma treatment, a laser treatment, a mixed acid treatment and an ozone-oxidation treatment. Among these surface treatments, an ultraviolet ray irradiation treatment, a flame treatment, a corona discharge treatment and glow discharge treatment are particularly preferable.

A subbing layer is described below. The subbing layer may consist of a single layer or two or more layers. Examples of the binder for the subbing layer include a copolymer, which is made up of a monomer, as a starting material, selected from the group consisting of vinyl chloride, vinylidene chloride, butadiene, methacrylic acid, acrylic acid, itaconic acid, maleic anhydride and the like, polyethyleneimine, an epoxy resin, grafted gelatin, nitrocellulose, gelatin, polyvinyl alcohol, and modified polymers thereof. Examples of compounds which swell the support include resorcin and p-chlorophenol. The subbing layer may contain a gelatin-hardening agent such as chromates (e.g., chromium alum), aldehydes (e.g., formaldehyde and glutaraldehyde), isocyanates, active halogenated compounds (e.g., 2,4-dichloro-6-hydroxy-s-triazine), epichlorohydrin resins and active vinylsulfones. Further, the subbing layer may contain $SiO_2$, $TiO_2$, particles of an inorganic material or particles of a copolymer of methyl methacrylate (0.01 to 10 $\mu$m) as a matting agent.

In addition, it is preferable to record photographing information and the like by use of a support which is provided with a magnetic recording layer and is described in JP-A Nos. 4-124,645, 5-40,321, 6-35,092 and 6-317,875.

A magnetic recording layer is formed by coating onto a support an aqueous or organic solvent-based coating solution comprising a binder and magnetic particles dispersed therein.

Examples of usable magnetic particles include ferromagnetic iron oxide such as $\gamma$-$Fe_2O_3$, Co-deposited $\gamma$-$Fe_2O_3$, Co-deposited magnetite, Co-containing magnetite, ferromagnetic chromium dioxide, ferromagnetic metals, ferromagnetic alloys, hexagonal system Ba-ferrite, Sr-ferrite, Pb-ferrite and Ca-ferrite. A Co-deposited ferromagnetic iron oxide such as Co-deposited $\gamma$-$Fe_2O_3$ is preferable. The particle can take the shape of any of, e.g., a needle, a rice grain, a sphere, a cube and a plate. The specific surface area in $S_{BET}$ is preferably 20 $m^2/g$ or greater, more preferably 30 $m^2/g$ or greater. The saturation magnetization ($\sigma s$) of the ferromagnetic substance is preferably in the range of $3.0\times10^4$ to $3.0\times10^5$ A/m, more preferably $4.0\times10^4$ to $2.5\times10^5$ A/m. The ferromagnetic particles may be surface-treated with silica and/or alumina or with an organic substance. Further, as described in JP-A No.6-161,032, the ferromagnetic particles may be surface-treated with a silane coupling agent or with a titanium coupling agent. Magnetic particles, which are covered with an inorganic or organic substance and are described in JP-A Nos.4-259,911 and 5-81,652, can also be used in the present invention.

As described in JP-A No.4-219,569, the binders usable together with the magnetic particles are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 300° C. and a weight average molecular weight in the range of 2,000 to 1,000,000. Preferred examples of the binder include vinyl copolymers, cellulose derivatives, such as cellulose diacetate, cellulose triacetate, cellulose acetatepropionate, cellulose acetatebulylate and cellulose tripropionate, acrylic resins, polyvinyl acetal resins and gelatin. Cellulose di (tri) acetate is particularly preferable. The binder may be hardened by use of a crosslinking agent such as an epoxy, aziridine or isocyanate crosslinking agent. Examples of the isocyanate crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in JP-A No.6-59,357.

As described in JP-A No.6-35,092, the aforementioned magnetic particles are dispersed in a binder preferably by means of a kneader, a pin-type mill or an annular mill. A combination of these dispersing means is also preferable. Dispersants described in JP-A No.5-088,283 and other known dispersants can be used. The thickness of the magnetic recording layer is in the range of 0.1 to 10 $\mu$m, preferably 0.2 to 5 $\mu$m, and more preferably 0.3 to 3 $\mu$m. The weight ratio of the magnetic particles to the binder is preferably in the range of 0.5:100 to 60:100, more preferably 1:100 to 30:100. The coated amount of the magnetic particles is in the range of 0.005 to 3 g/m$^2$, preferably 0.01 to 2 g/m$^2$, and more preferably 0.02 to 0.5 g/m$^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic support by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in JP-A No.5-341,436, is preferably used.

The magnetic recording layer may also function in the enhancement of lubrication, control of curling, prevention of electrostatic charge, prevention of adhesion and head polishing. Alternatively, another functional layer can be formed and any of these functions can be given to that layer. It is preferable to use a abrasive comprising abrasive particles at least one kind of which is composed of non-spherically shaped inorganic particles having a Mohs hardness of 5 or greater. Examples of the composition of non-spherical inorganic particles include oxides, such as aluminum oxide, chromium oxide, silicon dioxide and titanium dioxide, carbides, such as silicon carbide and titanium carbide, and a fine powder of diamond. The surface of abrasive particles may be treated with a silane coupling agent or with a titanium coupling agent. These particles may be added to the magnetic recording layer. Alternatively, the magnetic recording layer may be overcoated with a coating solution (e.g., a protective layer and lubricating layer) containing these particles. As for the binder in the overcoat, the same binders as those mentioned above may be used, and the binder in the overcoat is preferably the same as that for the magnetic recording layer. The photosensitive materials having a magnetic recording layer are described in U.S. Pat. Nos. 5,336,589, 5,250,404, 5,229,259 and 5,215,874 and in European Patent No. 466,130.

A polyester support suitable for use in the photosensitive material having a magnetic recording layer in the present invention is described below. Details of the polyester support, photosensitive materials, processings, cartridges and examples are described in Journal of Technical Disclosure (Kokai-Giho) No.94-6,023 (JIII; Mar. 15, 1994). The polyester used in the present invention is made up of a diol and an aromatic dicarboxylic acid as essential components. Examples of the aromatic dicarboxylic acid include 2,6-, 1,5-, 1,4- and 2,7-naphthalenedicarboxylic acids, terephthalic acid, isophthalic acid and phthalic acid. Examples of the diol include diethyleneglycol, triethyleneglycol, cyclohexanedimethanol, bisphenol A and bisphenol. Examples of the polymer are homopolymers such as polyethylene terephthalate, polyethylene naphthalate and polycyclohexanedimethanol terephthalate. The polyester containing 50 to 100 mol% of 2,6-naphthalenedicarboxylic acid is particularly preferable. Polyethylene 2,6-naphthalate is most preferable among these polymers. The average molecular weight ranges between 5,000 and 200,000. The Tg of the polyesters for use in the present invention is 50° C. or higher, preferably 90° C. or higher.

In order to make the polyester support more resistant to habitual wound behavior, the polyester support is heat-treated at a temperature within the range of from 40° C. up to the Tg, more preferably at a temperature within the range of from Tg −20° C. up to Tg. The heat treatment can be performed at a fixed temperature within this range or can be performed while being cooled. The heat treatment time is 0.1 to 1,500 hours, more preferably 0.5 to 200 hours. The heat treatment can be performed in the form of a rolled support or while the support is conveyed in the form of a web. Grooves and bumps (e.g., coating the surface with electroconductive inorganic fine particles such as $SnO_2$ or $Sb_2O_5$) may be given to the surface to improve the surface condition. It is also desirable to knurl and slightly raise the edge portions, thereby preventing the shape of the cut edge portions of the core from being transferred. These heat treatments can be performed at any stage, for example, after the film making of the support, after surface treatment, after back layer coating (e.g., an antistatic agent or lubrication agent) and after coating of a subbing layer. A preferable stage for the heat treatment is after the application of the antistatic agent.

An ultraviolet ray absorbent may be incorporated into this polyester. Also, the prevention of light piping can be achieved by incorporating the polyester with a dye or pigment, such as "Diaresin" manufactured by Mitsubishi Chemical Industries, Ltd. or "Kayaset" manufactured by Nippon Kayaku Co., Ltd., which is commercially available as an additive to polyester.

A film cartridge, into which the photosensitive material of the present invention may be loaded, is described below. The main material of the film cartridge may be a metal or a synthetic plastic.

Preferable examples of the plastic material include polystyrene, polyethylene, polypropylene, polyphenyl ether and the like. The film cartridge may contain an antistatic agent, examples of which include carbon black, metal oxide particles, surfactants such as nonionic, anionic, cationic and betaine-based surfactants, and polymers Examples of the film cartridge, which have been rendered antistatic, are described in JP-A Nos. 1-312,537 and 1-312,538. The resistivity of the film cartridge is preferably 1012 Ω.cm or less under conditions of 25° C. and 25%RH. Normally, carbon black or a pigment is incorporated into the plastic film cartridge in order to impart light-shielding properties. The size of the film cartridge may be the 135 size which is currently employed. For use in a small-sized camera, a film cartridge having a diameter of the cartridge of 22 mm or less may be used in place of the currently employed 135 size having a diameter of cartridge of 25 mm. The volume of the film cartridge is 30 $cm^3$ or less and preferably 25 $cm^3$ or less. The weight of the plastics for a film cartridge is preferably in the range of 5 to 15 g.

A film cartridge which feeds out film by the rotation of a spool may be used in the present invention. A film cartridge in which the leading end of the film therein is fed from the port of the film cartridge to the outside by rotating the spool shaft in the direction of the feed of the film can also be used. These film cartridge are described in U.S. Pat. Nos. 4,834,306 and 5,226,613.

The photosensitive material of the present invention described above is also suitable for use in a film unit with a lens described in JP-B No.32,615 and Japanese Utility Model Application Publication (JP-Y) No. 3-39,784.

The film unit with a lens refers to a unit made up of a package unit body which is provided with a photographing lens and shutter and accommodates an unexposed photosensitive material in the form of a sheet or a roll either directly or by loading it in a container, in which the unit is sealed in a light-tight manner and is further packaged in an exterior packaging material.

In addition, the package unit body may be provided with a finder and mechanisms for, e.g., forwarding frames, accommodating an exposed photosensitive material and taking it out. Further, the finder may be provided with a parallax-correcting support, while the photographing mechanism may be provided with an auxiliary illuminating mechanism described in Japanese Utility Model Application Laid-Open (JP-U) Nos. 1-93,723, 1-57,738 and 1-57,740, JP-A Nos. 1-93,723 and 1-152,437.

Since the package unit body in the present invention accommodates the photosensitive material, the humidity inside the package unit is adjusted to a value of relative humidity ranging from 40 to 70%, preferably from 50 to 65%, at 25° C. As for an exterior packaging material, the use of a moisture impermeable material or a hygroscopic material is preferable, an example of which is a material whose water absorption is 0.1% or less in the test according to ASTM D-570. The use of a sheet laminated with aluminum foil or the use of aluminum foil is particularly preferred.

A container, which is provided within the package unit body and accommodates an exposed photosensitive material, may be a container for a cartridge for an exterior package unit or a conventional cartridge. Examples of the container are described in, e.g., JP-A Nos. 54-111,822 and 63-194,255, U.S. Pat. Nos. 4,832,275 and 4,834,306, Japanese Patent Application Nos. 63-183,344, 1-21,862 and 1-85,198. The film sizes of the photosensitive materials include a 110 size, a 135 size, a half size thereof and a 126 size.

The plastic material for forming the package unit in the present invention can be produced by various methods such as an addition polymerization of an olefin having a carbon to carbon double bond, a ring-opening polymerization of a compound composed of a ring having a few constituent members, a polycondensation between two or more polyfunctional compounds, a polyaddition, and an addition-condensation between a derivative of phenol, urea or melamine and a compound having an aldehyde group.

The processing layer of the processing material to be used in the present invention contains at least a base and/or a base precursor.

An inorganic or organic base can be used as the base in the present invention. Examples of the inorganic base include hydroxides, phosphates, carbonates, borates and salts of organic acids of alkali metals or alkaline earth metals described in JP-A No. 62-209,448 as well as acetylides of alkali metals or alkaline earth metals described in JP-A Nos.63-25,208.

Examples of the organic base include ammonia, aliphatic or aromatic amines (e.g., primary amines, secondary amines, tertiary amines, polyamines, hydroxylamines and heterocyclic amines), amidines, bis-, tris- or tetra-amidines, guanidines, water-insoluble mono-, bis-, tris- or tetra-guanidines, and hydroxides of quaternary ammonium.

The base precursor may be a decarboxylation type compound, a decomposition type compound, a reactive type compound or a complex salt-forming type compound.

In the present invention, as described in European Patent Application Laid-Open No. 210,660, U.S. Pat. No. 4,740,445, of the purpose of generating a base, it is effective to employ as a base precursor a combination of a slightly soluble basic metal compound and a compound (complex forming compound) capable of reacting to form a complex with the metal ion constituting the basic metal compound utilizing water as a medium. In this case, it is preferable to add the slightly soluble basic metal compound to the photosensitive material and to add the complex forming compound to the processing material, but the reversal is also possible.

The amount of the base or base precursor added is in the range of 0.1 to 20 $g/m^2$ and preferably in the range of 1 to 10 $g/m^2$.

The binder for the processing layer may be the same hydrophilic polymer as in the photosensitive material.

As in the case of the photosensitive material, the processing material is preferably hardened by means of a hardener. The hardener which is the same as in the photosensitive material may be used for hardening the processing material.

As stated previously, the processing material may contain a mordant which removes by transfer the dye contained in the yellow color filter layer or antihalation layer of the photosensitive material. A polymeric mordant is preferable. Examples of the polymeric mordant include a polymer containing a secondary or tertiary amino group, a polymer having a nitrogen-containing heterocyclic moiety and a polymer containing a quaternary cationic group thereof. The molecular weight of the polymeric mordant is in the range of 5,000 to 200,000 and preferably in the range of 10,000 to 50,000.

More concretely, examples of the mordant are described in, e.g., U.S. Pat. Nos. 2,548,564, 2,484,430, 3,148,061, 3,756,814, 3,625,694, 3,859,096, 4,128,538, 3,958,995, 2,721,852, 2,798,063, 4,168,976, 3,709,690, 3,788,855, 3,642,482, 3,488,706, 3,557,066, 3,271,147, 3,271,148, 2,675,316, 2,882,156, British Patent No. 1,277,453, JP-A Nos.54-115,228, 54-145,529, 54-126,027, 50-71,332, 53-30,328, 52-155,528, 53-125 and 53-1,024.

The amount of the mordant added is in the range of 0.1 to 10 $g/m^2$ and preferably in the range of 0.5 to 5 $g/m^2$.

In the present invention, the processing material may contain a development stopper or a precursor of the development stopper so that the development stopper functions simultaneously with the development or after a certain delay from the development.

The development stopper as written here refers to a compound which terminates the development by rapidly neutralizing or reacting with the base to decrease the base concentration in the layer or a compound which inhibits the development by interacting with silver or a silver salt, after a proper stage of development is achieved. Concrete example of the stopper include an acid precursor which release an acid upon heating, an electrophilic compound which causes a substitution reaction with a base present in the layer upon heating, and a nitrogen-containing heterocyclic compound or a mercapto compound or a precursor thereof. Details of these compounds are described in JP-A No.62-190,529, pp.31–32.

Further, the processing material may contain a printout preventing agent for a silver halide so that the printout preventing agent functions simultaneously with the development. Examples of the printout preventing agent include halides described in JP-B No.54-164, JP-A Nos. 53-46,020 and 48-45,228 and JP-B No. 57-8,454, 1-phenyl-5-mercaptotetrazoles described in British Patent No.1,005,144 and viologens described in JP-A No.8-184,936.

The amount of the printout preventing agent added is in the range of $10^{-4}$ to 1 mol, preferably in the range of $10^{-3}$ to $10^{-2}$ mol, per mol of Ag.

Meanwhile, the processing material may contain a physical development nucleus and a solvent for a silver halide so that the silver halide of the photosensitive material is solubilized and fixed to the processing layer concurrently with the development.

A reducing agent necessary for the physical development may be any of the reducing agents known in the field of a photosensitive material. Further, a precursor of the reducing agent may be used which itself has no reducing capability but is given a reducing capability by a nucleophilic reagent or heat in the developing process. The developing agent which is not consumed in the development and diffuses from the photosensitive material can be used as a reducing agent, or otherwise a reducing agent may be incorporated in the processing material. In the latter case, the reducing agent incorporated in the processing material may be the same as or different from the reducing agent incorporated in the photosensitive material.

Examples of the reducing agents to be used in the present invention include the reducing agents and precursors thereof described in U.S. Pat. Nos. 4,500,626, columns 49–50, 4,483,914, columns 30–31, 4,330,617 and 4,590,152, JP-A Nos.60-140,335, pp.17–18, 57-40,245, 56-138,736, 59-178,458, 59-53,831, 59-182,449, 59-182,450, 60-119,555, 60-128,436 to 60-128,439, 60-198,540, 60-181,742, 61-259,253, 62-244,044, 62-131,253 to 62-131,256, and European Patent Application No.220,746A2, pp.78–96.

Further, a combination of reducing agents, which are disclosed in U.S. Pat. No. 3,039,869, can also be used in the present invention.

In the case where a diffusive developing agent is used, a combination of an electron transferring agent and/or a precursor thereof may be used, if necessary. The electron transferring agent or a precursor thereof may be selected from the reducing agents or precursors thereof enumerated previously.

If the reducing agent is added to the processing material, the amount of the reducing agent added is in the range of 0.01 to 10 g/m$^2$ and preferably in the range of 0.1 to 5 times the moles of silver in the photosensitive material.

A physical development nucleus reduces the soluble silver halide diffused from the photosensitive material to convert it into physically developed silver so that the developed silver is fixed to a processing layer. Examples of the physical development nucleus include any known colloidal particles of a heavy metal, such as zinc, mercury, lead, cadmium, iron, chromium, nickel, tin, cobalt, copper and ruthenium, a noble metal, such as palladium, platinum, gold and silver, and a chalcogen compound, such as sulfur, selenium or tellurium, of any of these heavy metals and noble metals.

The particle diameters of these physical development nuclei are preferably in the range of 2 to 200 nm.

The physical development nuclei are present in an amount ranging normally from $10^{-3}$mg to 10 g/m$^2$ in the processing layer.

The solvent for silver halide may be a known compound, preferable examples of which include thiosulfates, sulfites, thiocyanates, thioethers as described in JP-B No.47-11,386, a compound having a 5- or 6-membered imido ring, such as urasil and hydantoin, described in JP-A No. 8-179,458, a compound having a sulfur to carbon double bond as described in JP-A No.53-144,319, and a mesoion thiolate compound such as trimethyltriazolium thiolate described in "Analytica Chimica Acta", vol. 248, pp.604 to 614 (1991). A compound which is described in JP-A No.8-69,097 and which is capable of fixing a silver halide to stabilize it can also be used as a solvent for silver halide.

The above-described solvents for the silver halide may be used alone or in a combination of two or more of them.

The total amount of the solvent for silver halide in the processing layer is in the range of 0.01 to 100 mmol/m$^2$ and preferably 0.1 to 50 mmol/m$^2$. This amount ranges from 1/20 to 20 times, preferably from 1/10 to 10 times, and more preferably from 1/4 to 4 times the molar amount of coated silver in a photosensitive material.

When using the solvent for silver halide, it may be added to a solvent, such as water, methanol, ethanol, acetone, dimethylformamide or methylpropyl glycol, or to an alkaline or acidic aqueous solution. Otherwise a dispersion comprising solid particles of the solvent for the silver halide may be added to a coating solution.

A processing material may comprise auxiliary layers such as a protective layer, a subbing layer, a back layer and the like.

The processing material is preferably composed of a continuous web and a processing layer coated thereon. The continuous web here refers to a web having a size which affords the processing material with a length sufficiently longer than the longer side of the photosensitive material to be processed. This means that part of the photosensitive material does not need to be cut and that a plurality of photosensitive materials can be processed. Generally, the processing material coated on the continuous web has a length 5 to 10,000 times greater than the width. Although the width of the processing material is not limited, it is preferably larger than the width of the corresponding photosensitive material.

It is also preferable to process a plurality of photosensitive materials arranged in parallel. In this case, the width of the processing material is preferably equal to or larger than the width of the photosensitive material multiplied by the number of simultaneous processes.

In a process utilizing such a continuous web, the web is preferably fed from a feeding roll and wound on a windup roll so that the web can be disposed. Particularly, this disposal is easier when the photosensitive material has a large size.

As explained above, the handling of the processing material coated on a continuous web is much easier in comparison with the handling of a conventional processing material coated on a sheet.

The thickness of the support for the processing material is not limited, but a smaller thickness is preferable and most preferably the thickness is in the range of 4 to 120 $\mu$m. A processing material comprising a support having thickness of 40 $\mu$m or less is particularly preferable, because it increases the amount of processing material per unit volume and therefore the roll for the processing material can be rendered compact.

The material for the support is not particularly limited, but it must withstand the processing temperature. The support is generally selected from photographic supports such as paper, synthetic polymer (film), described in "Fundamentals of Photographic Engineering—Silver Salt Photography Section", pp.223–240, edited by Photographic Society of Japan, Corona Co., Ltd., 1979.

The support may be composed of a single material, or otherwise it may comprise a material having one side or both sides coated or laminated with a synthetic polymer such as polyethylene.

Other supports, which can be used in the present invention, include those described in, e.g., JP-A Nos.62-253,159, pp.29–31, 1-161,236, pp.14–17; 63-316,848; 2-22,651and3-56,955and U.S. Pat. No. 5,001,033.

Also preferable is a support made from a styrene-based polymer mainly composed of a syndiotactic structure.

The surface of these supports may be coated with a hydrophilic binder, a semiconducting metal oxide, such as alumina sol or tin oxide, and an antistatic agent such carbon black. A support having aluminum deposited on the surface thereof is also suitable.

In the present invention, in a developing process of the photosensitive material exposed for taking photographs by use of a camera or the like, the photosensitive material is put together with a processing material having a processing layer, in the presence of water in an amount ranging from 1/10 to the equivalent of an amount which is required for the maximum swelling of the entire coating layers excluding back layers of these materials, so that the photosensitive layer and the processing layer face each other. These materials are then heated at 60 to 100° C. for 5 to 60 seconds.

If the amount of water supplied is less than one tenth of the amount which is required for the maximum swelling of the entire coating layers, it is difficult to obtain a desired level of image density, whereas if the amount of water supplied is more than the amount which is required for the maximum swelling of the entire coating layers, undesirable unevenness in image density increases.

The water is not particularly specified, and examples of the water include distilled water, ion-exchange water, tap water, well water and mineral water. The water may be reused by being filtered and recycled by adding thereto a small amount of antiseptic for the prevention of water scale and putrefaction or by use of an active carbon filter or an ion-exchange resin filter.

In the present invention, the photosensitive material and/or the processing material, which are swollen with water, are put together and thereafter heated. Since the swollen layers are unstable, it is important to limit the amount of water to the above-mentioned range in order to prevent localized unevenness in color development.

The amount of water which is required for the maximum swelling of the coating layer can be obtained by a procedure comprising the steps of immersing a photosensitive or processing material having a coating layer for the measuring of swell, measuring the weight of the maximum swell after confirming that the layer is sufficiently swollen by measuring the thickness of the layer, and subtracting the weight of the original layer from the measured weight. An example for measuring the degree of swell is described in "Photographic Science Engineering", vol. 16. Pp. 449 (1972).

As for the methods for supplying water, two methods are conceivable, i.e., a method in which a photosensitive material or processing material is immersed in water and thereafter the excess water is removed by means of a squeezing roller and a method in which a predetermined amount of water is supplied to the photosensitive material or processing material. The latter method in which a predetermined amount of water is coated onto the photosensitive material or processing material is preferable. In this case, a particularly preferred mode is the employment of a water spraying apparatus comprising a plurality of nozzles which eject water and are linearly arranged at certain intervals in the direction perpendicular to the direction of the transfer of the photosensitive material or processing material and also actuators which displace the nozzles in the direction of the photosensitive material or processing material being transferred. Further, a method in which water is coated with a sponge or the like onto the photosensitive material or processing material is also suitable, because the apparatus in this case is simple.

The temperature of water supplied is preferably in the range of 30 to 60° C.

Examples of the method for putting the photosensitive material and the processing material together are described in JP-A Nos.62-253,159 and 61-147,244.

Examples of the heating method in the developing process include a method in which the photosensitive material is brought into contact with a heated block or plate, a method in which the photosensitive material is brought into contact with such an object as a hot plate, a hot presser, a heat roller, a heat drum, a halogen lamp heater and an infrared or a far infrared lamp heater, and a method in which the photosensitive material is passed through a heated atmosphere.

The heating process is preferably conducted at a temperature in the range of 60 to 100° C. for 5 to 60 seconds. If the temperature is lower than 60° C., it is difficult to obtain a desired level of image density, whereas if the temperature is higher than 100° C., the fogging becomes too high. Further, if the heating time is less than 5 seconds, it is difficult to obtain a desired level of image density, whereas if the heating time is more than 60 seconds, the fogging becomes too high.

Examples of the heating method in the developing process include a method in which the photosensitive material is brought into contact with a heated block or plate, a method in which the photosensitive material is brought into contact with such an object as a hot plate, a hot presser, a heat roller, a heat drum, a halogen lamp heater and an infrared or a far infrared lamp heater, and a method in which the photosensitive material is passed through a heated atmosphere.

For the purpose of processing the photosensitive material and/or the processing material of the present invention, any known apparatus for heat development can be used. Preferred examples of the apparatus include the apparatus described in JP-A Nos.59-75,247, 59-177,547, 59-181,353 and 60-18,951, JP-U No.62-25,944 and Japanese Patent Application Nos. 4-277,517, 4-243,072, 4-244,693, 6-164,421, 6-164,421 and 6-164,422.

In addition, commercially available apparatus such as "Pictrostat" 100, 200, 300, 330 and 50 and "Pictrography" 3000 and 2000, manufactured by Fuji Photo Film Co., Ltd. can be used in the present invention.

The photosensitive material and/or the processing material of the present invention may have an electroconductive heat generating layer as a heating means for the heat development. For example, a heat generating element described in JP-A No.61-145,544 can be used.

EXAMPLES

In order to better explain the present invention, the following examples are given by way of illustration and not by way of limitation.

Preparation of Chemically Modified Gelatin

Gelatin A 100 g of gelatin a having an average molecular weight of 1,000,000 which was deionized and treated with alkali was dissolved in 900 g of water and kept at 40° C. By repeating this procedure, three aqueous solutions were prepared, and these solutions were designated as A1, A2 and A3, respectively. These aqueous gelatin solutions were admixed with an aqueous solution of hydrogen peroxide to concentrations of 31, 310 and 3,100 ppm, respectively, and kept at 40° C. for 16 hours with stirring. After the hydrogen peroxide in the gelatin of each of the solutions was decomposed by means of catalase, the amino acid content was measured, and the methionine contents obtained are shown in Table 1.

TABLE 1

Contents per gram of gelatin (in μmol, other amino acid compositions are the same.)

| Gelatin | Methionine | Methionine sulfoxide | Methionine sulfone |
|---|---|---|---|
| α | 60 | 0 | 0 |
| A1 | 52 | 6 | 2 |
| A2 | 25 | 23 | 12 |
| A3 | 2 | 32 | 26 |

Gelatin B 100 g of gelatin a was dissolved in 900 g of water and was kept at 50° C. By repeating this procedure, three aqueous solutions were prepared, and these solutions were designated as B1, B2 and B3, respectively. The pH of these aqueous gelatin solutions was adjusted to 9.0 by the addition of sodium hydroxide. These aqueous gelatin solutions were then admixed with 3.8 g, 6.5 g and 8.4 g of acetic anhydride, respectively, and kept at 50° C. for 1 hour while keeping the pH in the range of 8.5 to 9.5 by the addition of sodium hydroxide with stirring. Then, the pH was adjusted to 5.0 by the addition of sulfuric acid. After the excess ions were removed by means of an ion-exchange resin, the —$NH_2$ groups and —NH— groups in the gelatin of each of the solutions were quantitatively measured by means of formol titration and amino acid analysis, and the results are shown in Table 2.

TABLE 2

Contents per gram of gelatin (in μmol, other amino acid compositions are the same.)

| Gelatin | —$NH_2$ group | —COOH group | —NH— group |
|---|---|---|---|
| α | 737 | 1188 | 2293 |
| B1 | 502 | 1179 | 2298 |
| B2 | 323 | 1182 | 2296 |
| B3 | 197 | 1185 | 2295 |

Gelatin C

The procedure for the preparation of Gelatin B was repeated, except that the acetic anhydride as used therein was replaced with 3.5 g, 6.0 g and 7.9 g, respectively, of phthalic anhydride. The resulting solutions were designated as C1, C2 and C3, respectively. The —$NH_2$ groups and —NH— groups in the gelatin of each of the solutions were quantitatively measured, and the results are shown in Table 3.

TABLE 3

Contents per gram of gelatin (in μmol, other amino acid compositions are the same.)

| Gelatin | —$NH_2$ group | —COOH group | —NH— group |
|---|---|---|---|
| α | 730 | 1182 | 2295 |
| C1 | 499 | 1314 | 2291 |
| C2 | 319 | 1593 | 2298 |
| C3 | 180 | 1734 | 2288 |

Gelatin D

The procedure for the preparation of Gelatin B was repeated, except that the acetic anhydride as used therein was replaced with 4.6 g, 8.1 g and 10.6 g, respectively, of trimellitic anhydride. The resulting solutions were designated as D1, D2 and D3, respectively. The —$NH_2$ groups and —NH— groups in the gelatin of each of the solutions were quantitatively measured, and the results are shown in Table 4.

TABLE 4

Contents per gram of gelatin (in μmol, other amino acid compositions are the same.)

| Gelatin | —$NH_2$ group | —COOH group |
|---|---|---|
| α | 732 | 1185 |
| D1 | 501 | 1701 |
| D2 | 323 | 2005 |
| D3 | 185 | 2285 |

Gelatin E 100 g of gelatin a was dissolved in 900 g of water and was kept at 50° C. By repeating this procedure, three aqueous solutions were prepared, and these solution were designated as E1, E2 and E3, respectively. The pH of these aqueous gelatin solutions was adjusted to 10.5 by the addition of sodium hydroxide. These aqueous gelatin solutions were admixed with 15.1 g, 19.6 g and 26.1 g of acetyl iodide, respectively, and kept at 50° C. for 1 hour while keeping the pH in the range of 10 to 11 by the addition of sodium hydroxide with stirring. Then, the pH was adjusted to 5.0 by the addition of sulfuric acid. After the excess ions were removed by means of an ion-exchange resin, the —NH— groups in the gelatin of each of the solutions were quantitatively measured by means of formol titration and amino acid analysis, and the results are shown in Table 5.

TABLE 5

Contents per gram of gelatin (in μmol, other amino acid compositions are the same.)

| Gelatin | —$NH_2$ group | —COOH group | —NH— group |
|---|---|---|---|
| α | 742 | 1181 | 2293 |
| E1 | 321 | 1607 | 1901 |
| E2 | 180 | 1743 | 1802 |
| E3 | 27 | 1896 | 1603 |

Gelatin F 100 g of gelatin α was dissolved in 900 g of water and was kept at 50° C. By repeating this procedure, three aqueous solutions were prepared, and these solution were designated as F1, F2 and F3, respectively. The pH of these aqueous gelatin solutions was adjusted to 9.0 by the addition of sodium hydroxide. These aqueous gelatin solutions were admixed with 3.0 g, 5.2 g and 6.8 g of o-sulfobenzoic anhydride, respectively, and kept at 50° C. for 2 hours while keeping the pH in the range of 8.5 to 9.0 by the addition of sodium hydroxide with stirring. Then, the pH was adjusted to 5.0 by the addition of sulfuric acid. After the excess ions were removed by means of an ion-exchange resin, the —$SO_3H$ groups in the gelatin of each of the solutions were quantitatively measured by means of amino acid analysis, and the results are shown in Table 6.

TABLE 6

| Contents per gram of gelatin (in μmol, other amino acid compositions are the same.) | | |
|---|---|---|
| Gelatin | —$NH_2$ group | —$SO_3$ group |
| α | 745 | 0 |
| F1 | 502 | 243 |
| F2 | 327 | 415 |
| F3 | 181 | 562 |

Gelatin G 100 g of gelatin a was dissolved in 900 g of water and was kept at 50° C. By repeating this procedure, three aqueous solutions were prepared, and these solution were designated as G1, G2 and G3, respectively. The pH of these aqueous gelatin solutions was adjusted to 9.0 by the addition of sodium hydroxide. These aqueous gelatin solutions were admixed with 7.4 g, 13.0 g and 17.1 g of sodium benzaldehyde-2,4-disulfonate, respectively, and kept at 50° C. for 10 hours while keeping the pH in the range of 8.5 to 9.0 by the addition of sodium hydroxide with stirring. Then, the pH was adjusted to 5.0 by the addition of sulfuric acid. After the excess ions were removed by means of an ion-exchange resin, the —$SO_3$ groups in the gelatin of each of the solutions were quantitatively measured by means of formol titration and amino acid analysis, and the results are shown in Table 7.

TABLE 7

| Per 1,000 residual amino groups (other amino acid compositions are the same.) | | |
|---|---|---|
| Gelatin | —$NH_2$ group | —$SO_3$ group |
| α | 748 | 0 |
| G1 | 496 | 308 |
| G2 | 336 | 822 |
| G3 | 192 | 1118 |

Preparation of Photosensitive Silver Halide Emulsions

Comparative Example 1

Preparation of Emulsion α-1

A mixture of 0.74 g of gelatin having an average molecular weight of 15,000, 0.7 g of potassium bromide, and 930 ml of distilled water was placed in a reaction vessel, and thereafter the temperature of the mixture was raised to 40° C. To this solution, which was vigorously stirred, there were added 30 ml of an aqueous solution (A) containing 1.2 g of silver nitrate and 30 ml of an aqueous solution (B) containing 0.82 g of potassium bromide over a period of 30 seconds. Upon completion of the addition, after the reaction solution was kept at 40° C. for 1 minute, the temperature was raised to 75° C. Next, 27 g of gelatin α containing no calcium ion and 200 ml of distilled water were added together to the reaction solution. After that, 100 ml of an aqueous solution (c) containing 22.5 g of silver nitrate and 80 ml of an aqueous solution (D) containing 15.43 g of potassium bromide were added to the reaction solution over a period of 11 minutes in such a manner that the flow rate of the addition was gradually increased. Further, 250 ml of an aqueous solution (E) containing 75.1 g of silver nitrate and an aqueous solution (F) containing potassium iodide and potassium bromide at a molar ratio of the former to the latter of 3:97 (having a potassium bromide concentration of 26%) were added to the reaction solution over a period of 20 minutes in such a manner that the flow rate of the addition was gradually increased and that the silver potential of the reaction solution was −20 mV with reference to a saturated calomel electrode. Furthermore, 75 ml of an aqueous solution (G) containing 18.7 g of silver nitrate and a 21.9% potassium bromide aqueous solution (H) were added to the reaction solution over a period of 3 minutes in such a manner that the silver potential of the reaction solution was 0 mV with reference to a saturated calomel electrode. After the completion of the addition, the temperature of the reaction solution was kept at 75° C. for 1 minute, and the temperature of the reaction solution was then lowered to 55° C. Then, 120 ml of an aqueous solution (I) containing 8.1 g of silver nitrate and 320 ml of an aqueous solution (J) containing 7.26 g of potassium iodide were added to the reaction solution over a period of 5 minutes. After the completion of the addition, 5.5 g of potassium bromide was added to the reaction solution, and the temperature of the reaction solution was kept at 55° C. for 1 minute. Then, 180 ml of an aqueous solution (K) containing 44.3 g of silver nitrate and 160 ml of an aqueous solution (L) containing 34.0 g of potassium bromide were added to the reaction solution over a period of 8 minutes. The temperature of the reaction solution was then lowered, and a desalting treatment and a dispersing treatment were performed by a standard method. In the dispersing treatment, 50 g of alkali-processed gelatin Y having a molecular weight of 100,000 which had not been deionized was added to the reaction solution. The gelatin Y had a calcium ion content of 4,520 ppm.

The emulsion obtained was made up of hexagonal tabular grains having an average grain size expressed in an equivalent-sphere diameter of about 0.66 μm. This emulsion was designated as emulsion α-1.

The spectral sensitization and the chemical sensitization of this emulsion were performed by the addition thereto of the following spectrally sensitizing dyes, compound I, potassium thiocyanate chloroauric acid, sodium thiosulfate and mono(pentafluorophenyl)diphenylphosphine selenide. The amounts of the spectral sensitizing dyes were such that the total amount of the following three dyes was $9.76\times10^{-4}$ mol/mol of silver. Further, pAg value and the amounts of the chemical sensitizers were adjusted so that the level of the chemical sensitization of the emulsion was optimized.

The green-sensitive emulsion prepared in the procedure described above was designated as emulsion α-1g.

Sensitizing dye I for green-sensitive emulsion

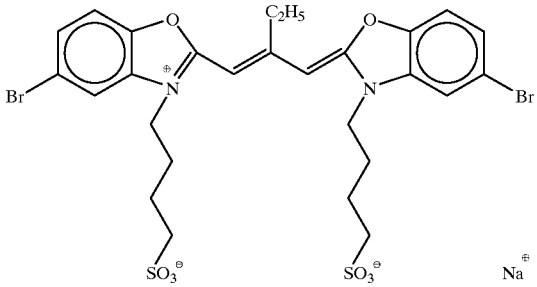

Sensitizing dye II for green-sensitive emulsion

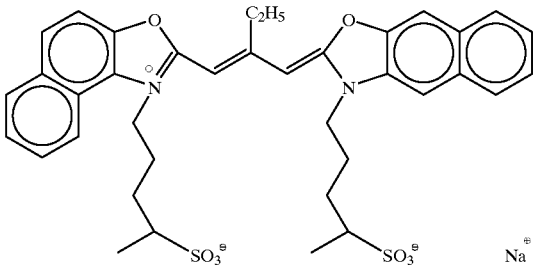

Sensitizing dye III for green-sensitive emulsion

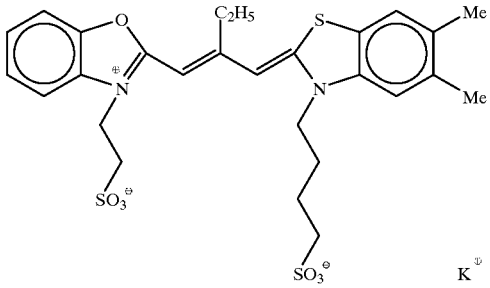

Compound I

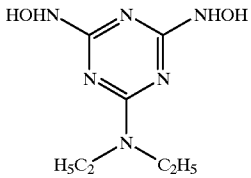

The sensitization for the emulsion α-1g described above was repeated, except that the spectral sensitizing dyes as used therein were replaced with the following dye, and the resulting blue-sensitive emulsion was designated as emulsion α-1b (the amount of the spectral sensitizing dye is $9.76\times10^{-4}$ mol/mol of silver).

Sensitizing dye IV for blue-sensitive emulsion

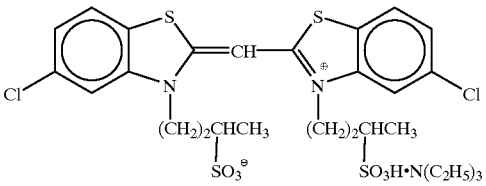

The sensitization for the emulsion α-1g described above was repeated, except that the spectral sensitizing dyes as used therein were replaced with the following dyes, and the resulting red-sensitive emulsion was designated as emulsion α-1r (the amount of the spectral sensitizing dyes is the same as in α-1g).

Sensitizing dye V for red-sensitive emulsion

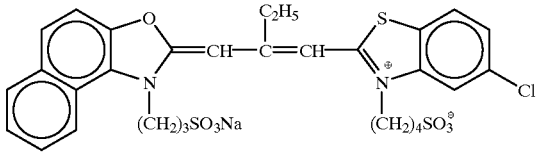

Sensitizing dye VI for red-sensitive emulsion

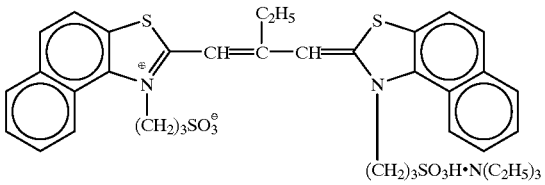

Sensitizing dye VII for red-sensitive emulsion

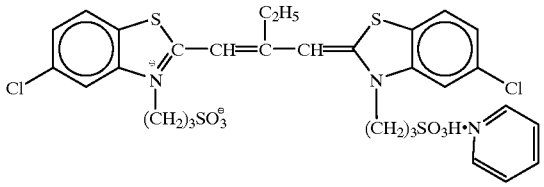

Preparation of Emulsion α-2

1,500 ml of distilled water containing 3.0 g of gelatin which had been deionized and lime-processed and 2.8 g of sodium chloride, was placed in a reaction vessel, and thereafter the temperature of the mixture was raised to 35° C. To this solution, which was vigorously stirred, there were added 80 ml of an aqueous solution (M) containing 12.5 g of silver nitrate and 80 ml of an aqueous solution (N) containing 4.5 g of sodium chloride over a period of 1 minute. After the completion of the addition, the reaction solution was kept at 35° C. for 1 minute. Then, 0.3 g of the compound (a) given below and 4.2 g of sodium chloride were added to the reaction solution, and the temperature was raised to 60° C. Next, 40 g of gelatin α, 0.08 g of the compound (a) given below and 360 ml of distilled water were added together to the reaction solution. After that, 1,000 ml of an aqueous solution (O) containing 157.3 g of silver nitrate and 1,000 ml of an aqueous solution (P) containing 57.5 g of sodium chloride were added to the reaction solution over a period of 40 minutes in such a manner that the flow rate of the addition was gradually increased. Then, 3 minutes before the completion of the addition of these solutions, 4.8 g of potassium bromide was added to the reaction solution. Further, 2 minutes after the completion of the addition of the solutions (O) and (P), 38 ml of a 1% potassium thiocyanate aqueous solution was added to the reaction solution. Furthermore, 2 minutes later, 540 mg of the spectral sensitizing dye given below was added to the reaction solution. Then, the temperature of the reaction solution was raised to 75° C. and thereafter the reaction solution was kept at that temperature for 5 minutes. The temperature of the reaction solution was then lowered to 40° C., and a desalting treatment and a dispersing treatment were performed by a standard method. In the dispersing treatment, 50 g of the above-mentioned gelatin Y was added to the reaction solution.

The emulsion obtained was made up of hexagonal tabular grains having an average grain size expressed in an equivalent-sphere diameter of about 0.67 μm. This emulsion was designated as emulsion α-2.

The spectral sensitization and the chemical sensitization of this emulsion were performed by the addition thereto of the following spectral sensitizing dyes, compound I, potassium thiocyanate, chloroauric acid, sodium thiosulfate and mono(pentafluorophenyl)diphenylphosphine selenide. The amounts of the spectral sensitizing dyes were such that the total amount of the dyes was $7.25\times10^{-4}$ mol/mol of silver. Further, pAg value and the amounts of the chemical sensitizers were adjusted so that the level of the chemical sensitization of the emulsion was optimized.

The green-sensitive emulsion prepared in the procedure described above was designated as emulsion α-2g.

Sensitizing dye I for green-sensitive emulsion

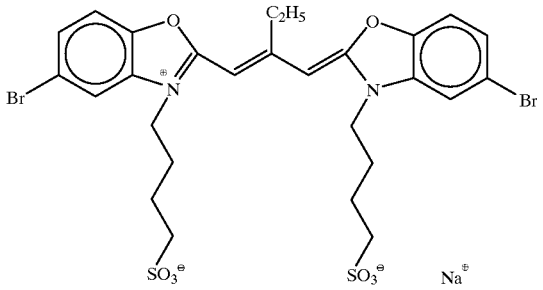

Sensitizing dye II for green-sensitive emulsion

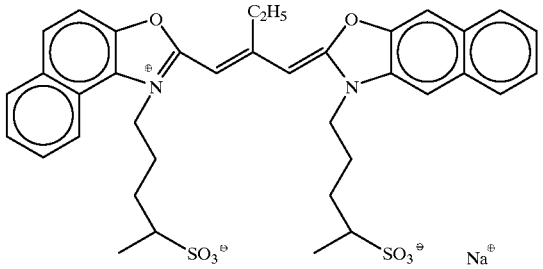

Sensitizing dye III for green-sensitive emulsion

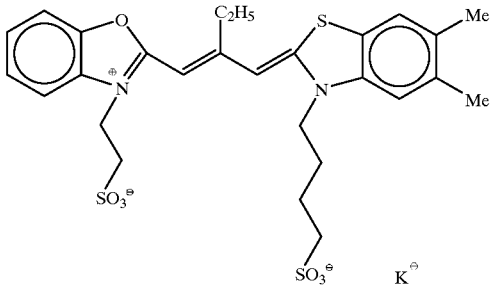

compound I

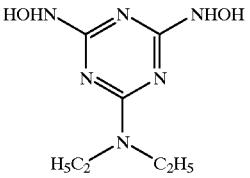

-continued compound (a)

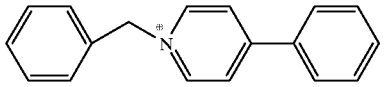

The sensitization for the emulsion α-2g described above was repeated, except that the spectral sensitizing dyes as used therein were replaced with the following dye, and the resulting blue-sensitive emulsion was designated as emulsion α-2b (the amount of the spectral sensitizing dye is $7.25\times10^{-4}$ mol/mol of silver).

Sensitizing dye IV for blue-sensitive emulsion

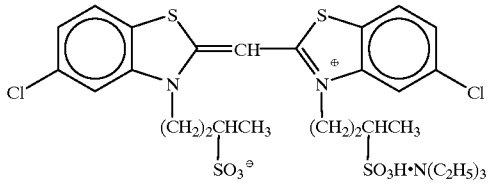

The sensitization for the emulsion α-2g described above was repeated, except that the spectral sensitizing dyes as used therein were replaced with the following dyes, and the resulting red-sensitive emulsion was designated as emulsion α-2r (the amount of the spectral sensitizing dyes is the same as in α-2g).

Sensitizing dye V for red-sensitive emulsion

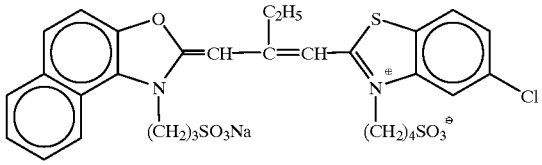

Sensitizing dye VI for red-sensitive emulsion

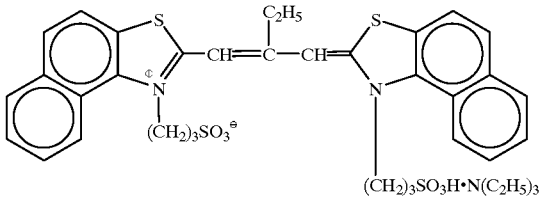

Sensitizing dye VII for red-sensitive emulsion

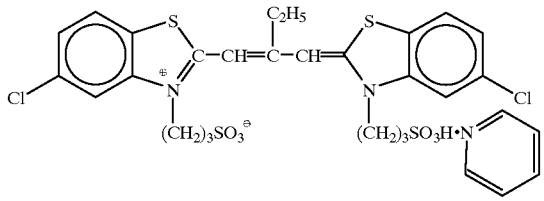

Preparation of Emulsion α-3

1,000 ml of distilled water containing 21.2 g of gelatin having an average molecular weight of 15,000, 0.85 g of sodium chloride and 3.8 ml of sulfuric acid (1N) was placed in a reaction vessel, and thereafter the temperature of the mixture was raised to 40° C. To this solution, which was vigorously stirred, there were added 30 ml of an aqueous solution (Q) containing 6.1 g of silver nitrate and 30 ml of an aqueous solution (R) containing 2.00 g of sodium chloride and 0.21 of potassium bromide over a period of 45 seconds. Further, 40 ml of an aqueous solution (S) containing 0.55 g of potassium bromide was added. Furthermore, 100 ml of an aqueous solution (T) containing 18.3 g of silver nitrate and 100 ml of an aqueous solution (U) containing 6.30 g of sodium chloride were added to the reaction solution over a period of 3 minutes. Then, 6.0 ml of sodium hydroxide aqueous solution (1N) was added to the reaction solution, and the temperature of the solution was raised to 75° C. Next, 10.0 g of gelatin α and 100 ml of distilled water were added together to the reaction solution. After that, 750 ml of an aqueous solution (V) containing 145.4 g of silver nitrate and a 7.0% sodium chloride aqueous solution (W) were added to the reaction solution over a period of 45 minutes in such a manner that the flow rate of the addition was gradually increased and that the silver potential of the reaction solution was 120 mV with reference to a saturated calomel electrode. The temperature of the reaction solution was then lowered, and a desalting treatment and a dispersing treatment were performed by a standard method. In the dispersing treatment, 50 g of the above-mentioned gelatin Y was added to the reaction solution.

The emulsion obtained had a silver bromide content of 0.64% and was made up of rectangular tabular silver chlorobromide grains with a projected area having an average length to breadth ratio of 1:1.25 and having an average grain size expressed in an equivalent-sphere diameter of about 0.69 μm. This emulsion was designated as emulsion α-3.

The spectral sensitization and the chemical sensitization of this emulsion were performed by the addition thereto of the following spectrally sensitizing dyes, compound I, potassium thiocyanate, chloroauric acid, sodium thiosulfate and mono(pentafluorophenyl)diphenylphosphine selenide. The amounts of the spectral sensitizing dyes were such that the total amount of the following three dyes was $6.95\times10^{-4}$ mol/mol of silver. Further, the pAg value and the amounts of the chemical sensitizers were adjusted so that the level of the chemical sensitization of the emulsion was optimized.

The green-sensitive emulsion prepared in the procedure described above was designated as emulsion α-3g.

Sensitizing dye I for green-sensitive emulsion

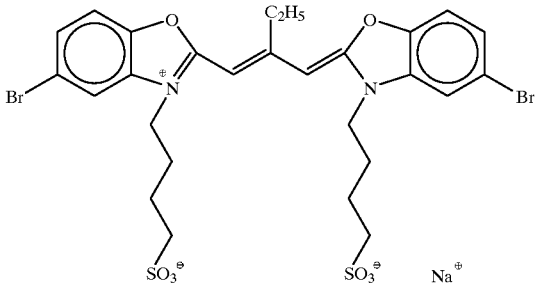

-continued

Sensitizing dye II for green-sensitive emulsion

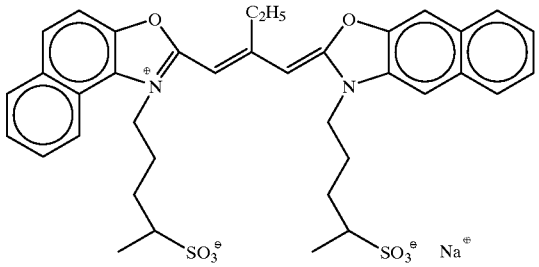

Sensitizing dye III for green-sensitive emulsion

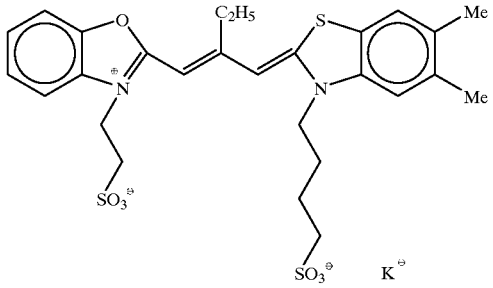

Compound I

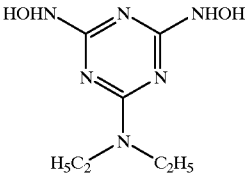

The sensitization for the emulsion α-3g described above was repeated, except that the spectral sensitizing dyes as used therein were replaced with the following dye, and the resulting blue-sensitive emulsion was designated as emulsion α-3b (the amount of the spectral sensitizing dye is $6.95\times10^{-4}$ mol/mol of silver).

Sensitizing dye IV for blue-sensitive emulsion

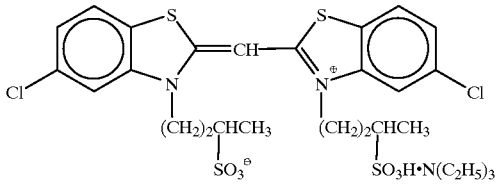

The sensitization for the emulsion α-3g described above was repeated, except that the spectral sensitizing dyes as used therein were replaced with the following dyes, and the resulting red-sensitive emulsion was designated as emulsion α-3r (the amount of the spectral sensitizing dyes is the same as in α-2g).

Sensitizing Dye V for Red-sensitive Emulsion

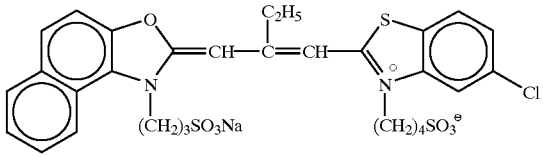

Sensitizing dye VI for red-sensitive emulsion

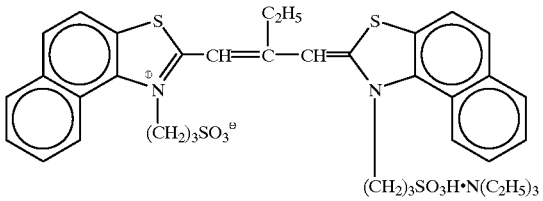

Sensitizing dye VII for red-sensitive emulsion

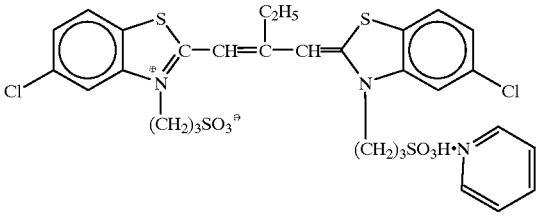

Next, a dispersion of zinc hydroxide serving as a base precursor was prepared.

A mixture, which comprised 31 g of zinc hydroxide powder having an average diameter of primary particles of 0.2 $\mu$m, 1.6 g of carboxymethylcellulose and 0.4 g of sodium polyacrylate as dispersants, 8.5 g of lime-processed ossein gelatin and 158.5 ml of water, was dispersed for one hour by means of a mill with glass beads. After filtering off the glass beads from the mixture, 188 g of a dispersion of zinc hydroxide was obtained.

Next, an emulsified dispersion of a magenta dye-forming coupler was prepared in the following way.

A mixture, which comprised 7.80 g of magenta dye forming coupler (a), 5.45 g of a developing agent (b), 2 mg of an anti-fogging agent (c), 8.21 g of an organic solvent having a high boiling point (d) and 24.0 ml of ethyl acetate, was made into a solution at 60° C. The solution was blended into 150 g of an aqueous solution comprising 12 g of a lime-processed gelatin and 0.6 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant emulsion was mixed at 2,000 revolutions per minute for 10 minutes.

Magenta dye-forming coupler (a)

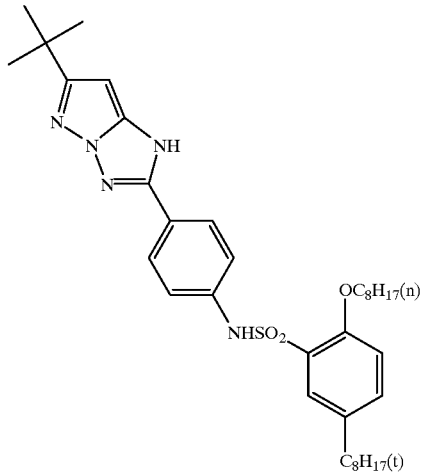

Developing agent (b)

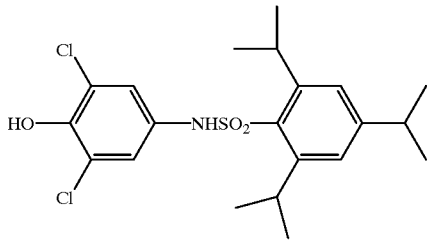

Anti-fogging agent (c)

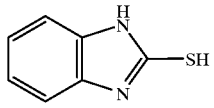

Organic solvent having a high boiling point (d)

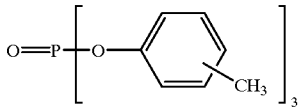

Next, an emulsified dispersion of a yellow dye-forming coupler and an emulsified dispersion of a cyan dye-forming coupler were prepared respectively by using a yellow dye-forming coupler (u), a developing agent (v) and an antifogging agent (w) and by using a cyan dye-forming coupler (aa), a developing agent (b) and an antifogging agent (c), all of which are given below.

Yellow dye-forming coupler (u)

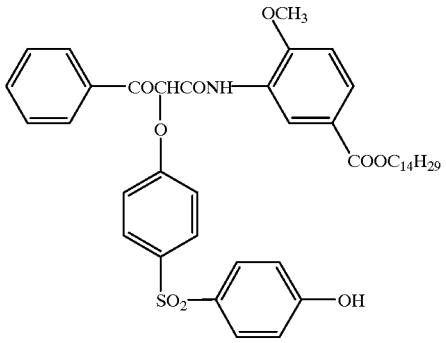

Anti-fogging agent (w)

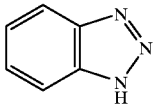

Developing agent (v)

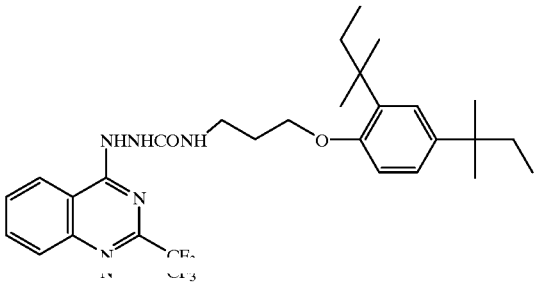

Cyan dye-forming coupler (aa)

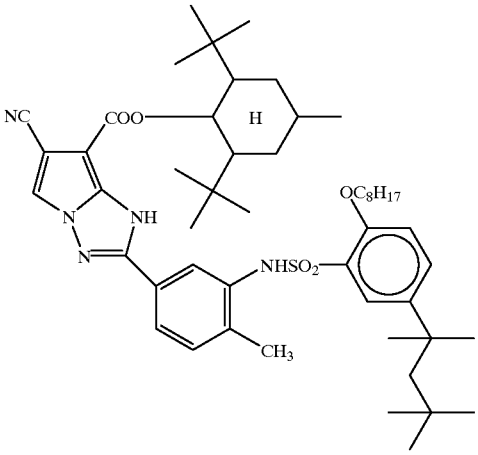

Developing agent (b)

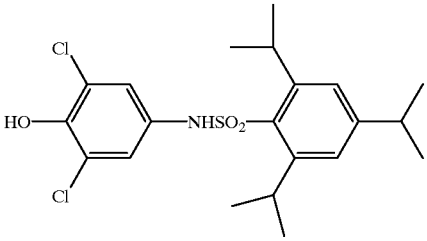

-continued

Anti-fogging agent (c)

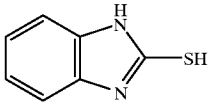

These emulsified dispersions and the emulsions prepared previously were combined and were admixed with ingredients as shown in Table 8 given below, and the resulting compositions were each coated on a support. Sample 101 as a heat-developing photosensitive material was prepared by employing the emulsion α-1g as an emulsion corresponding to the emulsion X and the magenta dye-forming coupler emulsified dispersion as the emulsified dispersion of coupler of Table 8. Similar procedures were carried out to prepare the following samples: from the emulsified dispersion of a magenta dye-forming coupler and the emulsion α-2g (Sample 201), from the same dispersion and the emulsion α-3g (Sample 301); from the emulsified dispersion of a yellow dye-forming coupler and the emulsion α-1b (Sample 401), from the same dispersion and the emulsion α-2b (Sample 501) and from the same dispersion and the emulsion α-3b (Sample 601); and from the emulsified dispersion of a cyan dye-forming coupler and the emulsion α-1r (Sample 701), from the same dispersion and the emulsion α-2r (Sample 801) and from the same dispersion and the emulsion α-3r (Sample 901). The calcium ion contents of the emulsion layers were in the range of 4,100 to 4,500 ppm based on the weight of gelatin.

TABLE 8

| | | ($mg/m^2$) |
|---|---|---|
| Protective layer | Lime-processed gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | |
| Intermediate layer | Lime-processed gelatin | 375 |
| | Surfactant (g) | 15 |
| | Zinc hydroxide | 1100 |
| | Water-soluble polymer (h) | 15 |
| Emulsion layer | Lime-processed gelatin | 2000 |
| | Emulsion X | 1726 |
| | (based on the amount of silver coated) | |
| | Emulsified dispersion of a coupler | 637 |
| | Developing agent (b) or (v) | 444 |
| | Anti-fogging agent (c) or (w) | 0.20 |
| | Organic solvent having a high boiling point (d) | 670 |
| | Surfactant (e) | 33 |
| | Water-soluble polymer (h) | 14 |
| | Transparent PET support (120 μm) | |

Surfactant (f)

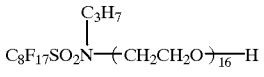

Surfactant (g)

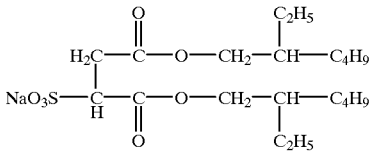

-continued

Water soluble polymer (h)

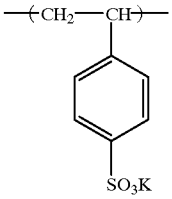

Hardener (i)

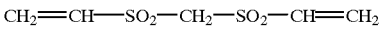

Surfactant (e)

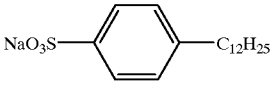

In addition, a processing material P-1 as shown in Table 9 and 10 was prepared.

TABLE 9

Composition of the processing material P-1

| Constituent layer | Added substance | Amount added (mg/m$^2$) |
|---|---|---|
| 4th layer Protective layer | Acid-processed gelatin | 220 |
| | Water-soluble polymer (1) | 60 |
| | Water-soluble polymer (k) | 200 |
| | Additive (l) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer Intermediate layer | Lime-processed gelatin | 240 |
| | Water-soluble polymer (k) | 24 |
| | Hardener (p) | 180 |
| | Surfactant (e) | 9 |
| 2nd layer Base generating layer | Lime-processed gelatin | 2400 |
| | Water-soluble polymer (k) | 360 |
| | Water-soluble polymer (q) | 700 |
| | Water-soluble polymer (r) | 600 |
| | Solvent having a high boiling point (s) | 2000 |
| | Additive (t) | 20 |
| | Potassium hydantoin | 260 |
| | Guanidine picolinate | 2910 |
| | Potassium quinolinate | 225 |
| | Sodium quinolinate | 180 |
| | Surfactant (e) | 24 |
| 1st layer Primer layer | Lime-processed gelatin | 280 |
| | Water-soluble polymer (j) | 12 |
| | Surfactant (g) | 14 |
| | Hardener (p) | 185 |
| | Transparent support A (63 μm) | |

TABLE 10

Composition of the support A

| Name of layer | Composition | Weight (mg/m$^2$) |
|---|---|---|
| Subbing layer on the front side | Gelatin | 100 |
| Polymer layer | Polyethylene terephthalate | 62500 |

TABLE 10-continued

Composition of the support A

| Name of layer | Composition | Weight (mg/m$^2$) |
|---|---|---|
| Subbing layer on the reverse side | Methyl methacrylate/2-ethylhexyl acrylate/methacrylic acid copolymer | 1000 |
| | PMMA latex (average particle diameter: 12 μm) | 120 |
| | | 63720 |

Water-soluble polymer (j): K-carrageenan;

Water-soluble polymer (k): Sumikagel L-5H (manufactured by Sumitomo Chemical Co., Ltd.);

Additive (l);

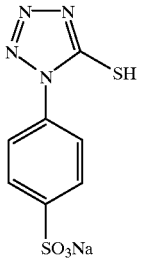

Matting Agent (m): SYLOID 79 (manufactured by Fuji-Davison Chemical Co., Ltd.);

Surfactant (n);

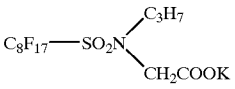

Surfactant (o);

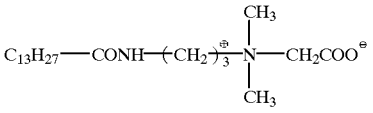

Hardener (p);

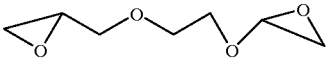

Water-soluble polymer (q): Dextran (molecular weight: 70,000);

Water-soluble polymer (r): MP Polymer MP 102 (manufactured by Kuraray Co., Ltd.);

Organic solvent having a high boiling point (s): Chlorinated Paraffin 40 (from Ajinomoto Co., Ltd.);

Additive (t)

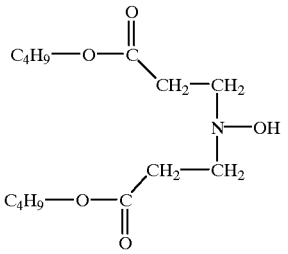

These photosensitive materials were exposed to light of 1,000 lux for 1/100 second through an optical wedge and a blue filter (for Samples 401, 501 and 601), a green filter (for Samples 101, 201 and 301) or a red filter (for Samples 701, 801 and 901).

After the exposure, a heat development was carried out by the procedure comprising supplying 15 ml/m$^2$ of warm water at 40° C. to the photosensitive layer of the photosensitive material, putting together the photosensitive material and the processing layer of a processing material so that the layers faced each other and thereafter heating the materials to 83° C. for 15 seconds by use of a heat drum. Then, removing the photosensitive material and a magenta-colored wedged image (for Samples 101, 201 and 301), a yellow-colored wedged image (for Samples 401, 501 and 601), and cyan-colored wedged image (for Samples 701, 801 and 901) were obtained.

Next, the sensitivity and the RMS granularity of the samples were evaluated in the following way. The colored samples were subjected to the transmission density measurement to obtain the so-called characteristic curve. The sensitivity was expressed as the reciprocal of an exposing light amount at a density 0.15 higher than fogging density. Sensitivities of Samples 102 to 122 were indicated in relative values by taking the sensitivity of the sample 101 as 100. Meanwhile, the samples were exposed in such a manner that the density of the formed magenta color was 1.0, and the similar heat development was then carried out to produce colored samples, whose RMS granularity levels were measured through an aperture having a diameter of 48 $\mu$m by use of a diffused light source. The results obtained were compared with the results obtained in the following examples. The RMS granularity obtained is the square root of a double average of the deviation in density observed in the micro-density measured through an aperture having a diameter of 48 $\mu$m, and is given by the following equation.

$$RMS = \sqrt{\sum_{i=1}^{N} \frac{(D_i - \overline{D})^2}{N-1}}$$

Example 1

Emulsions were prepared by replacing the gelatin α at while preparing the emulsion 1 to 3 in Comparative Example 1 with gelatin A1 to G3. In Tables 11, 12 and 13, the emulsions, which were prepared by replacing the gelatin A1 to G3 in order to confirm the effect of the present invention, were designated as A-1~A-21, B-1~B-21 and C-1~C-21, and aspect ratios which were obtained by dividing an average grain diameter by an average grain thickness for each of the emulsions were shown. The average grain sizes expressed as equivalent-sphere diameters and grain shapes of all of the emulsions were approximately the same as those of the grains of the emulsion of Comparative Example 1.

TABLE 11

Aspect ratios of grains of the emulsions prepared from various kinds of modified gelatin

| Name of emulsion | Gelatin employed | Aspect ratio |
|---|---|---|
| α-1 | α (Unmodified) | 6.0 |
| A-1 | A1 | 8.5 |
| A-2 | A2 | 10.2 |
| A-3 | A3 | 11.4 |
| A-4 | B1 | 8.2 |
| A-5 | B2 | 8.6 |
| A-6 | B3 | 9.4 |
| A-7 | C1 | 8.2 |
| A-8 | C2 | 8.8 |
| A-9 | C3 | 9.7 |
| A-10 | D1 | 8.5 |
| A-11 | D2 | 9.0 |
| A-12 | D3 | 10.0 |
| A-13 | E1 | 8.6 |
| A-14 | E2 | 10.5 |
| A-15 | E3 | 11.6 |
| A-16 | F1 | 8.5 |
| A-17 | F2 | 10.4 |
| A-18 | F3 | 12.2 |
| A-19 | G1 | 9.0 |
| A-20 | G2 | 10.6 |
| A-21 | G3 | 12.5 |

TABLE 12

Aspect ratios of grains of the emulsions prepared from various kinds of modified gelatin

| Name of emulsion | Gelatin employed | Aspect ratio |
|---|---|---|
| α-2 | α (Unmodified) | 6.5 |
| B-1 | A1 | 8.8 |
| B-2 | A2 | 9.6 |
| B-3 | A3 | 11.2 |
| B-4 | B1 | 8.6 |
| B-5 | B2 | 8.9 |
| B-6 | B3 | 10.2 |
| B-7 | C1 | 8.9 |
| B-8 | C2 | 9.2 |
| B-9 | C3 | 11.2 |
| B-10 | D1 | 9.1 |
| B-11 | D2 | 9.6 |
| B-12 | D3 | 11.6 |
| B-13 | E1 | 9.3 |
| B-14 | E2 | 9.6 |
| B-15 | E3 | 12.0 |
| B-16 | F1 | 9.0 |
| B-17 | F2 | 9.7 |
| B-18 | F3 | 11.8 |
| B-19 | G1 | 9.2 |
| B-20 | G2 | 9.9 |
| B-21 | G3 | 12.5 |

TABLE 13

Aspect ratios of grains of the emulsions prepared from various kinds of modified gelatin

| Name of emulsion | Gelatin employed | Aspect ratio |
|---|---|---|
| α-3 | α (Unmodified) | 7.1 |
| C-1 | A1 | 9.5 |
| C-2 | A2 | 12.0 |
| C-3 | A3 | 14.5 |
| C-4 | B1 | 9.2 |

TABLE 13-continued

| Aspect ratios of grains of the emulsions prepared from various kinds of modified gelatin | | |
|---|---|---|
| Name of emulsion | Gelatin employed | Aspect ratio |
| C-5 | B2 | 9.9 |
| C-6 | B3 | 12.2 |
| C-7 | C1 | 9.3 |
| C-8 | C2 | 10.2 |
| C-9 | C3 | 11.2 |
| C-10 | D1 | 9.5 |
| C-11 | D2 | 12.6 |
| C-12 | D3 | 14.8 |
| C-13 | E1 | 9.7 |
| C-14 | E2 | 13.0 |
| C-15 | E3 | 15.5 |
| C-16 | F1 | 9.9 |
| C-17 | F2 | 12.5 |
| C-18 | F3 | 14.8 |
| C-19 | G1 | 10.0 |
| C-20 | G2 | 13.0 |
| C-21 | G3 | 15.2 |

The spectral sensitization and the chemical sensitization of these emulsions were performed in the exactly same way as in Comparative Example 1. The pAg values and the amounts of the chemical sensitizers were adjusted so that the levels of the chemical sensitization of the emulsions were optimized (The amount of the spectral sensitizing dye used was altered from that in Comparative Example 1 in proportion to the surface area of the silver halide grains).

The emulsions thus obtained were as follows: green-sensitive emulsions A-1g to A-21g derived from the emulsion α-1, blue-sensitive emulsions A-1b to A-21b derived from the emulsion α-1 and red-sensitive emulsions A-1r to A-21r derived from the emulsion α-1; green-sensitive emulsions B-1g to B-21g derived from the emulsion α-2, blue-sensitive emulsions B-1b to B-21b derived from the emulsion α-2 and red-sensitive emulsions B-1r to B-21r derived from the emulsion α-2; and green-sensitive emulsions C-1g to C-21g derived from the emulsion α-3, blue-sensitive emulsions C-1b to C-21b derived from the emulsion α-3 and red-sensitive emulsions C-1r to C-21r derived from the emulsion α-3.

As in Comparative Example 1, the emulsified dispersions and the emulsions prepared above were combined and were admixed with ingredients as shown in Table 8, and the resulting compositions were each coated on a support. Samples 102 to 122 were prepared by employing the emulsions A-1g to A-21g as emulsions corresponding to the emulsion X and the dispersion of the magenta dye-forming coupler as the emulsified dispersion of coupler of Table 8. Similar procedures were carried out to prepare the following samples: from the emulsified dispersion of a magenta dye-forming coupler and the emulsions B-1g to B-21g (Samples 202 to 222), from the same emulsified dispersion and the emulsions C-1g to C-21g (Samples 302 to 322); from the emulsified dispersion of a yellow dye-forming coupler and the emulsions A-1b to A-21b (Samples 402 to 422), from the same emulsified dispersion and the emulsion B-1b to B-21b (Samples 502 to 522) and from the same emulsified dispersion and the emulsions C-1b to C-21b (Samples 602 to 622); and from the emulsified dispersion of a cyan dye-forming coupler and the emulsions A-1r to A-21r (Samples 702 to 722), from the same emulsified dispersion and the emulsions B-1r to B-21r (Samples 802 to 822) and from the same emulsified dispersion and the emulsion C-1r to C-21r (Samples 902 to 922).

These photosensitive materials were exposed to light of 1,000 lux for 1/100 second through an optical wedge and a blue filter (for Samples 402~422, 502~522 and 602~622), a green filter (for Samples 102~122, 202~222 and 302~322) or a red filter (for Samples 702~722, 802~822 and 902~922).

Spotted color unevenness in color was found in samples prepared by using gelatin A1~A3, E1~E3, F1~F3 and G1~G3, but no spotted color unevenness was found in samples prepared by using gelatin B1~B3, C1~C3, and D1~D3.

Then, as in Comparative Example 1, the sensitivity and the RMS granularity of the samples were examined. The results of Samples 102~122 are shown as representative data in Table 14.

TABLE 14

| | Name of sample | Gelatin employed | Relative sensitivity | RMS granularity | Spotted color unevenness* | Image quality on photosensitive printing material |
|---|---|---|---|---|---|---|
| Comparative Example | 101 | α (Unmodified) | 100 | 0.036 | ○ | x |
| Present invention | 102 | A1 | 101 | 0.030 | Δ | Δ |
| Present invention | 103 | A2 | 98 | 0.029 | Δ | Δ |
| Present invention | 104 | A3 | 100 | 0.028 | Δ | Δ |
| Present invention | 105 | B1 | 102 | 0.024 | ○ | ○ |
| Present invention | 106 | B2 | 101 | 0.024 | ○ | ○ |
| Present invention | 107 | B3 | 98 | 0.025 | ○ | ○ |
| Present invention | 108 | C1 | 103 | 0.024 | ○ | ○ |
| Present invention | 109 | C2 | 99 | 0.023 | ○ | ○ |
| Present invention | 110 | C3 | 101 | 0.023 | ○ | ○ |
| Present invention | 111 | D1 | 102 | 0.020 | ○ | ◎ |
| Present invention | 112 | D2 | 99 | 0.019 | ○ | ◎ |
| Present invention | 113 | D3 | 101 | 0.018 | ○ | ◎ |
| Present invention | 114 | E1 | 101 | 0.031 | Δ | Δ |
| Present invention | 115 | E2 | 102 | 0.030 | Δ | Δ |
| Present invention | 116 | E3 | 103 | 0.029 | Δ | Δ |
| Present invention | 117 | F1 | 99 | 0.029 | Δ | Δ |
| Present invention | 118 | F2 | 103 | 0.031 | Δ | Δ |
| Present invention | 119 | F3 | 102 | 0.028 | Δ | Δ |
| Present invention | 120 | G1 | 99 | 0.029 | Δ | Δ |

TABLE 14-continued

| | Name of sample | Gelatin employed | Relative sensitivity | RMS granularity | Spotted color unevenness* | Image quality on photosensitive printing material |
|---|---|---|---|---|---|---|
| Present invention | 121 | G2 | 102 | 0.027 | Δ | Δ |
| Present invention | 122 | G3 | 100 | 0.028 | Δ | Δ |

*Criterion for the evaluation of spotted color unevenness is as follows:
○: No spotted color unevenness found
Δ: A few spotted color unevenness was found From Table 14, it can be seen that the RMS granularity of the examples of the present invention are smaller (improved) relative to Comparative Example 1. The RMS granularity values of the samples prepared by using gelatin B1~B3, C1~C3, and D1~D3, none of which produced spotted color unevenness. In particular, the RMS granularity of the samples prepared from gelatin D1~D3, which were each trimellitated, was remarkably improved.

The image information of these samples was read out by an image scanner, digitized, and printed on a photosensitive printing material. The quality of images obtained was evaluated, and the results are shown in Table 14. Criterion for the evaluation is as follows:

◎: granularity is very good and the print quality is excellent;

○: granularity is good and the print quality is good;

Δ: the print quality is acceptable;

X: granularity is coarse and the print quality is not acceptable.

From these results, it can be seen that Samples 102~104 and 113~122, despite spotted color unevenness produced in photographing materials, resulted in improved image quality after being read out by an image scanner and digitized. Samples 104~110 resulted in better image quality, and Samples 111~113 resulted in the best image quality.

Similar results were confirmed with Samples 202~222, 302~322, 402~422, 502~522, 602~622, 702~722, 802~822 and 902~922.

Example 2

Samples were prepared by repeating the procedure of Example 1, except that the alkali-processed gelatin Y having a calcium ion content of 4,520 ppm as used in the dispersing stage therein was replaced with the alkali-processed gelatin Z having a calcium ion content of 4,012 ppm. In these samples, the calcium ion content in the emulsion layer ranged from 3,800 to 3,900 ppm based on the weight of gelatin.

Contrary to Example 1, no spotted color unevenness was found in any of the samples prepared. Then, as in Example 1, sensitivity and RMS granularity of the samples were examined. The results are shown in Table 15.

TABLE 15

| | Name of sample | Gelatin employed | Relative sensitivity | RMS granularity |
|---|---|---|---|---|
| Comparative example | 101 | α (Unmodified) | 100 | 0.036 |
| Present invention | 102 | A1 | 101 | 0.022 |
| Present invention | 103 | A2 | 98 | 0.020 |
| Present invention | 104 | A3 | 100 | 0.018 |
| Present invention | 105 | B1 | 102 | 0.020 |

TABLE 15-continued

| | Name of sample | Gelatin employed | Relative sensitivity | RMS granularity |
|---|---|---|---|---|
| Present invention | 106 | B2 | 101 | 0.023 |
| Present invention | 107 | B3 | 98 | 0.023 |
| Present invention | 108 | C1 | 103 | 0.023 |
| Present invention | 109 | C2 | 99 | 0.021 |
| Present invention | 110 | C3 | 101 | 0.020 |
| Present invention | 111 | D1 | 102 | 0.021 |
| Present invention | 112 | D2 | 99 | 0.019 |
| Present invention | 113 | D3 | 101 | 0.017 |
| Present invention | 114 | E1 | 101 | 0.021 |
| Present invention | 115 | E2 | 102 | 0.019 |
| Present invention | 116 | E3 | 103 | 0.018 |
| Present invention | 117 | F1 | 99 | 0.022 |
| Present invention | 118 | F2 | 103 | 0.020 |
| Present invention | 119 | F3 | 102 | 0.019 |
| Present invention | 120 | G1 | 99 | 0.020 |
| Present invention | 121 | G2 | 102 | 0.018 |
| Present invention | 122 | G3 | 100 | 0.017 |

From Table 15, it can be seen that all of the samples prepared from chemically modified gelatin are superior to the samples prepared from original gelatin α in RMS granularity. Accordingly, the use of gelatin having a low calcium ion content makes it possible to prevent the generation of spotted color unevenness of an emulsion composed of grains having a high aspect ratio prepared by using chemically modified gelatin and to prepare a photosensitive material having a very good RMS granularity.

Similar results were confirmed with Samples 202~222, 302~322, 402~422, 502~522, 602~622, 702~722, 802~822 and 902~922 of Example 1. Accordingly, the replacement of gelatin Y with gelatin Z in the samples was found to prevent the formation of spotted unevenness and to provide an RMS granularity better than that of 201, 301, 401, 501, 601, 701, 801 and 901, respectively.

Example 3

The Effect of the Present Invention in Various Equivalent-sphere Diameters

The procedure for the preparation of the silver halide emulsion employed in Example 1 was repeated, except that the amount of silver in the formation of a nucleus, the rate of the addition of the reaction solutions and the potential when the grains were grown were altered. In this case, for use as gelatin X, trimellitated gelatin D4 having 36.6 μmol of residual amino group per gram of gelatin (degree of chemical modification of about 95.0%) was prepared as in "the preparation of chemically modified gelatin", but the amount of trimellitic anhydride was increased to an amount larger than that for gelatin D. By using this gelatin D4 and the gelatin A3 described in "the preparation of chemically modified gelatin", silver iodobromide emulsions, which were composed of high-aspect-ratio (111) grains having various equivalent-sphere diameters, various aspect ratios and grain thicknesses smaller than those of Example 1, were prepared as shown in Table 16. In addition, emulsions by use of unmodified gelatin α were prepared in a similar way, and these emulsion are also shown in Table 16.

TABLE 16

| Gelatin | Equivalent-sphere diameter [μm] | Aspect ratio | Thickness [μm] |
|---|---|---|---|
| α | 0.83 | 7.8 | 0.184 |
| D4 | 0.84 | 23.7 | 0.088 |
| α | 0.66 | 6.0 | 0.174 |
| D4 | 0.67 | 16.7 | 0.087 |
| α | 0.59 | 6.1 | 0.153 |
| D4 | 0.58 | 13.3 | 0.090 |
| α | 0.46 | 5.1 | 0.137 |
| D4 | 0.45 | 9.3 | 0.089 |
| α | 0.39 | 4.0 | 0.135 |
| D4 | 0.38 | 7.4 | 0.087 |

Then, sensitivity and RMS granularity of the samples were examined by using Comparative Example 1 and Example 1 as reference. The RMS granularity (which was evaluated by the same method as in Comparative Example 1) and the comparative sensitivity obtained by taking the sensitivity of the unmodified gelatin as 100 are shown in Table 17 for representative emulsions, i.e., the emulsions composed of grains having equivalent-sphere diameters in the range of 0.83 to 0.84 μm and the emulsions composed of grains having equivalent-sphere diameters in the range of 0.65 to 0.67 μm. From the results of Table 17, it is apparent that the RMS granularity of the samples of Example 3 are further improved in comparison with those of Example 2.

TABLE 17

| Gelatin | Equivalent-sphere diameter [μm] | Relative sensitivity | RMS granularity |
|---|---|---|---|
| α | 0.83 | 100 | 0.045 |
| D4 | 0.84 | 101 | 0.022 |
| α | 0.66 | 100 | 0.036 |
| D4 | 0.67 | 102 | 0.012 |
| D1 (Example 2) | 0.66 | 102 | 0.021 |
| D2 (Example 2) | 0.66 | 99 | 0.019 |
| D3 (Example 2) | 0.66 | 101 | 0.017 |

Further, the procedure for the preparation of emulsions described previously was repeated, except that the gelatin D as used therein was replaced with gelatin A, C, E, F and G, respectively, and the potential when the grains were grown was altered, in order to prepare emulsions composed of tabular grains having equivalent-sphere diameters, aspect ratios and thicknesses similar to those of the emulsions from the trimellitated gelatin as shown in Table 15. These emulsions were subjected to the same test, and similar results were obtained. Accordingly, it was confirmed that the effect of the present invention was obtained with emulsions composed of grains having various equivalent-sphere diameters.

Example 4 and Comparative Example 2

Photosensitive materials for heat development having a multilayered structure as shown in Tables 18 to 21 were prepared by using the silver halide emulsions and the emulsified dispersions of the dye forming-couplers prepared in Example 1 together with a colorant dispersion prepared by combining the following yellow coloring leuco dye (X), magenta coloring leuco dye (Z) and leuco dye (ab) with a complex of zinc. The blue-sensitive emulsions A, B and C, green-sensitive emulsions A, B and C as well as red-sensitive emulsions A, B and C are described later.

TABLE 18

Structure of photosensitive materials for heat development

| | | (mg/m$^2$) |
|---|---|---|
| Protective layer | Lime-processed gelatin | 1000 |
| | Matting agent (silica) | 50 |
| | Surfactant (f) | 100 |
| | Surfactant (g) | 300 |
| | Water-soluble polymer (h) | 15 |
| | Hardener (i) | 98 |
| Intermediate layer | Lime-processed gelatin | 375 |
| | Surfactant (g) | 15 |
| | Zinc hydroxide | 1100 |
| | Water-soluble polymer (h) | 15 |
| Yellow color-forming layer | Lime-processed gelatin | 2000 |
| | Blue-sensitive emulsion A (based on the weight of silver coated) | 647 |
| | Yellow dye-forming coupler (u) | 57 |
| | Developing agent (v) | 41 |
| | Anti-fogging agent (w) | 4 |
| | Organic solvent having a high boiling point (d) | 50 |
| | Surfactant (e) | 3 |
| | Water-soluble polymer (h) | 1 |
| Yellow color-forming layer | Lime-processed gelatin | 220 |
| | Blue-sensitive emulsion B (based on the weight of silver coated) | 475 |
| | Yellow color-forming layer (u) | 84 |
| | Developing agent (v) | 60 |
| | Anti-fogging agent (w) | 6 |
| | Organic solvent having a high boiling point (d) | 74 |
| | Surfactant (e) | 4 |
| | Water-soluble polymer (h) | 2 |
| Yellow color-forming layer | Lime-processed gelatin | 1400 |
| | Blue-sensitive emulsion C (based on the weight of silver coated) | 604 |
| | Yellow color-forming layer (u) | 532 |
| | Developing agent (v) | 382 |
| | Anti-fogging agent (w) | 40 |
| | Organic solvent having a high boiling point (d) | 469 |
| | Surfactant (e) | 23 |
| | Water-soluble polymer (h) | 10 |
| Intermediate layer | Lime-processed gelatin | 750 |
| | Surfactant (e) | 15 |
| | Leuco dye (x) | 303 |
| | Color developer (y) | 433 |
| | Water-soluble polymer (h) | 15 |
| Magenta color-forming layer | Lime-processed gelatin | 150 |
| | Green-sensitive emulsion A (based on the weight of silver coated) | 647 |
| | Magenta dye—forming coupler (a) | 48 |
| | Developing agent (b) | 33 |
| | Anti-fogging agent (c) | 0.02 |
| | Organic solvent having a high boiling point (d) | 50 |
| | Surfactant (e) | 3 |
| | Water-soluble polymer (h) | 1 |
| Magenta color-forming layer | Lime-processed gelatin | 220 |
| | Green-sensitive emulsion B (based on the weight of silver coated) | 475 |
| | Magenta dye—forming coupler (a) | 70 |
| | Developing agent (b) | 49 |
| | Anti-fogging agent (c) | 0.02 |
| | Organic solvent having a high boiling point (d) | 74 |
| | Surfactant (e) | 4 |
| | Water-soluble polymer (h) | 2 |
| Magenta color-forming layer | Lime-processed gelatin | 1400 |
| | Green-sensitive emulsion C (based on the weight of silver coated) | 604 |
| | Magenta dye-forming coupler (a) | 446 |
| | Developing agent (b) | 311 |
| | Anti-fogging agent (c) | 0.14 |
| | Organic solvent having a high boiling point (d) | 469 |
| | Surfactant (e) | 23 |
| | Water-soluble polymer (h) | 10 |

TABLE 18-continued

| Structure of photosensitive materials for heat development | | (mg/m²) |
|---|---|---|
| Intermediate layer | Lime-processed gelatin | 900 |
| | Surfactant (e) | 15 |
| | Leuco dye (z) | 345 |
| | Color developer (y) | 636 |
| | Zinc hydroxide | 1100 |
| | Water-soluble polymer (h) | 15 |
| Cyan color-forming layer | Lime-processed gelatin | 150 |
| | Red-sensitive emulsion A | 647 |
| | (based on the weight of silver coated) | |
| | Cyan dye-forming coupler (aa) | 65 |
| | Developing agent (b) | 33 |
| | Anti-fogging agent (c) | 0.03 |
| | Organic solvent having a high boiling point (d) | 50 |
| | Surfactant (e) | 3 |
| | Water-soluble polymer (h) | 1 |
| Cyan color-forming layer | Lime-processed gelatin | 220 |
| | Red-sensitive emulsion B | 475 |
| | (based on the weight of silver coated) | |
| | Cyan dye-forming coupler (aa) | 96 |
| | Developing agent (b) | 49 |
| | Anti-fogging agent (c) | 0.05 |
| | Organic solvent having a high boiling point (d) | 74 |
| | Surfactant (e) | 4 |
| | Water-soluble polymer (h) | 2 |
| Cyan color-forming layer | Lime-processed gelatin | 1400 |
| | Red-sensitive emulsion C | 604 |
| | (based on the weight of silver coated) | |
| | Cyan dye-forming coupler (aa) | 610 |
| | Developing agent (b) | 311 |
| | Anti-fogging agent (c) | 0.32 |
| | Organic solvent having a high boiling point (d) | 469 |
| | Surfactant (e) | 23 |
| | Water-soluble polymer (h) | 10 |
| Antihalation layer | Lime-processed gelatin | 750 |
| | Surfactant (e) | 15 |
| | Leuco dye (ab) | 243 |
| | Color developer (y) | 425 |
| | Water-soluble polymer (h) | 15 |
| | Transparent PET support (120 μm) | |

Leuco Dye (Ab)

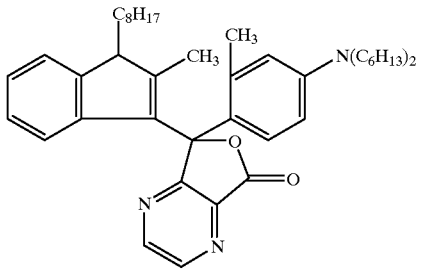

Yellow-Coloring Leuco Dye (X)

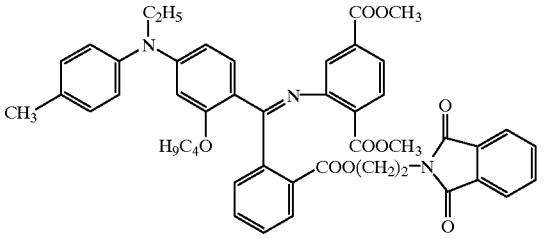

-continued

Color Developer (Y)

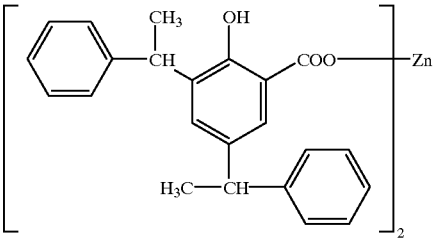

Magenta-Coloring Leuco Dye (Z)

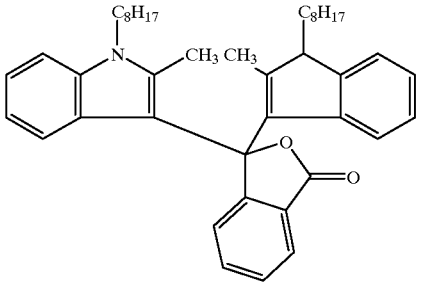

The effect of the present invention in a photosensitive material having a multilayered structure was confirmed by using silver halide emulsions prepared in Example 1 as the silver halide emulsions in Tables 18, 19 and 20. In Comparative Example 2, the emulsion α-1b, which was prepared in Comparative Example 1 and composed of grains having an equivalent-sphere diameter of 0.66 μm, was used as the blue-sensitive emulsion B in Table 18, while emulsions composed of grains having an equivalent-sphere diameter of 0.83 μm and 0.38 μm were prepared by repeating the method for preparing the emulsion α-1b in Comparative Example 1, except that the amount of silver in the formation of a nucleus and the rate of the addition of the reaction solutions were altered, and these emulsions were used as blue-sensitive emulsions A and C, respectively, in Table 18. Similarly, from emulsion α-1g and α-1r, green-sensitive emulsions A, B and C and red-sensitive emulsions A, B and C were obtained, respectively. By using these emulsions, a photosensitive material was obtained, which was designated as Sample 1101.

Further, in order to confirm the effect of the present invention, Samples 1102 to 1122 were prepared by repeating the procedure for preparing the sample of Comparative Example 2, except that the base emulsions α-1b, α-1g and α-1r were replaced, respectively, with A-1b to A-21b, A-1g to A-21g and A-1r to A-21r.

The photographic characteristics of these photosensitive materials were examined as in Comparative Example 1 and Example 1. Firstly, these photosensitive materials were exposed to the light of 1,000 lux for 1/100 second via an optical wedge and a blue, green or red filter.

After the exposure, a heat development was carried out by the procedure comprising supplying 15 ml/m² of warm water at 40° C. to the photosensitive layer of the photosensitive material, putting together the photosensitive layer and the processing layer of a processing material face to face and thereafter heating the materials to 83° C. to keep them at that temperature for 15 seconds by use of a heat drum. After the processing, when the processing material was removed, a magenta-colored wedged image was obtained in the photosensitive material which had been exposed through a green filter, a yellow-colored wedged image was obtained in the photosensitive material which had been exposed through a blue filter, and a cyan-colored wedged image was obtained in the photosensitive material which had been exposed through a red filter.

The colored samples were subjected to the transmission density measurement to obtain the so-called characteristic curve. The sensitivity was expressed as the reciprocal of an exposing light amount at a density 0.15 higher than fogging density. Sensitivities of Samples 1102 to 1122 were indicated in relative values by taking the sensitivity of the sample 1101 as 100. Meanwhile, the samples were exposed in such a manner that the density of the formed yellow, magenta and cyan colors were each 1.0, and the similar heat development was then carried out to produce colored samples, whose RMS granularity was measured through an aperture having a diameter of 48 μm by use of a diffused light source. The results obtained are shown in Table 22.

TABLE 22

| | Name of sample | Gelatin | Relative sensitivity | | | RMS granularity ($\times 10^{-2}$) | | |
|---|---|---|---|---|---|---|---|---|
| | | | B | G | R | B | G | R |
| Comparative example | 1101 | α | 100 | 100 | 100 | 4.0 | 3.8 | 3.6 |
| Present invention | 1102 | A1 | 98 | 101 | 99 | 3.6 | 3.2 | 3.3 |
| Present invention | 1103 | A2 | 99 | 99 | 102 | 3.5 | 3.3 | 3.4 |
| Present invention | 1104 | A3 | 100 | 101 | 100 | 3.4 | 3.2 | 3.1 |
| Present invention | 1105 | B1 | 97 | 99 | 98 | 2.9 | 2.3 | 2.5 |
| Present invention | 1106 | B2 | 98 | 102 | 100 | 2.8 | 2.3 | 2.4 |
| Present invention | 1107 | B3 | 101 | 101 | 101 | 2.7 | 2.4 | 2.3 |
| Present invention | 1108 | C1 | 99 | 100 | 102 | 2.7 | 2.2 | 2.4 |
| Present invention | 1109 | C2 | 100 | 101 | 100 | 2.5 | 2.1 | 2.3 |
| Present invention | 1110 | C3 | 98 | 98 | 101 | 2.6 | 2.1 | 2.4 |
| Present invention | 1111 | D1 | 102 | 99 | 100 | 2.2 | 1.9 | 1.9 |
| Present invention | 1112 | D2 | 99 | 100 | 100 | 2.2 | 1.9 | 1.9 |
| Present invention | 1113 | D3 | 101 | 99 | 99 | 2.1 | 1.6 | 1.6 |
| Present invention | 1114 | E1 | 98 | 99 | 100 | 3.0 | 2.9 | 2.8 |
| Present invention | 1115 | E2 | 102 | 101 | 99 | 3.0 | 2.9 | 2.9 |
| Present invention | 1116 | E3 | 100 | 99 | 99 | 2.9 | 2.8 | 2.7 |
| Present invention | 1117 | F1 | 99 | 100 | 102 | 2.9 | 2.9 | 2.8 |
| Present invention | 1118 | F2 | 101 | 99 | 98 | 2.7 | 2.8 | 2.8 |
| Present invention | 1119 | F3 | 102 | 100 | 101 | 2.7 | 2.6 | 2.7 |
| Present invention | 1120 | G1 | 99 | 99 | 100 | 2.8 | 2.6 | 2.7 |
| Present invention | 1121 | G2 | 100 | 99 | 101 | 2.7 | 2.4 | 2.7 |
| Present invention | 1122 | G3 | 99 | 100 | 102 | 2.6 | 2.6 | 2.6 |

From Table 22, it can be seen that an effect equivalent to that of Example 2 can be obtained even if a combination of the emulsions employed in Example 1 is coated to form a multilayered structure. That is, it is apparent that when a photosensitive material having a multilayered structure is prepared by using silver halide emulsions from various kinds of gelatin prepared in the stage of "preparation of modified gelatin" and using gelatin having a calcium content of 4,012 ppm at the dispersing stage and thereafter coating these emulsions to form a multilayered structure and the thus obtained photosensitive material is subjected to a heat development, a colored multilayered photosensitive material is produced which is free from spotted color unevenness and has a very good RMS granularity (in this case, the calcium ion content in the colored layers ranged from 3,700 to 39,000 ppm).

It was further confirmed that, even when a photosensitive material having a multilayered structure was prepared from other emulsions such as blue-sensitive emulsions B-1b to B-21b or C-1b to C-21b, green-sensitive emulsions B-1g to B-21g or C-1g to C-21g, and red-sensitive emulsions B-1r to B-21r or C-1r to C-21r prepared in Example 1, a colored multilayered photosensitive material having a better RMS granularity relative to that of Comparative Example 2 was also obtained.

Example 5

A color multilayered photosensitive material was prepared from the silver halide emulsions prepared in Examples 2 and 3 by using Example 4 as reference. In the evaluation test, it was found that the spotted color unevenness further diminished and the effect of the present invention was exhibited as in Examples 2 and 3.

Example 6

A photosensitive material, which had the same structure as that of the photosensitive material described in Example 2 (DRR compound) of JP-A No.9-121,265, was prepared by using the same emulsion as that for Sample 1113 of Example 4. According to the evaluation, the photosensitive material obtained exhibited sensitivity more than ten times higher and a better quality of digital print in comparison with the photosensitive material of Example 2 described in JP-A No.9-121,265.

Example 7

The procedure for preparing the color multilayered photosensitive material of Example 4 was repeated, except that the support as used therein was replaced with a support prepared in the following procedure, and the photosensitive material obtained was subjected to tests.

1) Support

A support used in this example was formed as follows.

100 parts by weight of a polyethylene-2,6-naphthalate (PEN) polymer and 2 parts by weight of Tinuvin P.326 (manufactured by Ciba-Geigy Co.) as an ultraviolet absorbent were dried, melted at 300° C., and extruded from a T-die. The resultant material was longitudinally stretched by 3.3 times at 140° C., then transversely stretched by 3.3 times at 130° C., and thermally fixed at 250° C. for 6 seconds. The result was a 90 μm-thick PEN film. Proper amounts of blue, magenta and yellow dyes (I-1, I-4, I-6, I-24, I-26, I-27 and II-5 described in Journal of Technical Disclosure No.94-6, 023) were added to this PEN film. The PEN film was wound around a stainless steel core having a diameter of 20 cm and given a thermal hysteresis of 48 hours at 110° C., thereby manufacturing a support with a high resistance to curling.

2) Formation of Subbing Layers

The two surfaces of the support were subjected to corona discharge, UV irradiation and glow discharge and thereafter coated with a solution for a subbing layer (10 cc/m$^2$, by using a bar coater), consisting of 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$ and 0.02 g/m$^2$ of a polyamide/epichlorohydrin polycondensate to one surface prepared the photosensitive layer to obtain a subbing layer. Drying was performed at 115° C. for 6 minutes (all of the rollers and conveyors in the drying zone were maintained at 115° C.).

3) Formation of Back Layers

One surface of the undercoated support was coated with an antistatic layer, a magnetic recording layer and a sliding layer, having the following compositions, respectively, as back layers.

3-1) Formation of Antistatic Layer 0.2 g/m$^2$ of a dispersion (secondary aggregate particle size: about 0.08 μm) of a fine powder of a tin oxide/antimony oxide composite material having an average particle size of 0.005 μm and a specific resistance of 5 Ω·cm was applied together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree: 10) and resorcin.

3-2) Formation of Magnetic Recording Layer 0.06 g/m$^2$ of cobalt-γ-iron oxide (specific surface area: 43 m$^2$/g; major axis: 0.14 μm: minor axis: 0.03 μm; saturation magnetization: 89 emu/g; $Fe^{+2}/Fe^{+3}$:6/94; surface-treated with aluminum oxide/silicon oxide in an amount corresponding to 2% by weight of the iron oxide) coated with 3-polyoxyethylene-propyloxytrimethoxysilane (polymerization degree: 15) (15% by weight), 1.2 g/m$^2$ of diacetylcellulose (iron oxide was dispersed by means of an open kneader and a sand mill) and 0.3 g/m$^2$ of $C_2H_5C(CH_2OCONH{-}C_6H_3(CH_3)NCO)_3$ as a hardener were applied by means of a bar coater by using acetone, methylethylketone and cyclohexanone as solvents, thus forming a 1.2 μm-thick magnetic layer. 10 mg/m$^2$ of silica particles (0.3 μm) as a matting agent and 10 mg/m$^2$ of aluminum oxide particles (0.15 μm) surface-coated with 3-polyoxyethylene-propyloxytrimethoxysilane (polymerization degree: 15) (15% by weight) as an abrasive were added. Drying was performed at 115° C. for 6 minutes (all of the rollers and conveyors in the drying zone were maintained at 115° C.). The color density increment of $D^B$ of the magnetic recording layer measured by an X-light (blue filter) was about 0.1. The saturation magnetization moment, coercive force and squareness ratio of the magnetic recording layer were 4.2 emu/g, $7.3\times10^4$ A/m and 65%, respectively.

3-3) Formation of a Sliding Layer

Diacetylcellulose (25 mg/m$^2$) and a mixture of $C_6H_{13}CH(OH)C_{10}H_{20}COOC_{40}H_{81}$ (compound a; 6 mg/m$^2$)/$C_{50}H_{101}O(CH_2CH_2O)_{16}H$ (compound b; 9 mg/m$^2$) were applied. It should be noted that this mixture was melted in xylene/propylenemonoglycolmonomethyl ether (1/1) at 105° C., added to and dispersed in propylenemonoglycolmonomethyl ether (tenfold amount) at room temperature, and formed into a dispersion (average particle size: 0.01 μm) in acetone before being added. 15 mg/m$^2$ of silica particles (0.3 μm) as a matting agent and 15 mg/m$^2$ of aluminum oxide particles (0.15 μm) surface-coated with 3-poly oxyethylene-propyloxytrimethoxysilane (polymerization degree: 15) (15% by weight) as an abrasive were added. Drying was performed at 115° C. for 6 minutes (all of the rollers and conveyors in the drying zone were maintained at 115° C.). The resultant sliding layer was found to have excellent characteristics. That is, the coefficient of kinetic friction was 0.06 (stainless steel hard ball having a diameter of 5 mmØ; load: 100 g; speed: 60 cm/minute) and the coefficient of static friction was 0.07 (clip method). The coefficient of kinetic friction between an emulsion surface to be described later and the sliding layer was also excellent and gave a value of 0.12.

The photosensitive material prepared was cut into a 24 mm-wide and 160 cm-long shape. Further, two 2 mm-square perforations with a spacing of 5.8 mm were formed on one side at 0.7 mm from end of width in the longitudinal direction, and this set of perforations was repeated at an interval of 32 mm. The thus obtained cut samples were loaded in plastic film cartridges illustrated in FIGS. 1 to 7 of U.S. Pat. No. 5,296,887.

From the side of the magnetic recording layer coated on the sample, FM signals were recorded between the perforations of the photosensitive material at a feed speed of 100 mm/second by using a head capable of inputting/outputting and having a head gap of 5 μm and a turn number of 2,000.

After the FM signals were recorded, the emulsion surface was given a uniform exposure amount of 1,000 cms on the front, and processed respectively by using the following method and thereafter again loaded in the original plastic film cartridge.

The photosensitive material loaded in the cartridge in the manner described above was subjected to tests. Excellent results were also obtained, and thus the effect of the present invention was also confirmed.

The silver halide photographic photosensitive material of the present invention has superior properties in that it produces no spotted color unevenness even in a simple and rapid heat developing process. It produces no spotted color unevenness and exhibits a high sensitivity/RMS granularity even when a highly sensitive emulsion having a high aspect ratio is used. Further, according to the method for forming an image of the present invention, it is possible to form an excellent image free from spotted color unevenness even when the photosensitive material is processed by a simple and rapid heat development.

What is claimed is:

1. A silver halide photosensitive material comprising a support and at least one photosensitive layer formed thereon, said photosensitive layer comprising at least a photosensitive silver halide emulsion, a developing agent, a compound, which forms a dye by a coupling reaction with an oxidized form of the developing agent, and a binder, said silver halide photosensitive material after the exposure thereof being put together with a processing material, which comprises a support and a processing layer coated thereon containing at least a base and/or a base precursor, in the presence of water supplied between the layer of the silver halide photosensitive material and the layer of the processing material in an amount ranging from 1/10 to the equivalent of an amount which is required for the maximum swelling of the total of the layers of these materials excluding back layers thereof so that the layers face each other, and being heated to form a color image in the silver halide photosensitive material, wherein said photosensitive layer comprises gelatin which is modified so that the interaction thereof with silver is reduced, and a silver halide emulsion in which tabular silver halide grains, each having an aspect ratio of 2 or more where the aspect ratio is defined as a value obtained by dividing the projected grain diameter by the grain thickness, account for 50% or more of the total projected area of the silver halide grains of the emulsion, and wherein said gelatin is (i) a gelatin having an —$NH_2$ group content of 720 μmol or less per gram of gelatin and contains a —COOH group and a derivative thereof in an amount of 1,200 μmol or more per gram of gelatin, or (ii) a gelatin having an —$NH_2$ group content of 720 μmol or less per gram of gelatin and contains an —$SO_3H$ group and a derivative thereof in an amount of 5 μmol or more per gram of gelatin.

2. A silver halide photosensitive material according to claim 1, wherein the amount of calcium ions contained in said photosensitive layer is 4,000 ppm or less with respect to the amount of gelatin.

3. A silver halide photosensitive material according to claim 2, wherein the gelatin which is modified so that the interaction thereof with silver is reduced is a gelatin whose amino groups are chemically modified such that at least two carboxyl groups are introduced into the chemically modified part.

4. A silver halide photosensitive material according to claim 3, wherein the gelatin whose amino group is chemically modified such that at least two carboxyl groups are introduced into the chemically modified part is a trimellitated gelatin.

5. A silver halide photosensitive material according to claim 4, wherein the trimellitated gelatin is a gelatin which is trimellitated such that the amino group content of the gelatin is 190 μmol or less per gram of the gelatin.

6. A silver halide photosensitive material according to claim 1, wherein said gelatin which is modified so that the interaction thereof with silver is reduced is at least one selected from the following (i) to (v):

(i) gelatin having a methionine content of 50 μmol or less per gram of gelatin;

(ii) gelatin having an —$NH_2$ group content of 720 μmol or less per gram of gelatin;

(iii) gelatin having an —NH— group content of 1,800 μmol or less per gram of gelatin;

(iv) gelatin containing a —COOH group and a derivative thereof in an amount of 1,200 μmol or more per gram of gelatin; and (v) gelatin containing a —$SO_3H$ group and a derivative thereof in an amount of 5 μmol or more per gram of gelatin.

7. A silver halide photosensitive material according to claim 1, wherein the gelatin which is modified so that the interaction thereof with silver is reduced is a gelatin whose amino groups are chemically modified such that at least two carboxyl groups are introduced into the chemically modified part.

8. A silver halide photosensitive material according to claim 1, wherein said developing agent is at least one compound represented by any of the following formulas (1) to (5):

General formula (1)

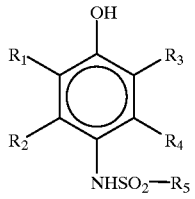

General formula (2)

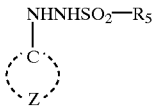

General formula (3)

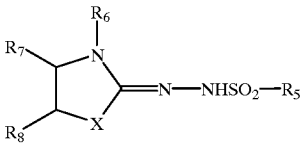

General formula (4)

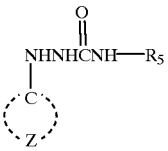

-continued

General formula (5)

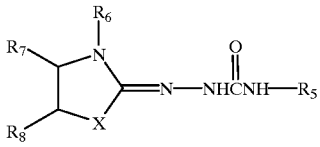

where $R_1$ to $R_4$ each represents a group selected from the group consisting of a hydrogen atom, a halogen atom, an alkyl group, an aryl group, an alkylcarbonamide group, an arylcarbonamide group, an alkylsulfonamide group, an arylsulfonamide group, an alkoxy group, a aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group; $R_5$ represents a group selected from the group consisting of an alkyl group, an aryl group and a heterocyclic group; Z stands for an atomic group forming an aromatic ring (including a heterocyclic/aromatic ring) and the total of Hammett's constants σ of the substituents is 1 or greater if Z is a benzene ring; $R_6$ represents an alkyl group; X represents a group selected from the group consisting of an oxygen atom, a sulfur atom, a selenium atom and a tertiary nitrogen atom bearing an alkyl or aryl substituent; $R_7$ and $R_8$ represent a group selected from the group consisting of a hydrogen atom and a substituent; and $R_7$ and $R_8$ may join together to form a double bond or a ring.

9. A silver halide photosensitive material comprising a support and at least one photosensitive layer formed thereon, said photosensitive layer comprising at least a photosensitive silver halide emulsion, a binder and a colorant which releases or diffuses a diffusive dye in proportion or in reverse proportion of the silver development, said silver halide photosensitive material after the exposure thereof being put together with a processing material, which comprises a support and a processing layer coated thereon containing at least a base and/or a base precursor, in the presence of water supplied between the layer of the silver halide photosensitive material and the layer of the processing material in an amount ranging from 1/10 to the equivalent of an amount which is required for the maximum swelling of the total of the layers of these materials excluding back layers thereof so that the layers face each other, and being heated to form a color image in the silver halide photosensitive material by removing part or all of the released or diffused diffusive dye through transfer thereof from the photosensitive material to the processing material, wherein said photosensitive layer comprises gelatin which is modified so that the interaction thereof with silver is reduced, and a silver halide emulsion in which tabular silver halide grains, each having an aspect ratio of 2 or more where the aspect ratio is defined as a value obtained by dividing the projected grain diameter by the grain thickness, account for 50% or more of the total projected area of the silver halide grains of the emulsion, and wherein said gelatin is (i) a gelatin having an —$NH_2$ group content of 720 μmol or less per gram of gelatin and contains a —COOH group and a derivative thereof in an amount of 1,200 μmol or more per gram of gelatin, or (ii) a gelatin having an —$NH_2$ group content of 720 μmol or less per gram of gelatin and contains an —$SO_3H$ group and a derivative thereof in an amount of 5 μmol or more per gram of gelatin.

10. A silver halide photosensitive material according to claim 9, wherein the amount of calcium ions contained in said photosensitive layer is 4,000 ppm or less with respect to the amount of gelatin.

11. A silver halide photosensitive material according to claim 10, wherein said developing agent is at least one compound represented by any of the following formulas (1) to (5):

General formula (1)

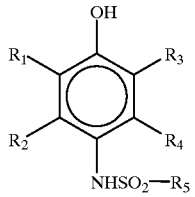

General formula (2)

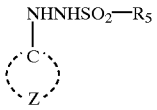

General formula (3)

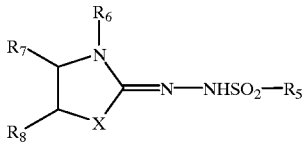

General formula (4)

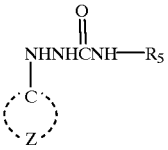

General formula (5)

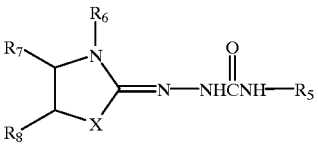

where $R_1$ to $R_4$ each represents a group selected from the group consisting of a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group; $R_5$ represents a group selected from the group consisting of an alkyl group, an aryl group and a heterocyclic group; Z stands for an atomic group forming an aromatic ring (including a heterocyclic/aromatic ring) and the total of Hammett's constants σ of the substituents is 1 or greater if Z is a benzene ring; $R_6$ represents an alkyl group; X represents a group selected from the group consisting of an oxygen atom, a sulfur atom, a selenium atom and a tertiary nitrogen atom bearing an alkyl or aryl substituent; $R_7$ and $R_8$ represent a group selected from the group consisting of a hydrogen atom and a substituent; and $R_7$ and $R_8$ may join together to form a double bond or a ring.

12. A silver halide photosensitive material according to claim 9, wherein said gelatin which is modified so that the interaction thereof with silver is reduced is at least one selected from the following (i) to (v):

(i) gelatin having a methionine content of 50 μmol or less per gram of gelatin;

(ii) gelatin having an —$NH_2$ group content of 720 μmol or less per gram of gelatin;

(iii) gelatin having an —NH— group content of 1,800 μmol or less per gram of gelatin;

(iv) gelatin containing a —COOH group and a derivative thereof in an amount of 1,200 μmol or more per gram of gelatin; and (v) gelatin containing a —$SO_3H$ group and a derivative thereof in an amount of 5 μmol or more per gram of gelatin.

13. A silver halide photosensitive material according to claim 9, wherein the gelatin which is modified so that the interaction thereof with silver is reduced is a gelatin whose amino groups are chemically modified such that at least two carboxyl groups are introduced into the chemically modified part.

14. A silver halide photosensitive material according to claim 9, wherein said developing agent is at least one compound represented by any of the following formulas (1) to (5):

General formula (1)

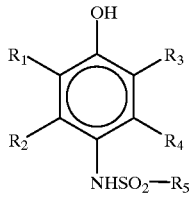

General formula (2)

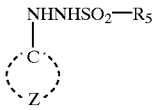

General formula (3)

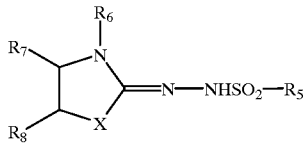

General formula (4)

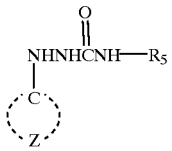

-continued

General formula (5)

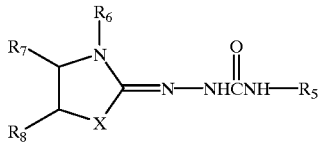

where $R_1$ to $R_4$ each represents a group selected from the group consisting of a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group; $R_5$ represents a group selected from the group consisting of an alkyl group, an aryl group and a heterocyclic group; Z stands for an atomic group forming an aromatic ring (including a heterocyclic/aromatic ring) and the total of Hammett's constants σ of the substituents is 1 or greater if Z is a benzene ring; $R_6$ represents an alkyl group; X represents a group selected from the group consisting of an oxygen atom, a sulfur atom, a selenium atom and a tertiary nitrogen atom bearing an alkyl or aryl substituent; $R_7$ and $R_8$ represent a group selected from the group consisting of a hydrogen atom and a substituent; and $R_7$ and $R_8$ may join together to form a double bond or a ring.

15. A method for forming an image comprising the steps of:

putting the silver halide photosensitive material of claim 1 after imagewise exposure thereof together with a processing material in the presence of water supplied between the photosensitive material and the processing material in an amount ranging from 1/10 to the equivalent of an amount which is required for the maximum swelling of the total of the layers of these material, and heating these materials at 60 to 100° C. for 5 to 60 seconds to form a color image in the photosensitive material.

16. A method for forming an image the steps of:

comprising putting the silver halide photosensitive material of claim 9 after imagewise exposure thereof together with a processing material in the presence of water supplied between the photosensitive material and the processing material in an amount ranging from 1/10 to the equivalent of an amount which is required for the maximum swelling of the total of the layers of these material, and heating these materials at 60 to 100° C. for 5 to 60 seconds to form a color image in the photosensitive material.

17. A method for forming an image comprising the steps of:

putting the silver halide photosensitive material of claim 10 after imagewise exposure thereof together with a processing material in the presence of water supplied between the photosensitive material and the processing material in an amount ranging from 1/10 to the equivalent of an amount which is required for the maximum swelling of the total of the layers of these material, and heating these materials at 60 to 100° C. for 5 to 60 seconds to form a color image in the photosensitive material.

18. A method for forming an image comprising the steps of:

putting the silver halide photosensitive material of claim 12 after imagewise exposure thereof together with a processing material in the presence of water supplied between the photosensitive material and the processing material in an amount ranging from 1/10 to the equivalent of an amount which is required for the maximum swelling of the total of the layers of these materials, and heating these materials at 60 to 100° C. for 5 to 60 seconds to form a color image in the photosensitive material.

19. A method for forming an image comprising the steps of:

putting the silver halide photosensitive material of claim 3 after imagewise exposure thereof together with a processing material in the presence of water supplied between the photosensitive material and the processing material in an amount ranging from 1/10 to the equivalent of an amount which is required for the maximum swelling of the total of the layers of these materials, and heating these materials at 60 to 100° C. for 5 to 60 seconds to form a color image in the photosensitive material.

20. A method for forming an image comprising the steps of:

putting the silver halide photosensitive material of claim 5 after imagewise exposure thereof together with a processing material in the presence of water supplied between the photosensitive material and the processing material in an amount ranging from 1/10 to the equivalent of an amount which is required for the maximum swelling of the total of the layers of these materials, and heating these materials at 60 to 100° C. for 5 to 60 seconds to form a color image in the photosensitive material.

* * * * *